US008224219B2

(12) United States Patent
Ishino et al.

(10) Patent No.: US 8,224,219 B2
(45) Date of Patent: Jul. 17, 2012

(54) FIXING DEVICE, IMAGE FORMING APPARATUS, HEAT FIXING MEMBER FOR FIXING DEVICE, CYLINDRICAL ROTATING MEMBER AND MEDIUM TRANSPORTING DEVICE

(75) Inventors: Masahiro Ishino, Saitama (JP); Yasuhiro Uehara, Kanagawa (JP); Motofumi Baba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 493 days.

(21) Appl. No.: 12/355,419

(22) Filed: Jan. 16, 2009

(65) Prior Publication Data

US 2009/0232569 A1 Sep. 17, 2009

(30) Foreign Application Priority Data

Mar. 12, 2008 (JP) ..... 2008-062889
Jun. 20, 2008 (JP) ..... 2008-162520

(51) Int. Cl.
*G03G 15/20* (2006.01)
*H05B 1/00* (2006.01)
*B21K 1/02* (2006.01)

(52) U.S. Cl. ..... 399/320; 399/328; 399/329; 399/330; 399/331; 219/216; 29/895.2; 29/895.21; 29/895.3

(58) Field of Classification Search ..... 399/320, 399/328–331; 219/216; 29/895.2, 895.21, 29/895.3

See application file for complete search history.

(56) References Cited

U.S. PATENT DOCUMENTS

| | | | | |
|---|---|---|---|---|
| 4,001,544 | A | 1/1977 | Heinzer et al. | |
| 5,499,089 | A * | 3/1996 | Tsukamoto et al. | 399/328 |
| 5,528,351 | A | 6/1996 | Tsuji | |
| 6,308,039 | B1 * | 10/2001 | Haneda et al. | 399/328 |
| 2002/0085866 | A1 | 7/2002 | Okayasu et al. | |
| 2005/0067407 | A1 * | 3/2005 | Tanino et al. | 219/619 |
| 2005/0147436 | A1 | 7/2005 | Koyama et al. | |
| 2005/0173417 | A1 * | 8/2005 | Takagi et al. | 219/619 |
| 2005/0271434 | A1 * | 12/2005 | Maeda | 399/333 |
| 2006/0182474 | A1 * | 8/2006 | Naito et al. | 399/329 |
| 2006/0213902 | A1 | 9/2006 | Nanjo | |
| 2007/0242990 | A1 | 10/2007 | Ohhara et al. | |

FOREIGN PATENT DOCUMENTS

| | | | |
|---|---|---|---|
| CN | 1629750 | A | 6/2005 |
| CN | 101059675 | A | 10/2007 |

(Continued)

*Primary Examiner* — David Porta
*Assistant Examiner* — Mindy Vu
(74) *Attorney, Agent, or Firm* — Morgan, Lewis & Bockius LLP

(57) ABSTRACT

A cylindrical rotating member rotatably supported in a device in state where it is configured to contact a medium and that is heated in state where it is supported in the device, including: an elastically deformable base body that is a metal cylinder extending in a width direction of the medium, the width direction intersecting a transport direction of the medium, the base body being configured such that: when the base body is rotated and a portion of the base body reaches a contact-portion at which the base body contacts the medium, the portion of the base body elastically deforms, applies pressure to the medium, increases the size of a contact-area with the medium and applies heat to the medium; and after the base body is further rotated and the portion of the base body has passed the contact-portion, the base body elastically recovers its original shape is provided.

16 Claims, 45 Drawing Sheets

FOREIGN PATENT DOCUMENTS

| | | |
|---|---|---|
| JP | 57-200071 | 12/1982 |
| JP | 11-024469 | 1/1999 |
| JP | 2001-215829 | 8/2001 |
| JP | 2002-116647 | 4/2002 |
| JP | 2002-148971 | 5/2002 |
| JP | 2002-148972 | 5/2002 |
| JP | 2002-196602 | 7/2002 |
| JP | 2002-214949 | 7/2002 |
| JP | 2004-52994 | 2/2004 |
| JP | 2004-144971 | 5/2004 |
| JP | 2005-202158 | 7/2005 |
| JP | 2005-225044 | 8/2005 |
| JP | 3738615 B | 11/2005 |
| JP | 2006-119677 | 5/2006 |
| JP | 2006-251622 | 9/2006 |
| JP | 2006-267198 | 10/2006 |

* cited by examiner

BASE BODY (TUBE) : LENGTH 250 mm, DIAMETER 25 mm (HALF MODEL), IRON
P/R: MODELED AS RUBBER LAYER WITH YOUNG'S MODULUS OF ABOUT 1.6 MPa
SHAFT: LENGTH 250 mm, DIAMETER 12 mm, IRON
ADD 100 N IN +Y↑ DIRECTION TO SHAFT END PORTION

OVERALL DIAGRAM

DEFORMATION DIAGRAM OF JUST HEAT ROLL BASE BODY (TUBE) (CONTOUR : DISPLACEMENT)

BASE BODY (TUBE) THICKNESS : 0.10 mm

BASE BODY (TUBE) THICKNESS : 0.16 mm

DEFORMATION DIAGRAM OF JUST HEAT ROLL BASE BODY (TUBE) (CONTOUR: DISPLACEMENT)

DEFORMATION DIAGRAM OF JUST HEAT ROLL BASE BODY (TUBE) (CONTOUR: DISPLACEMENT)

EMPHASIZED BY DOUBLING IN SCALE JUST IN 1Y DIRECTION

DEFORMATION DIAGRAM OF JUST HEAT ROLL BASE BODY (TUBE) (CONTOUR: DISPLACEMENT)

EMPHASIZED BY DOUBLING IN SCALE JUST IN ↑Y DIRECTION

BASE BODY (TUBE) THICKNESS : 0.10 mm

BASE BODY (TUBE) THICKNESS : 0.16 mm

P/R AND CROSS SECTION OF BASE BODY (TUBE)

END PORTION

P/R AND CROSS SECTION OF BASE BODY (TUBE)

CENTER TO END PORTION

BASE BODY (TUBE) THICKNESS : 0.10 mm

BASE BODY (TUBE) THICKNESS : 0.16 mm

P/R AND CROSS SECTION OF BASE BODY (TUBE)

CENTER

CROSS SECTION A-A'

CROSS SECTION B-B'

CROSS SECTION C-C'

CROSS SECTION D-D'

FIXING DEVICE, IMAGE FORMING APPARATUS, HEAT FIXING MEMBER FOR FIXING DEVICE, CYLINDRICAL ROTATING MEMBER AND MEDIUM TRANSPORTING DEVICE

CROSS-REFERENCE TO RELATED APPLICATIONS

This application is based on and claims priority under 35 USC 119 from Japanese Patent Applications No. 2008-062889 filed Mar. 12, 2008 and No. 2008-162520 filed Jun. 20, 2008.

BACKGROUND

1. Technical Field

The present invention relates to a fixing device, an image forming apparatus, a heat fixing member for a fixing device, a cylindrical rotating member and a medium transporting device.

2. Related Art

As a device that contacts a surface of a medium and applies heat to the medium, there is publicly known a fixing device that is used in image forming apparatus such as electrophotographic copiers and printers and fixes an unfixed toner image that has been transferred.

Further, as a device that contacts the surface of a medium and applies heat to the medium, there is publicly known a fixing device that is used in inkjet image forming apparatus outside of the electrophotographic image forming apparatus such as copiers and printers, is disposed on a medium transporting direction upstream side of an ink head that ejects ink, and applies heat to the medium.

SUMMARY

An aspect of the present invention is a cylindrical rotating member that is rotatably supported in a device in a state in which the cylindrical rotating member is configured to contact a medium and that is heated in a state in which the cylindrical rotating member is supported in the device, the cylindrical rotating member including:

an elastically deformable base body that is a metal cylinder extending in a width direction of the medium, the width direction intersecting a transport direction of the medium, the base body being configured such that: when the base body is rotated and a portion of the base body reaches a contact portion at which the base body contacts the medium, the portion of the base body elastically deforms without it being necessary to provide a member that contacts an inner surface of the base body in the contact portion from within, applies pressure to the medium, increases the size of a contact area with the medium and applies heat to the medium; and after the base body is further rotated and the portion of the base body has passed the contact portion, the base body elastically recovers its original shape.

BRIEF DESCRIPTION OF THE DRAWINGS

Exemplary embodiments of the invention will be described in detail with reference to the following figures, wherein.

DETAILED DESCRIPTION

Figure 1:
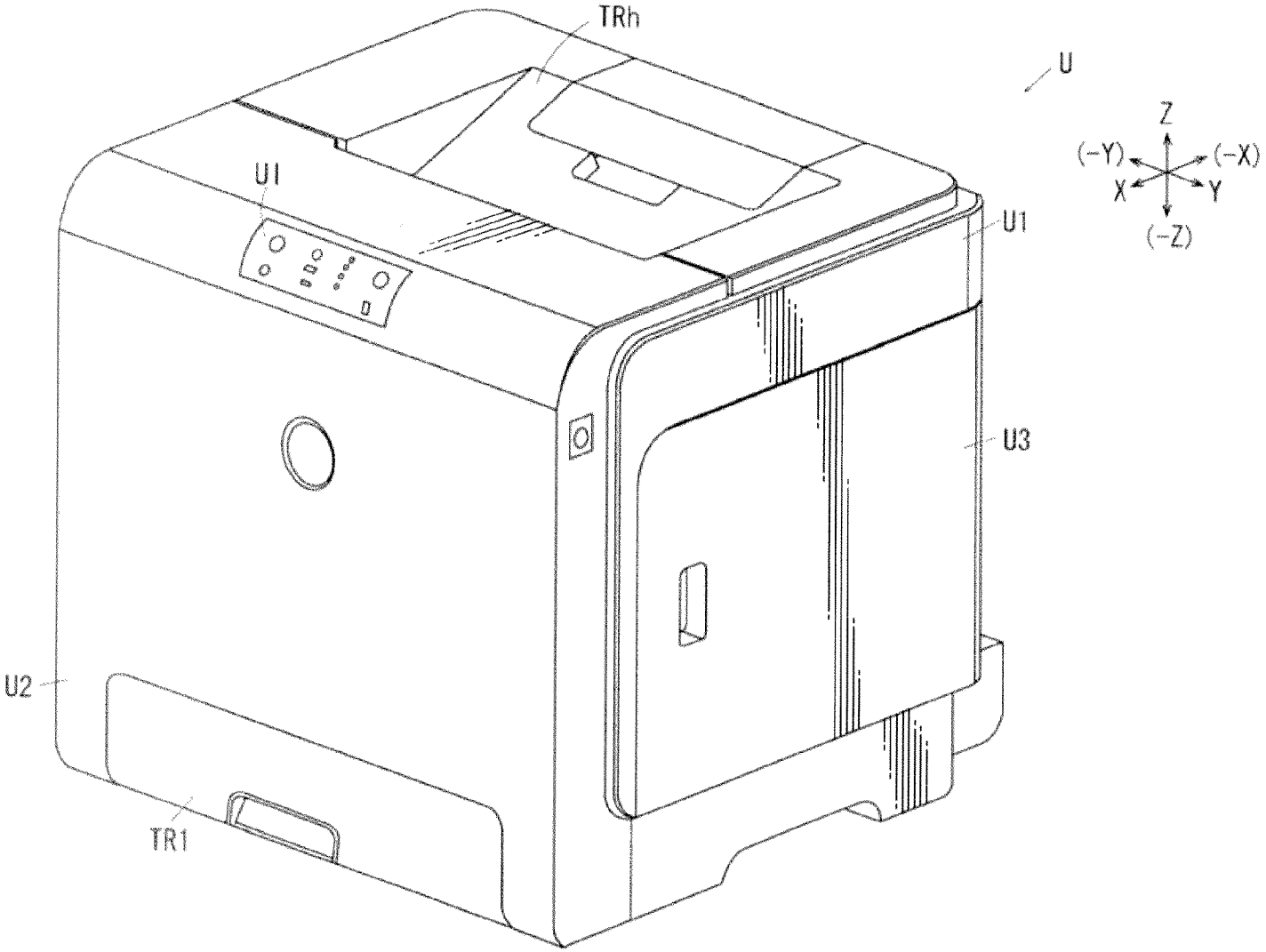
FIG. 1 is a perspective explanatory diagram of an image forming apparatus of exemplary embodiment 1 of the invention.

Next, specific example of modes of implementing the present invention (below, called exemplary embodiments) will be described with reference to the drawings, but the present invention is not limited to the exemplar embodiments below.

It will be noted that, in order to facilitate understanding of the description hereinafter, in the drawings, the front-rear direction will be referred to as an X axis direction, the right-left direction will be referred to as a Y axis direction, the up-down direction will be referred to as a Z axis direction, and directions or sides indicated by arrows X, −X, Y, −Y, Z and −Z respectively represent front, back, right, left, up and down or the front side, the back side, the right side, the left side, the up side and the down side.

Further, in the drawings, a circle with a dot in the middle means an arrow from the back of the page to the front, and a circle with an x (cross) in the middle means an arrow from the front of the page to the back.

It will also be noted that, in the description below using the drawings, illustration of members other than members needed for description will be appropriately omitted in order to facilitate understanding.

[Exemplary Embodiment 1]

FIG. 1 is a perspective explanatory diagram of an image forming apparatus of exemplary embodiment 1 of the invention.

Figure 2:
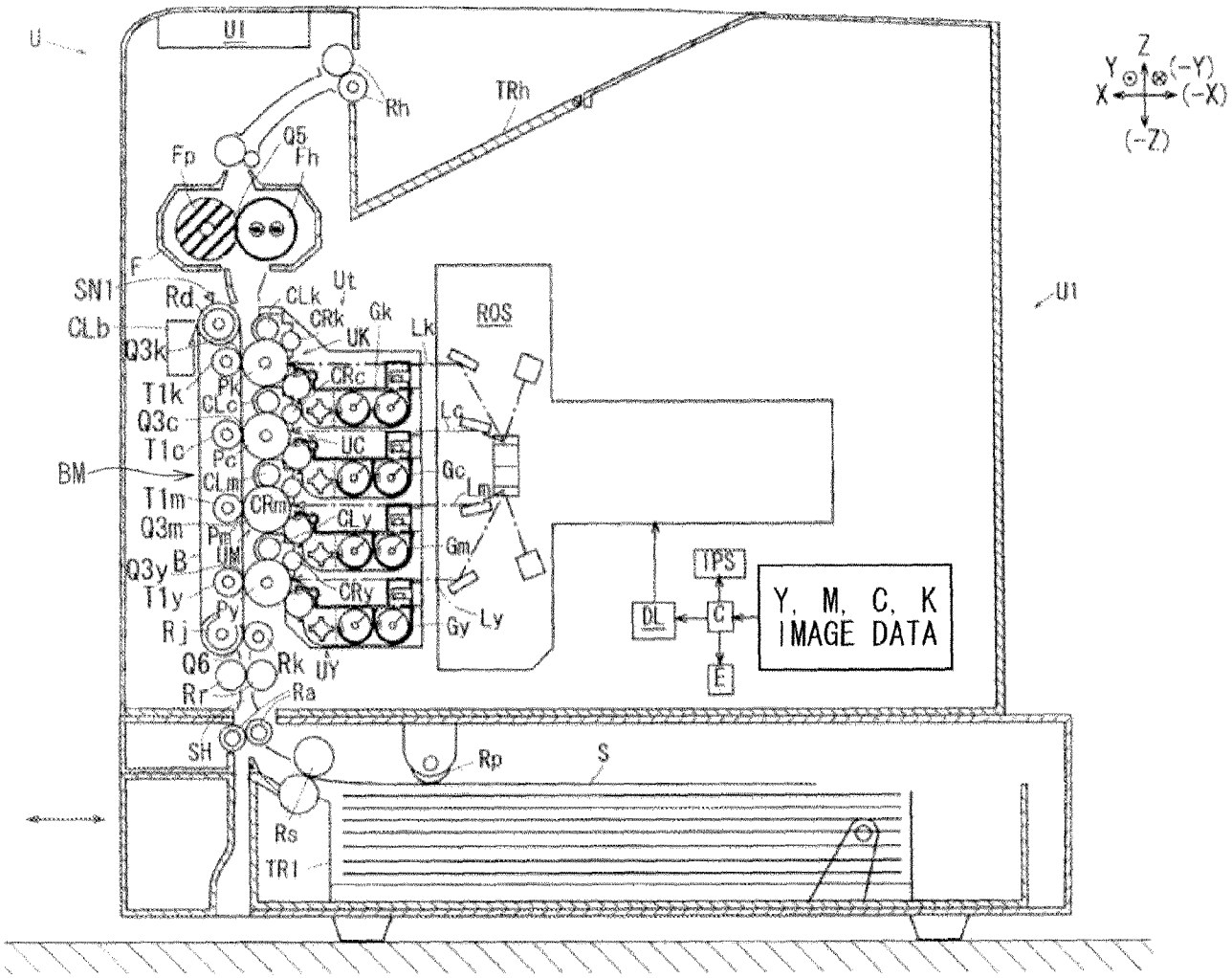
FIG. 2 is an overall explanatory diagram of the image forming apparatus of exemplary embodiment 1 of the invention.

FIG. 2 is an overall explanatory diagram of the image forming apparatus of exemplary embodiment 1 of the invention.

Figure 3:
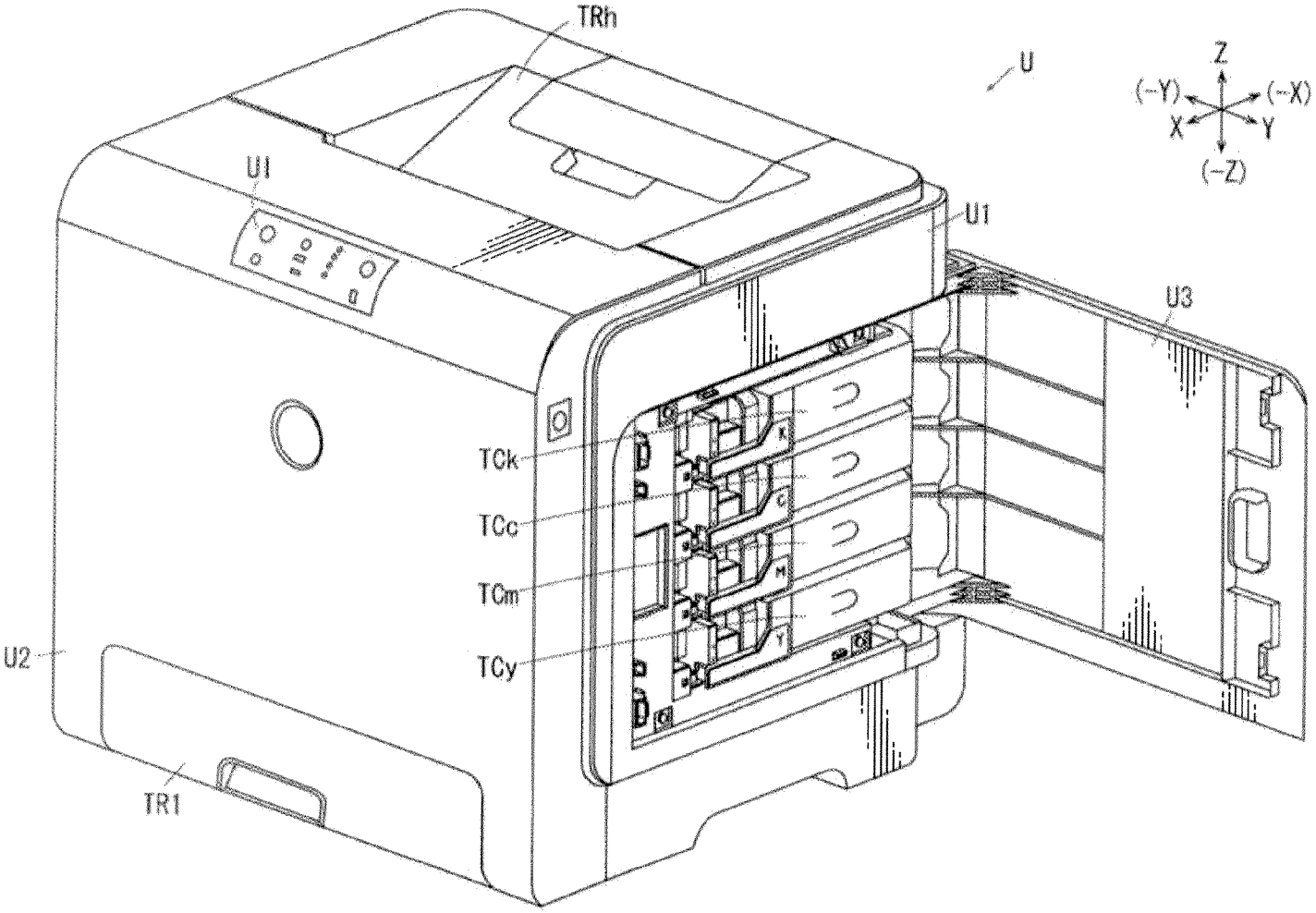
FIG. 3 is a perspective explanatory diagram of the image forming apparatus of exemplary embodiment 1 of the invention in a state where a side cover has been opened.

FIG. 3 is a perspective explanatory diagram of the image forming apparatus of exemplary embodiment 1 of the invention in a state where a side cover has been opened.

In FIG. 1 to FIG. 3, a printer U that serves as one example of the image forming apparatus of exemplary embodiment 1 of the invention is configured such that a paper feed tray TR1 in which are stored sheets S that serve as one example of a medium on which images are recorded is housed in the lower portion of the printer U and such that a paper discharge tray TRh is disposed in the upper surface of the printer U. Further, an operation portion UI for performing various kinds of operation such as button input is disposed on the upper portion of the printer U.

The printer U of exemplary embodiment 1 includes an image forming apparatus body U1, a front cover U2 that serves as one example of an openable/closable opening/closing portion that is disposed on the front of the image forming apparatus body U1, and a side cover U3 that serves as one example of an openable/closable opening/closing portion that is disposed on the side of the image forming apparatus body U1. The front cover U2 is opened when opening the inside of the image forming apparatus body U1 in order to replace an image carrier cartridge, a developing device or a failed member, for cleaning and maintenance, or to remove a jammed sheet S. The side cover U3 is opened when performing replacement of a developer replenishment container or a so-called toner cartridge.

In FIG. 3, when the side cover U3 of the printer U is moved to an open position, the side of the printer U is opened to enable handling of toner cartridges TCy, TCm, TCc and TCk that serve as one example of developer containers.

In FIG. 2, the printer U includes a controller C that performs various kinds of control of the printer U, an image processing section IPS whose operation is controlled by the controller C, an image writing device drive circuit DL and a power supply unit E. The power supply unit E applies a voltage to charge rolls CRy to CRk that serve as one example of later-described chargers, developing rollers that serve as one example of developer holders, and transfer rollers T1*y* to T1*k* that serve as one example of transfer devices.

The image processing section IPS converts printing information that has been inputted from an external image information transmitting device or the like into image information for latent image formation corresponding to an image of the four colors of black (K), yellow (Y), magenta (M) and cyan (C) and outputs the image information to the image writing device drive circuit DL at a predetermined timing. The image writing device drive circuit DL outputs a drive signal to a latent image forming device ROS in accordance with the image information of the respective colors that has been inputted. The latent image forming device ROS emits laser beams Ly, Lm, Lc and Lk that serve as one example of image writing light for image writing of the respective colors in accordance with the drive signal.

In FIG. 2, visible image forming devices UY, UM, UC and UK that form toner images that serve as one example of visible images of the respective colors of yellow (Y), magenta (M), cyan (C) and black (K) are disposed in front (+X direction) of the latent image forming device ROS.

The black (K) visible image forming device UK includes a photoconductor Pk that serves as one example of a rotating image carrier. Disposed around the photoconductor Pk are a charge roll CRk that serves as one example of a charger, a developing device Gk that develops an electrostatic latent image on the surface of the photoconductor Pk into a visible image and a photoconductor cleaner CLk that serves as one example of an image carrier cleaner that removes developer remaining on the surface of the photoconductor Pk.

The surface of the photoconductor Pk is uniformly charged by the charge roll CRk in a charging region that faces the charge roll CRk, and thereafter a latent image is written by the laser beam Lk in a latent image forming region. As for the electrostatic latent image that has been written, the electrostatic latent image is made into a visible image in a developing region that faces the developing device Gk.

The black visible image forming device UK of exemplary embodiment 1 is configured by an image carrier cartridge where the photoconductor Pk, the charger CRk and the photoconductor cleaner CLk are integrally configured and replaceable and by a replaceable developing cartridge that is configured by the developing device Gk.

The visible image forming devices UY, UM and UC of the other colors are, in the same manner as the black visible image forming device UK, configured by an image carrier cartridge and a developing cartridge that are attachable to and detachable from the image forming apparatus body U1. It will be noted that, in exemplary embodiment 1, the four visible image forming devices UY to UK are supported on an attachable and detachable frame body Ut, or a so-called replacement frame Ut, and the four visible image forming devices UY to UK are configured to be integrally replaceable with respect to the image forming apparatus body U1.

In FIG. 2, a belt module BM that serves as one example of a recording medium transporting device that is supported on the opening/closing portion U2 is disposed in front (+X direction) of the photoconductors Py to Pk. The belt module BM includes a medium transporting belt B that serves as one example of a recording medium holding and transporting member, belt support rolls (Rd and Rj) that serve as one example of a holding and transporting member support system that includes a belt drive roll Rd that serves as one example of a drive member that supports the medium transporting belt B and a driven roll Rj that serves as one example of a driven member, transfer rolls T1*y*, T1*m*, T1*c* and T1*k* that serve as one example of transfer devices that are disposed facing the photoconductors Py to Pk, a belt cleaner CLb that serves as one example of a holding and transporting member cleaner, and a medium attracting roll Rk that serves as one example of a recording medium attracting member that is disposed facing the driven roll Rj and causes the sheets S to be attracted to the medium transporting belt B. The medium attracting roll Rk is not invariably necessary and may be omitted. The medium transporting belt B is rotatably supported by the belt support rolls Rd and Rj.

It will be noted that an image density sensor SN1 is for detecting the density of an image for density detection or a so-called patch image that is formed by an unillustrated image density adjusting component of the controller C at a predetermined time period, and the image density adjusting component performs adjustment of the voltages applied to the chargers CRy to CRk, the developing devices Gy to Gk and the transfer rolls T1*y* to T1*k* and adjustment of the intensity of the latent image writing light beams Ly to Lk on the basis of the image density that has been detected by the image density detecting member, whereby the image density adjustment component performs adjustment and correction of image density or so-called process control.

The sheets S that serve as one example of a recording medium in the paper feed tray TR1 disposed below the medium transporting belt B are removed by a paper feed member Rp and transported to a medium transporting path SH.

The sheet S in the medium transporting path SH is transported by medium transporting rolls Ra that serve as one example of medium transporting members and is sent to registration rolls Rr that serve as one example of paper feed time period adjusting members. The registration rolls Rr transport the sheet S at a predetermined timing to a recording medium attracting position Q6 that is an opposing region between the driven roll Rj and the medium attracting roll Rk. The sheet S that has been transported to the recording medium attracting position Q6 is electrostatically attracted to the medium transporting belt B.

The sheet S that has been attracted to the medium transporting belt B sequentially passes through transfer regions Q3*y*, Q3*m*, Q3*c* and Q3*k* where the sheet S contacts the photoconductors Py to Pk.

A transfer voltage of the opposite polarity of the toner charge polarity is applied at a predetermined timing from the power supply unit E that is controlled by the controller C to the transfer rolls T1*y*, T1*m*, T1*c* and T1*k* that are disposed on the underside of the medium transporting belt B in the transfer regions Q3*y*, Q3*m*, Q3*c* and Q3*k*.

In the case of a multicolor image, the toner images on the photoconductors Py to Pk are superposed on and transferred to the sheet S on the medium transporting belt B by the transfer rolls T1*y*, T1*m*, T1*c* and T1*k*. Further, in the case of a single color image or a so-called black-and-white image, just the black (K) toner image is formed on the photoconductor Pk and just this black (K) toner image is transferred to the sheet S by the transfer device T1*k*.

The photoconductors Py to Pk after toner image transfer are cleaned as a result of toners remaining on their surfaces being collected by the photoconductor cleaners CLy to CLk and are again charged by the charge rolls CRy to CRk.

The toner image that has been transferred to the sheet S is fixed to the sheet S in a transfer region Q5 that is formed as a result of a heat roll Fh, which is one example of a heat fixing member of a fixing device F and serves as one example of a cylindrical rotating member, and a pressure roll Fp, which serves as one example of a pressure fixing member, pressure-contacting each other. The sheet S to which the image has been fixed is discharged into the medium discharge tray TRh from discharge rolls Rh that serve as one example of medium discharging members.

The medium transporting belt B after the sheet S has been released therefrom is cleaned by the belt cleaner CLb.

A medium transporting device of exemplary embodiment 1 is configured by the medium transporting path SH, the medium transporting rolls Ra, the registration rolls Rr, the medium transporting belt B, the heat roll Fh and the pressure roll Fp that serve as one example of medium transporting members of the fixing device F, and the discharge rolls Rh.

(Fixing Device)

Figure 4:
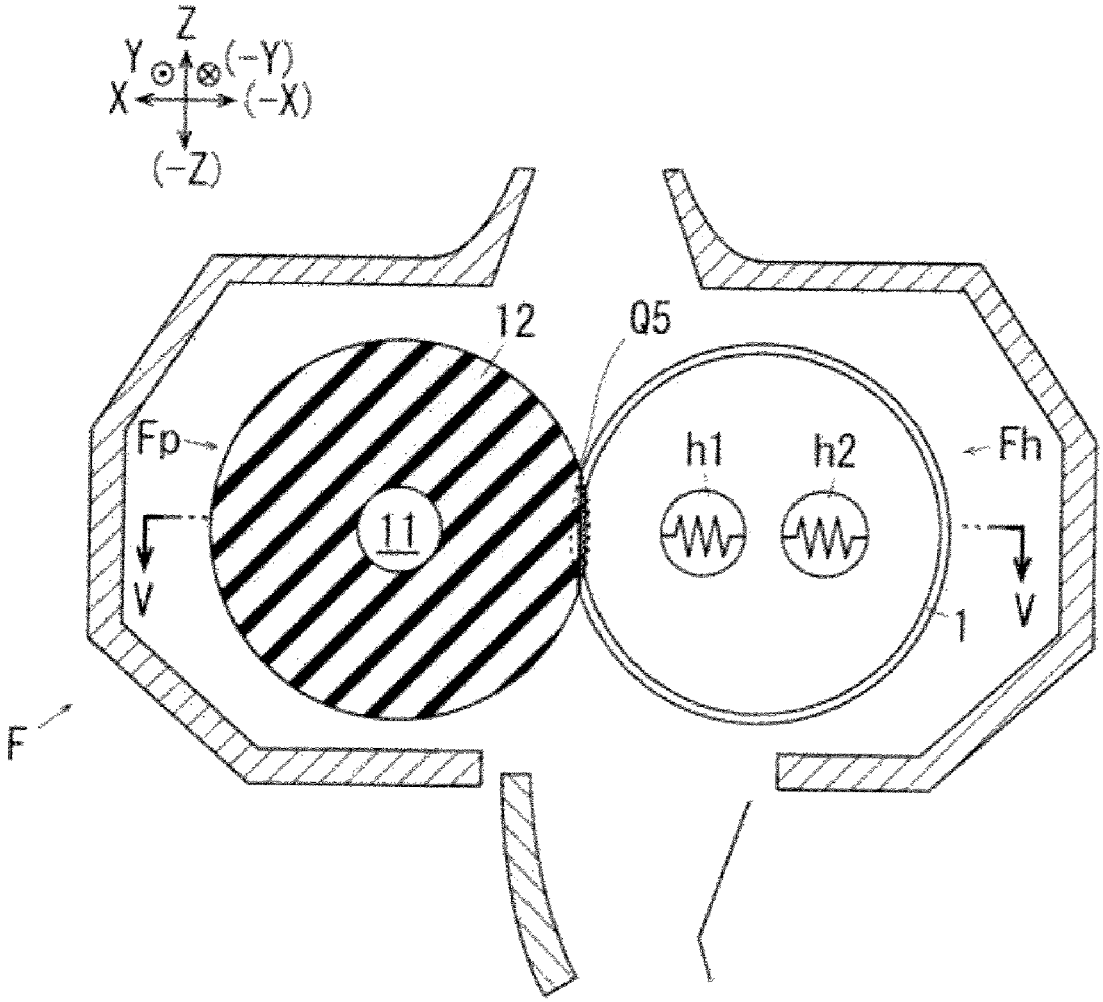
FIG. 4 is an enlarged cross-sectional diagram of a fixing device of exemplary embodiment 1.

FIG. 4 is an enlarged cross-sectional diagram of the fixing device F of exemplary embodiment 1.

Figure 5:
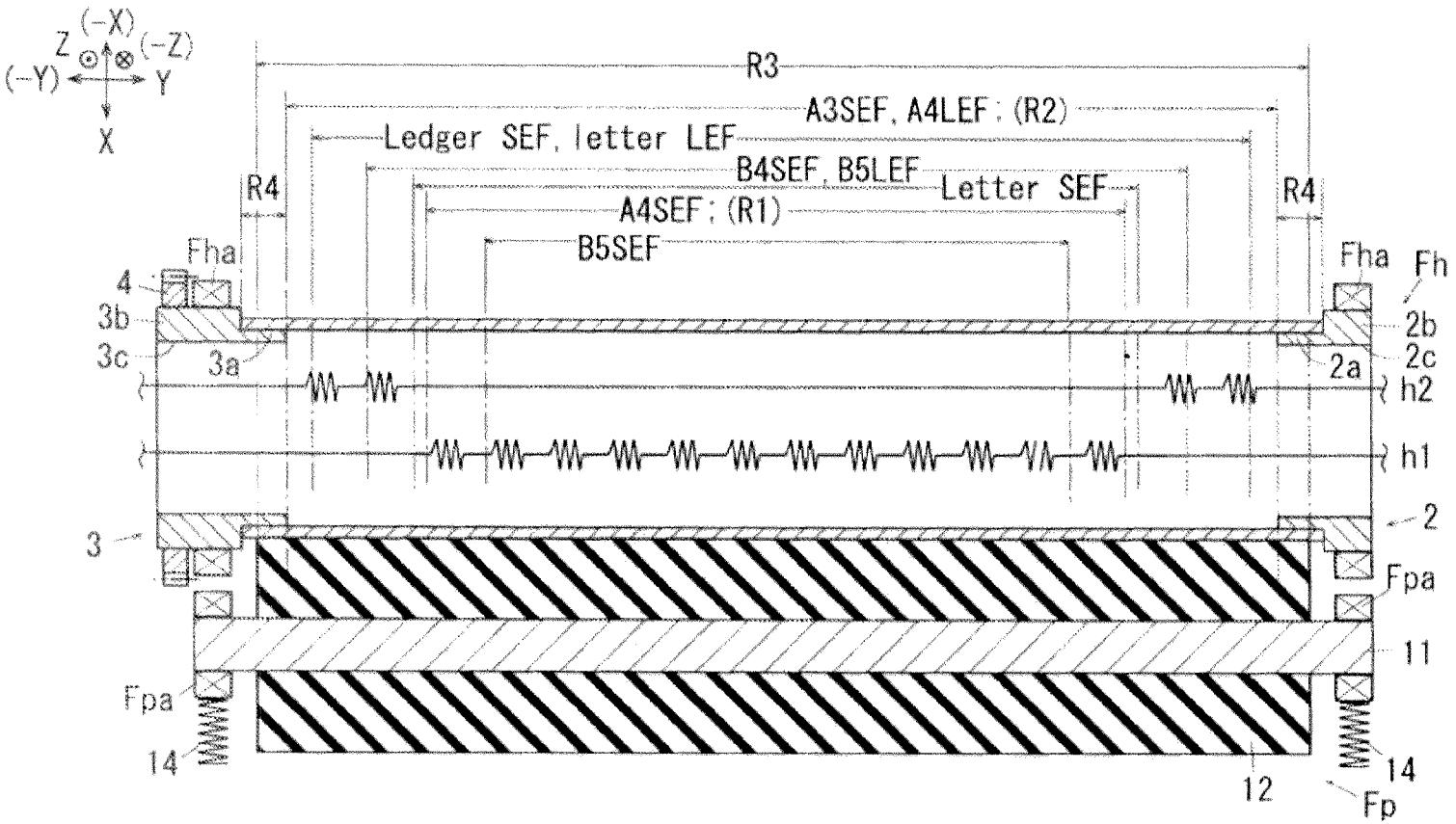
FIG. 5 is an explanatory diagram of relevant portions of a cross section along line V-V of FIG. 4.

FIG. 5 is an explanatory diagram of relevant portions of a cross section along line V-V of FIG. 4.

In FIG. 4 and FIG. 5, in the fixing device F of exemplary embodiment 1, the heat roll Fh includes a base body 1 that is configured by a cylinder of thin wall thickness that is made of metal and extends in the right-left direction. The base body 1 of exemplary embodiment 1 is configured by nickel steel with an outer diameter of 25 mm and with a thickness (wall thickness) of 0.1 mm and is configured to be elastically deformable and to hold a cylindrical shape by its own rigidity. Consequently, the base body 1 is configured such that the base body 1 elastically deforms by contact with the pressure roll Fp, widens the area of a contact region that is one example of a contact portion along the medium transporting direction, or so called a nip region that is one example of a fixing portion, and applies pressure to the medium in a contact region that is one example of a contact portion, or so called a nip region that is one example of a fixing portion, by its own elastic force between the pressure roll Fp, and also such that, in a state where the base body 1 is not contacting the pressure roll Fp, the base body 1 elastically returns to its original state by its own rigidity and returns to a cylindrical shape.

Please note that, hereinafter, there are cases where "wall thickness" may be merely mentioned as "thickness".

That is, the base body 1 of the heat roll Fh of exemplary embodiment 1 is configured such that, in contrast to a configuration that cannot hold a cylindrical shape by its own rigidity such as an endless member or a so-called belt member, further such that a pressing member or a so-called support member for causing the base body 1 to deform into a predetermined shape such as a planar shape in the fixing region Q5 and for applying a predetermined contact pressure to the base body 1 is not disposed inside.

It will be noted that, although 0.1 mm is exemplified as the thickness of the base body 1, the thickness of the base body 1 is not limited to this; it is also possible to make the thickness equal to or less than 0.15 mm, which is thinner than 0.16, which is the minimum thickness of a heat roll that is commonly used at present, and it is preferable for the thickness to be in the range of 0.07 mm to 0.12 mm. It is possible for the nickel steel with a thickness of 0.1 mm to be manufactured by an arbitrary method: for example, it is possible for the nickel steel to be configured by electroforming or deep drawing.

Further, nickel steel is exemplified as the material of the base body 1, but the material of the base body 1 is not limited to this material; for example, stainless steel, so-called stainless used steel (SIS), a nickel-cobalt alloy, copper, gold, and a nickel-iron alloy are usable. It will be noted that, in exemplary embodiment 1, the heat roll Fh is configured by just the base body 1, but it is also possible to form a surface layer or a so-called coating layer of several μm to several tens of μm on the surface of the base body 1 in order to raise releasability. It will be noted that it is preferable to use a fluorine resin whose releasability is good as the coating layer. It will be noted that, in exemplary embodiment 1, "contact region" means the portion of the base body 1 that contacts the medium and is the region of Q5 in FIG. 4 and the region of R2 in FIG. 5.

In FIG. 4 and FIG. 5, a pair of right and left substantially cylindrical holding members 2 and 3 are supported on both end portions of the base body 1. The holding members 2 and 3 include cylindrical base body insertion portions 2*a* and 3*a*, which are disposed on the inner end sides and are inserted into the base body 1, and cylindrical born portions (received portion) 2*b* and 3*b*, which are formed integrally on the outer end sides of the base body insertion portions 2*a* and 3*a*, are larger in diameter than the base body 1 and are thicker than the base body insertion portions 2*a* and 3*a*. Further, heater passage holes 2*c* and 3*c* that penetrate the holding members 2 and 3 in the axial direction are formed in the center portions of the holding members 2 and 3. The outer peripheries of the right and left holding members 2 and 3 are rotatably supported by bearing members (receiving portions) Fha, and a driven gear 4 to which driving force from an unillustrated drive source is transmitted is fixed to and supported on the outer end portion of the left side holding member 3.

Inside the heat roll Fh are housed a small-size heater for sheet (small-size sheet heater) h1 and a large-size heater for sheet (large-size sheet heater) h2 that serve as one example of heat source members that penetrate the base body 1 and the heater passage holes 2*c* and 3*c* and extend in the axial direction. In FIG. 5, the small-size sheet heater h1 is configured to heat substantially the same width as a small-size sheet fixing region R1 that is a region through which small-size sheets pass whose sheet width in the direction perpendicular to the sheet transporting direction is equal to or less than A4 SEF, and just the small-size sheet heater h1 is switched ON and OFF (controlled) when fixing an image to a sheet whose width is equal to or less than the width of a letter-size sheet short edge (Letter SE).

The large-size sheet heater h2 has a width that is substantially the same as a large-size sheet fixing region R2 that is a region through which large-size sheets pass whose sheet width in the direction perpendicular to the sheet transporting direction is longer than A4 SEF, but the large-size sheet heater h2 does not generate heat at the small size sheet fixing region R1 that is in the center portion thereof and just generates heat at both end portions. Additionally, both the large-size sheet heater h2 and the small-size sheet heater h1 are independently switched ON and OFF (controlled) when fixing an image to a sheet whose width is larger than the width of a letter-size sheet short edge (Letter SE).

It will be noted that, in FIG. 5, "LEF" in "A4 LEF", for example, is an abbreviation for "long edge feed" and means a sheet of paper that is transported with its long side on its leading end. Further, "SEF" in "A3 SEF" is an abbreviation for "short edge feed" and means a sheet of paper that is transported with its short side on its leading end. Consequently, in exemplary embodiment 1, in the fixing device F, a medium passage region whose width corresponds to the sheet width in the fixing region Q5, is set to the large-size sheet fixing region R2.

In FIG. 4 and FIG. 5, in the fixing device F of exemplary embodiment 1, the pressure roll Fp includes a shaft 11 that serves as one example of a rotating shaft and an elastic body layer 12 that is formed on the outer periphery of the shaft 11. The shaft 11 of exemplary embodiment 1 is configured by a metal material such as SUS with a diameter of 10 mm, and the thickness of the elastic body layer 12 is set such that the outer diameter of the pressure roll Fp becomes 25 mm.

Both end portions of the shaft 11 are rotatably supported by bearing members (receiving members) Fpa, and the bearing members Fpa are energized (urged) toward the heat roll Fh by coil springs 14 that serve as one example of energizing (urging) members. The coil springs 14 are set such that the total load falls in the range of about 200 [N] to about 300 [N] with the pressure roll Fp toward the heat roll side, and are set such that the pressure, which is force per unit area, becomes about 4 kgf/cm$^2$.

As the elastic body layer 12, an arbitrary elastic body material such as rubber may be used. The elastic body layer 12 may be given a single layer structure or a multilayer structure where plural elastic body layers or a surface layer are laminated. It is preferable to use fluororubber whose releasability is good on the outer surface.

Consequently, in the fixing device F of exemplary embodiment 1, the heat roll Fh is supported in a state where the holding portions 2 and 3 are attached to both end portions of the cylindrical base body 1, that is, the so-called sleeve heat roll body 1+2+3, and a state where the heaters h1 and penetrate the inside thereof, and the heaters h1 and h2 are disposed in a state where they are away from the inner surface of the base body 1. Additionally, the heat roll Fh generates heat in a state where the heaters h1 and h2 are fixed without rotating and is configured such that the holding members 2 and 3 and the base body 1 rotate. Thus, in the heat roll Fh of exemplary embodiment 1, in the fixing region Q5, a support member such as in the prior art that contacts the inner surface of the base body 1 from inside is not disposed, and heat is directly supplied to the base body 1 in the fixing region Q5 from the heaters h1 and h2 that are disposed away from the inner surface of the base body 1. It will be noted that the pressure roll Fp rotates following, that is, co-rotates along with, the rotation of the heat roll Fh that is rotated by the driven gear 4.

Figure 6:
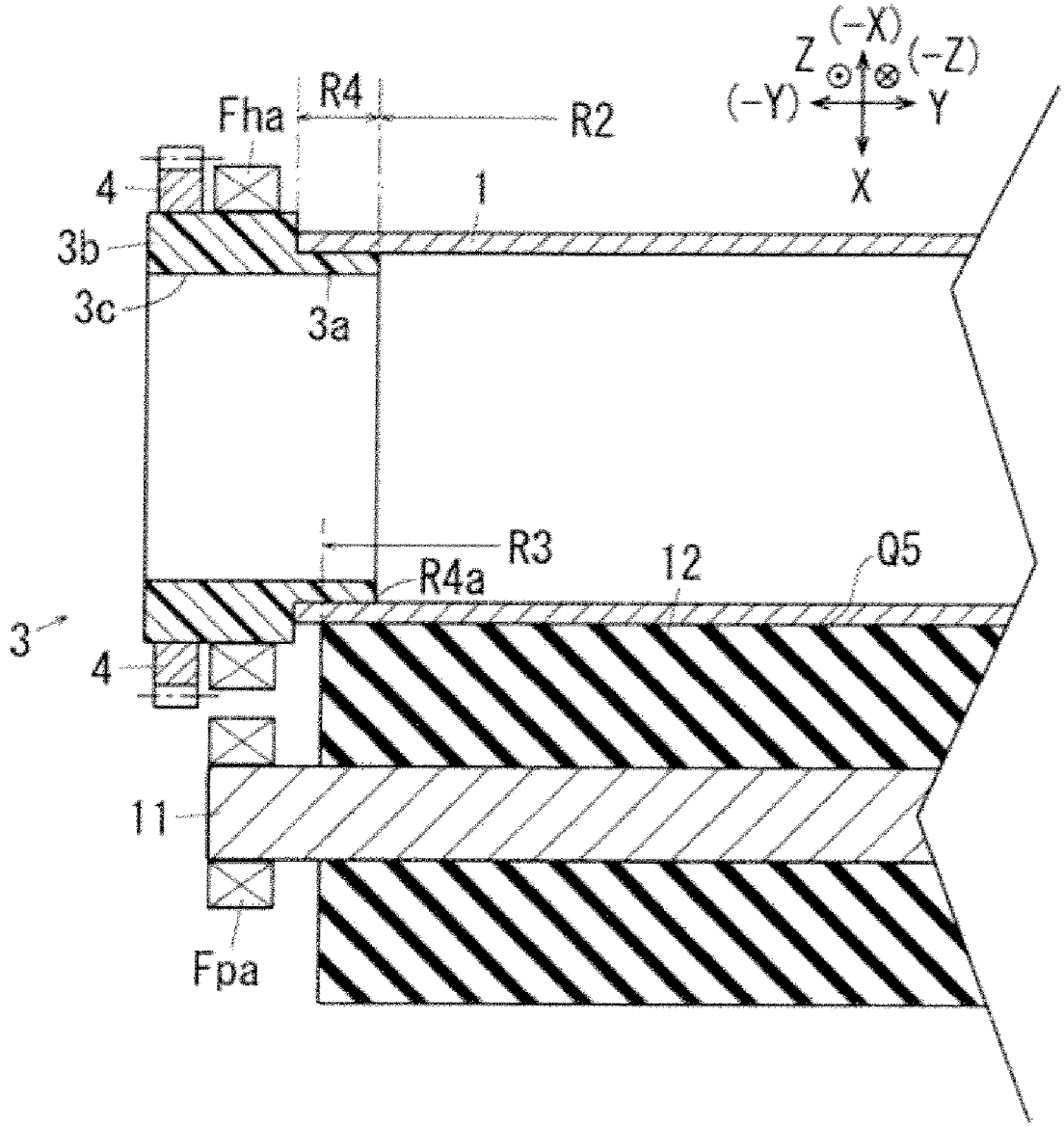
FIG. 6 is an enlarged explanatory diagram of relevant portions of an axial direction end portion of the fixing device of exemplary embodiment 1.

FIG. 6 is an enlarged explanatory diagram of main portions of an axial direction end portion of the fixing device of exemplary embodiment 1.

In FIG. 5 and FIG. 6, in the fixing device F of exemplary embodiment 1, the axial direction end portion in a region R3 where the elastic body layer 12 of the pressure roll Fp contacts the base body 1 along the medium width direction of the fixing region Q5, that is, along the axial direction, is set so as to overlap region R4 where the base body insertion portion 3*a* (2*a*) is inserted. Further, the axial direction end portions of the medium passage region R2 which the sheet S passes are set on the base body axial direction insides of the region R4 where the base body insertion portions 2*a* and 3*a* are inserted, that is, such that the regions R4 and the region R2 do not overlap each other.

(Operation of Exemplary Embodiment 1)

In the printer U that serves as one example of the image forming apparatus of exemplary embodiment 1 that is provided with the above-described configuration, the pressure roll Fp is pushed against the wall-thickness-thin metal cylindrical base body 1, and in the fixing region Q5, as shown in FIG. 4, the base body 1 and the elastic body layer 12 mutually elastically deform. At this time, the base body 1 and the elastic body layer 12 elastically deform in a substantially planar manner with respect to the sheet transporting direction, the fixing region Q5 becomes wider, the transporting performance of the sheet S improves, and stable fixing is performed. As a result, for example, when an envelope that serves as one example of a medium is used, a situation where crease arises in the envelope is reduced, and when thick paper is used as one example of a medium, curving of the thick paper is reduced.

Additionally, when the base body 1 rotates so the portion that has been elastically deformed in the fixing region Q5 moves away from the fixing region Q5, the portion that was elastically deformed elastically returns to a cylindrical shape. Consequently, in exemplary embodiment 1, the base body 1 is configured such that, when the base body 1 is rotated and passes through the fixing region Q5 where the base body 1 contacts the sheet S, the base body 1 elastically deforms without there having to be disposed a member that inner-contacts the inner surface of the metal cylinder in the fixing region Q5, so applies pressure to the sheet S, increases its area of contact with the sheet S and applies heat to the sheet S, and such that, when the base body 1 is further rotated and has passed through the fixing region Q5, there base body 1 elastically returns to its original state.

Further, in the fixing device F of exemplary embodiment 1, a member that presses the base body 1 from inside in correspondence to the fixing region Q5 and causes the base body 1 to deform into a predetermined shape is not necessary. Therefore, situations where, as in the prior art, the number of parts increases, heat capacity increases resulting from the increased number of parts, and electrical power consumption increases in order to heat further due to the increased heat capacity, are reduced. That is, the base body 1 is efficiently heated by the heaters h1 and h2 in comparison to a case where other members that have heat capacity are disposed and the temperature of the base body 1 is raised via those.

Consequently, in the fixing device F, the base body 1 is efficiently heated by the heaters h1 and h2, needless consumption of heat and electrical power is reduced, the temperature of the fixing region Q5 is efficiently and quickly raised, and the amount of time needed for the temperature to be raised until the start of fixing is shortened. Moreover, in the fixing device F of exemplary embodiment 1, the heat roll Fh has a configuration where a layer such as an elastic body layer is not formed on the base body 1 as in the prior and where an increase in heat capacity resulting from the layer is also reduced. Consequently, in the image forming apparatus U of exemplary embodiment 1, needless consumption of heat and electrical power is reduced, electrical power consumption and costs or so-called running costs during use are reduced, and electrical power is conserved.

Further, in FIG. 6, in the heat roll Fh, the holding members 2 and 3 hold a cylindrical shape and virtually do not deform such that driving force is transmitted by the driven gear 4 so as to be rotated, and the base body 1 elastically deforms in the fixing region Q5 such that its cylindrical shape is distortion. Supposing that the pressure roll Fp only contacts the base body 1 and the pressure roll Fp does not contact the regions R4, it becomes easy for stress concentration to occur in holding member inner end positions R4*a* that correspond to the inner end portions of the holding members 2 and 3, and particularly in a base body where an elastic body layer is not disposed on its surface, when its thickness becomes thinner, there is the potential for the base body to be fatigued and sustain damage due to repeated elastic deformation and elastic return to its original state. In contrast, in exemplary embodiment 1, the pressure roll Fp contacts the base body 1 in the regions R4 at positions that correspond to the holding members 2 and 3 that hold a cylindrical shape, and stress concentration in the holding member inner end positions R4*a* is alleviated. That is, in the heat roll Fh of exemplary embodiment 1, in the holding member inner end positions R4*a*, stress concentration, fatigue resulting from repeated elastic deformation and return, and damage such as folding resulting from repeated fatigue, bending and breaking are reduced, and the life of the heat roll Fh is lengthened.

[Exemplary Embodiment 2]

Next, description of exemplary embodiment 2 of the present invention will be performed. In the description of exemplary embodiment 2, identical reference signs will be given to configural elements that correspond to the configural elements of exemplary embodiment 1, and detailed description of those corresponding configural elements will be omitted.

Exemplary embodiment 2 differs from exemplary embodiment 1 in the following point but is configured in the same manner as exemplary embodiment 1 in other points.

Figure 7:
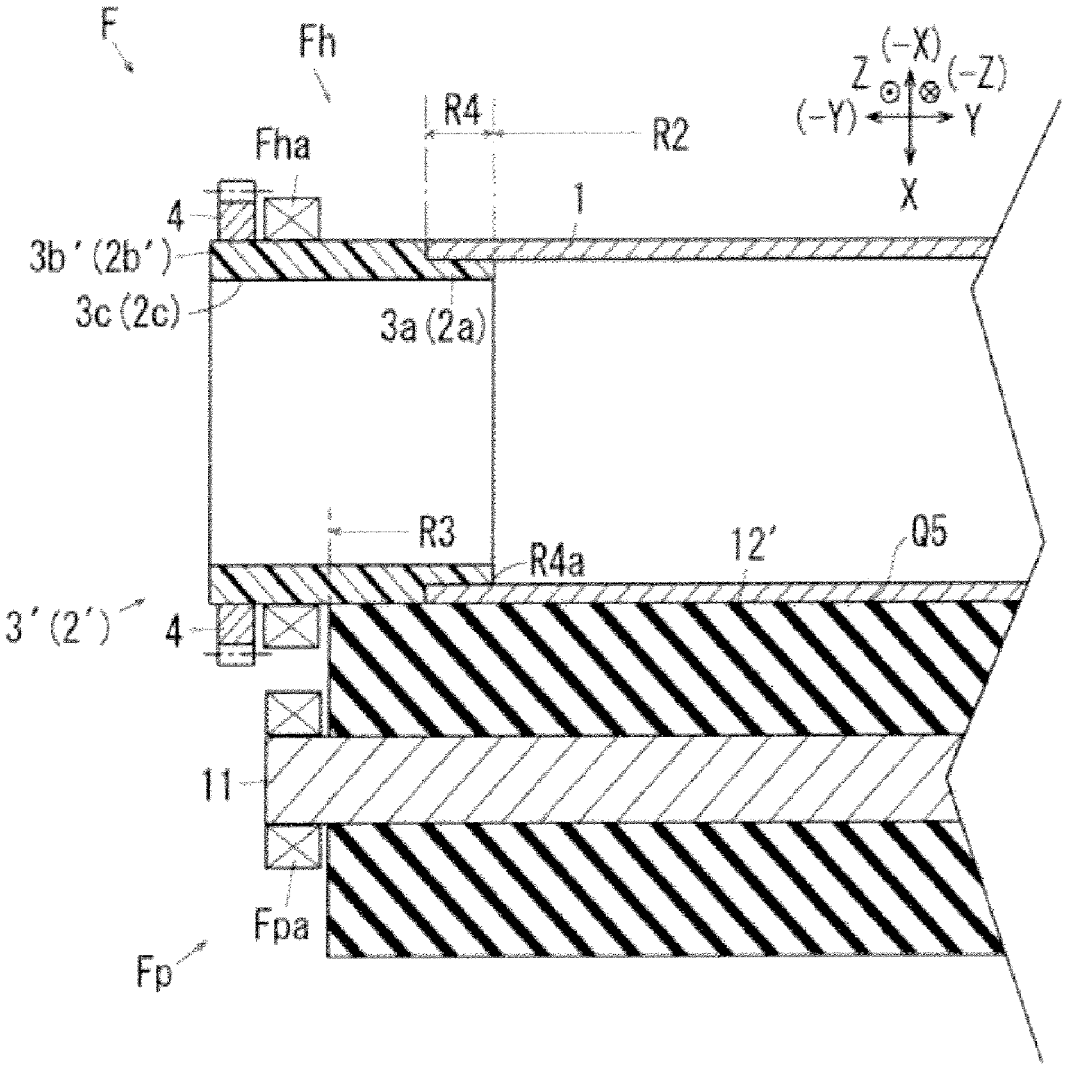
FIG. 7 is an enlarged explanatory diagram of relevant portions of an axial direction end portion of a fixing device of exemplary embodiment 2 and is a diagram that corresponds to FIG. 6 of exemplary embodiment 1.

FIG. 7 is an enlarged explanatory diagram of main portions of an axial direction end portion of a fixing device F of exemplary embodiment 2 and is a diagram that corresponds to FIG. 6 of exemplary embodiment 1.

In FIG. 7, in the fixing device F of exemplary embodiment 2, born portions 2*b*' and 3*b*' of holding members 2' and 3' are formed such that they are larger in diameter than the inner diameter of the base body 1 and such that they are equal in diameter to the outer diameter of the base body 1. Additionally, the lengths of both axial direction end portions of an elastic body layer 12' of the pressure roll Fp are formed longer than those of the elastic body layer 12 of exemplary embodiment 1, and the elastic body layer 12' is supported in a state where the outer surface of the elastic body layer 12' at the both end portions contacts the outer surfaces of the born portions 2*b*' and 3*b*'.

Consequently, a region R3 where the pressure roll Fp contacts the base body 1 along the medium width direction of the fixing region Q5, that is, along the axial direction, overlaps the regions R4 where the base insertion portions 2*a* and 3*a* are inserted, and the outer surface of the pressure roll Fp is disposed so as to contact the born portions 2*b*' and 3*b*'.

(Operation of Exemplary Embodiment 2)

In the fixing device F of exemplary embodiment 2 that is provided with the above-described configuration, stress concentration is alleviated in the same manner as in exemplary embodiment 1, the pressure roll Fp contacts not only the base body 1 but also directly the holding members 2' and 3' to which driving force is transmitted, and in comparison to a case where the pressure roll Fp contacts only the base body 1 that is thin and easily deforms and where there may remain the potential for driving force to not be sufficiently transmitted, efficient and sufficient driving force is transmitted from the heat roll Fh to the pressure roll Fp, and the sheet S is reliably transported.

[Exemplary Embodiment 3]

Next, description of exemplary embodiment 3 of the present invention will be performed. In the description of exemplary embodiment 3, identical reference signs will be given to configural elements that correspond to the configural elements of exemplary embodiment 1, and detailed description of those corresponding configural elements will be omitted.

Exemplary embodiment 3 differs from exemplary embodiment 1 in the following point but is configured in the same manner as exemplary embodiment 1 in other points.

Figure 8:
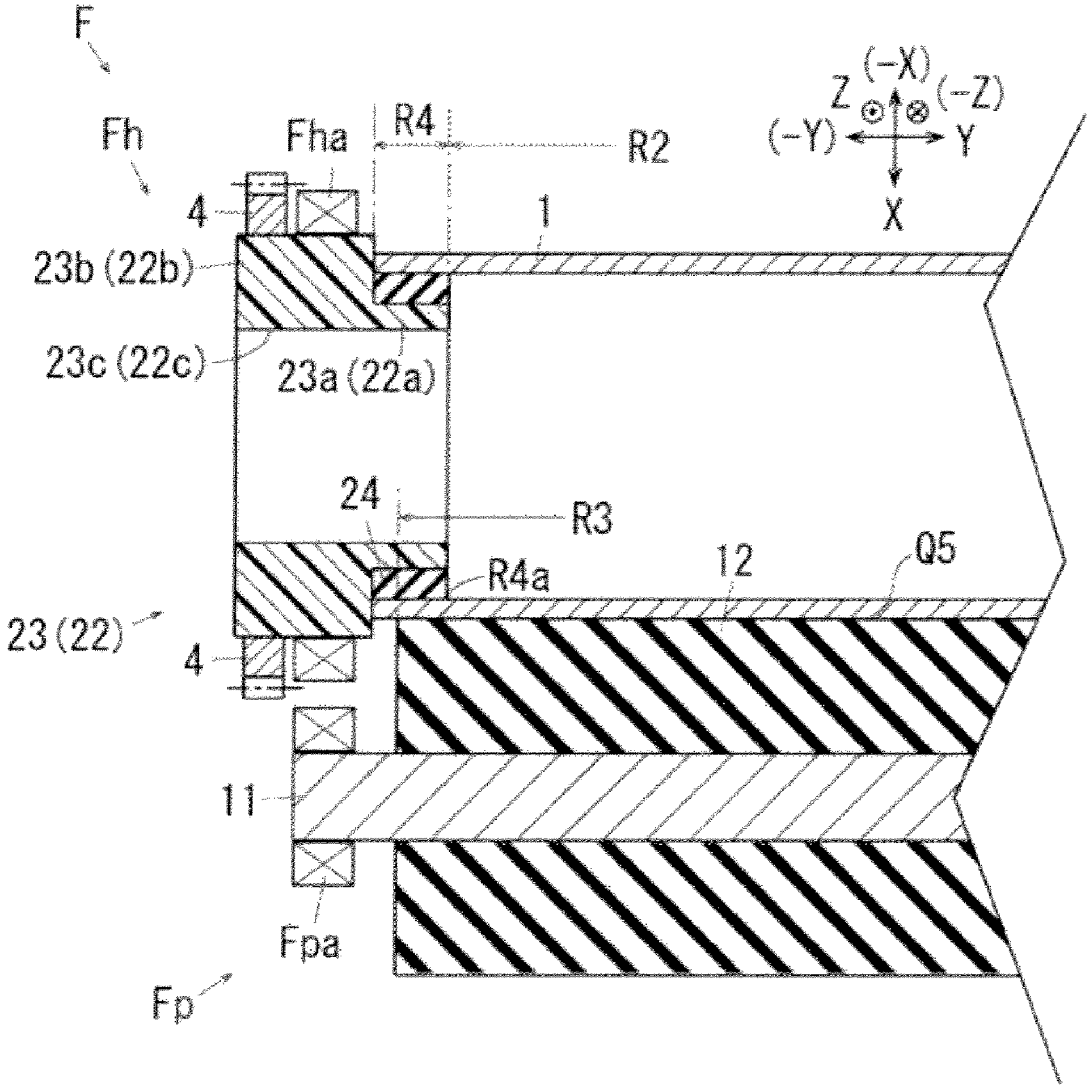
FIG. 8 is an enlarged explanatory diagram of relevant portions of an axial direction end portion of a fixing device of exemplary embodiment 3 and is a diagram that corresponds to FIG. 6 of exemplary embodiment 1.

FIG. 8 is an enlarged explanatory diagram of main portions of an axial direction end portion of a fixing device F of exemplary embodiment 3 and is a diagram that corresponds to FIG. 6 of exemplary embodiment 1.

In FIG. 8, in the fixing device F of exemplary embodiment 3, base body insertion portions 22*a* and 23*a* of holding members 22 and 23 are formed in smaller diameters in comparison to those of the base body insertion portions 2*a* and 3*a* of exemplary embodiment 1. Additionally, between the outer peripheral surfaces of the base body insertion portions 22*a* and 23*a* and the inner peripheral surface of the base body 1 there are supported cylindrical ring-shaped elastically deformable buffer rubber members 24 as one example of buffer members. Consequently, in the fixing device F of exemplary embodiment 3, the holding members 22 and 23 are configured by the base body insertion portions 22*a* and 23*a*. born portions 22*b* and 23*b* and the buffer rubber members 24. It will be noted that an arbitrary rubber such as silicone rubber, for example, may be used for the buffer rubber members 24, and a rubber material that has heat resistance is preferable because the buffer rubber members 24 receive heat from the heaters h1 and h2.

(Operation of Exemplary Embodiment 3)

In the fixing device F of exemplary embodiment 3 that is provided with the above-described configuration, the buffer rubber members 24 elastically deform in response to force that is received at both end portions of the base body 1 that elastically deforms by contact with the pressure roll Fp, and the buffer rubber members 24 absorb the force that is received and fulfill the role of so-called cushions. Thus, stress concentration in the base body 1 is alleviated.

[Exemplary Embodiment 4]

Next, description of exemplary embodiment 4 of the present invention will be performed. In the description of exemplary embodiment 4, identical reference signs will be given to configural elements that correspond to the configural elements of exemplary embodiments 1 to 3, and detailed description of those corresponding configural elements will be omitted.

Exemplary embodiment 4 differs from exemplary embodiments 1 to 3 in the following point but is configured in the same manner as exemplary embodiments 1 to 3 in other points.

Figure 9:
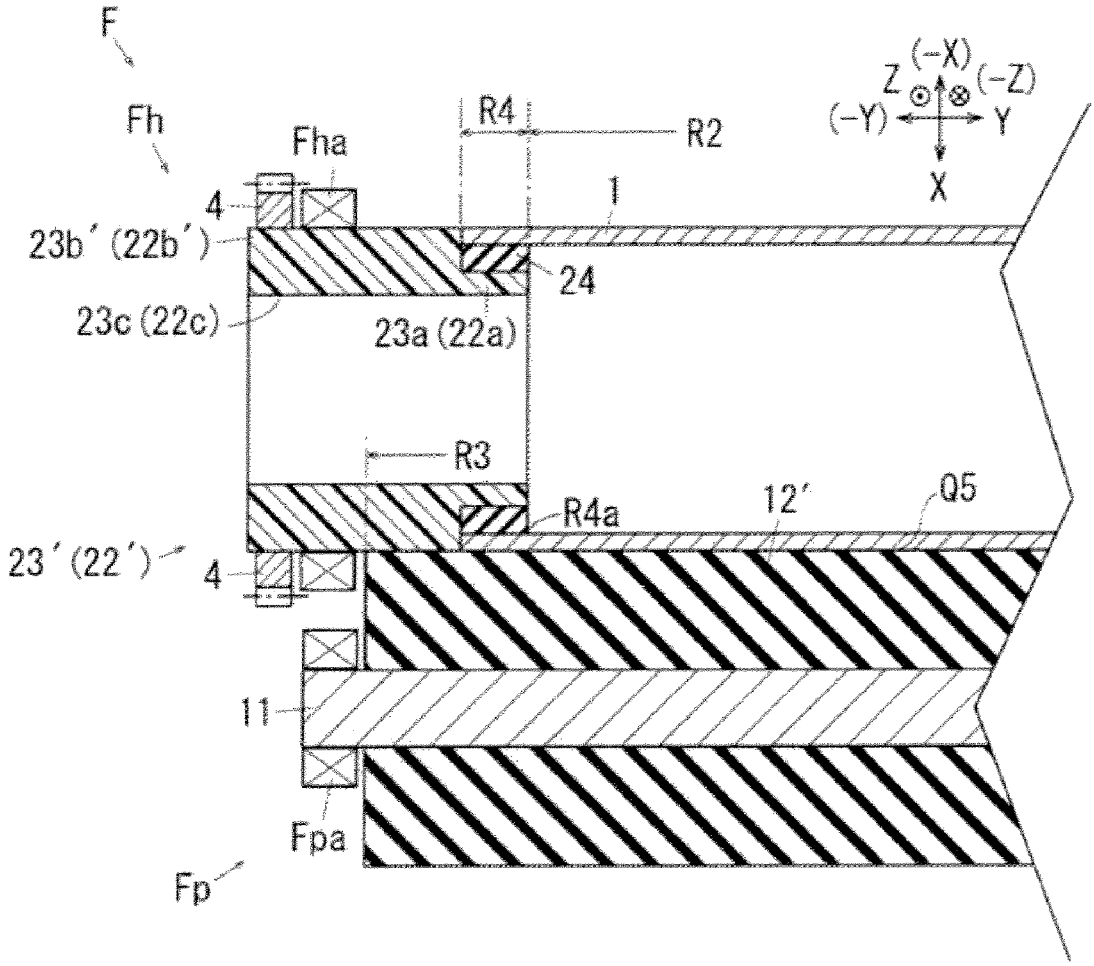
FIG. 9 is an enlarged explanatory diagram of relevant portions of an axial direction end portion of a fixing device of exemplary embodiment 4 and is a diagram that corresponds to FIG. 6 of exemplary embodiment 1.

FIG. 9 is an enlarged explanatory diagram of main portions of an axial direction end portion of a fixing device F of exemplary embodiment 4 and is a diagram that corresponds to FIG. 6 of exemplary embodiment 1.

In FIG. 9, in the fixing device F of exemplary embodiment 4, holding members 22' and 23' of exemplary embodiment 4 include the same buffer rubber members 24 as exemplary embodiment 3 and include born portions 22*b*' and 23*b*' with the same shape as those in exemplary embodiment 2.

(Operation of Exemplary Embodiment 4)

In the fixing device F of exemplary embodiment 4 that is provided with the above-described configuration, stress concentration is alleviated by the buffer rubber members 24 in the same manner as in exemplary embodiment 3, the life of the base body 1 and the fixing device F is lengthened, and driving force is reliably transmitted in the same manner as in exemplary embodiment 2.

[Exemplary Embodiment 5]

Next, description of exemplary embodiment 5 of the present invention will be performed. In the description of exemplary embodiment 5, identical reference signs will be given to configural elements that correspond to the configural elements of exemplary embodiment 1, and detailed description of those corresponding configural elements will be omitted.

Exemplary embodiment 5 differs from exemplary embodiment 1 in the following point but is configured in the same manner as exemplary embodiment 1 in other points.

Figure 10:
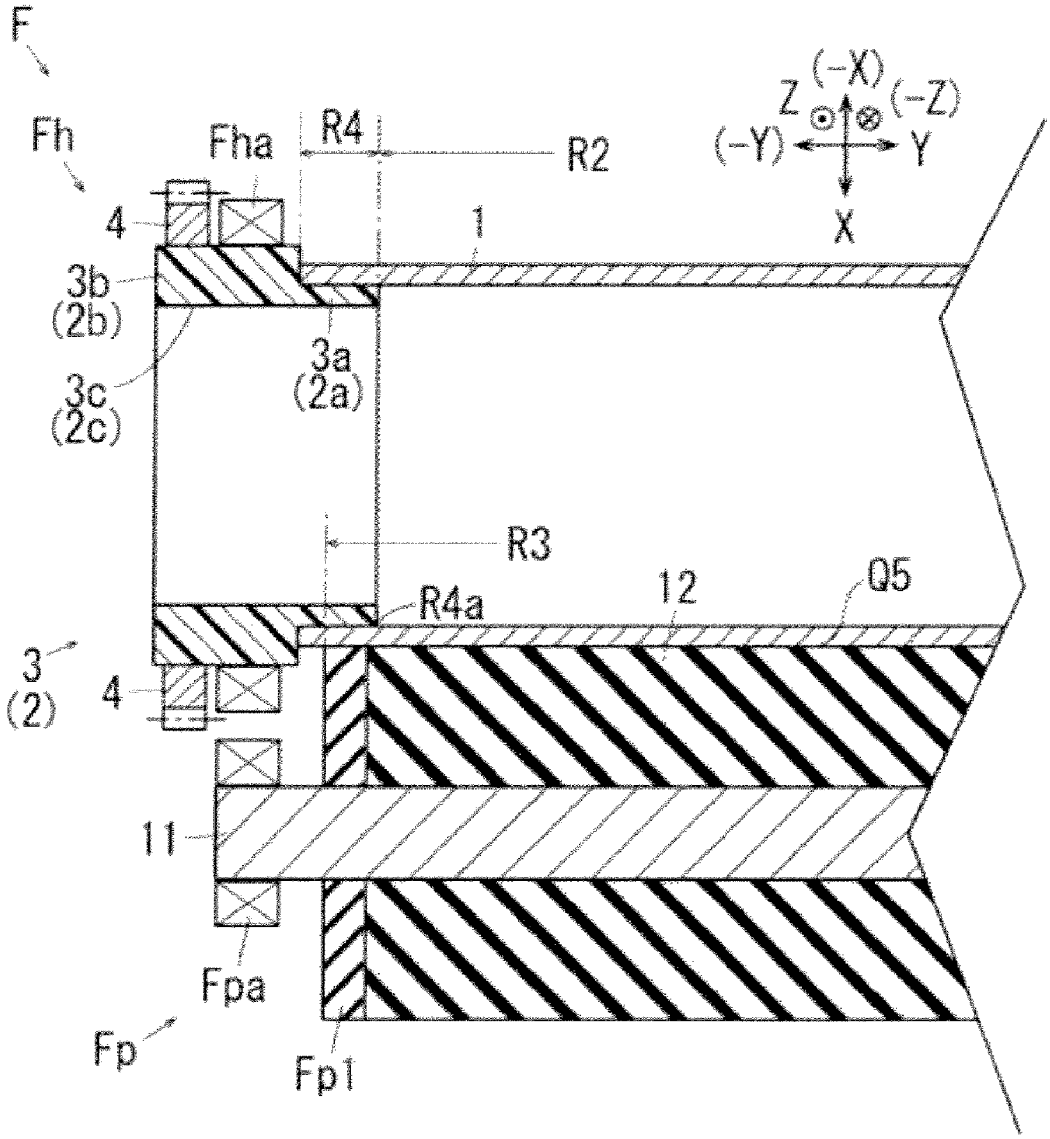
FIG. 10 is an enlarged explanatory diagram of relevant portions of an axial direction end portion of a fixing device of exemplary embodiment 5 and is a diagram that corresponds to FIG. 6 of exemplary embodiment 1.

FIG. 10 is an enlarged explanatory diagram of main portions of an axial direction end portion of a fixing device F of exemplary embodiment 5 and is a diagram that corresponds to FIG. 6 of exemplary embodiment 1.

In FIG. 10, in the fixing device F of exemplary embodiment 5, in the pressure roll Fp of exemplary embodiment 1. high friction portions Fp1 whose coefficient of friction is high in comparison to that of the outer surface of the pressure roll Fp in the medium passage region R2 are formed on the surface of the pressure roll Fp in correspondence to the regions R4 where the base body insertion portions 2*a* and 3*a* are inserted. That is, the high friction portions Fp1 are disposed on the outer surface of the pressure roll Fp in correspondence to regions where the region R3, where the pressure roll Fp contacts the base body 1, and the regions R4, where the base body insertion portions 2*a* and 3*a* are inserted, overlap. The high friction portions Fp1 can be formed by raising the coefficient of friction of the surface of the pressure roll Fp by performing work to roughen the surface of the pressure roll Fp into a rough surface or by raising the coefficient of friction by forming a surface layer with good releasability just in the medium passage region R2 and not forming the surface layer on both end portions in the pressure roll Fp.

(Operation of Exemplary Embodiment 5)

In the fixing device F of exemplary embodiment 5 that is provided with the above-described configuration, stress concentration is alleviated in the same manner as in exemplary embodiment 1, friction is raised between the base body 1 and the high friction portions Fp1, it becomes difficult for the base body 1 and the high friction portions Fp1 to slide, and driving force from the heat roll Fh is reliably transmitted to the pressure roll Fp.

[Exemplary Embodiment 6]

Next, description of exemplary embodiment 6 of the present invention will be performed. In the description of exemplary embodiment 6, identical reference signs will be given to configural elements that correspond to the configural elements of exemplary embodiments 1 to 5, and detailed description of those corresponding configural elements will be omitted.

Exemplary embodiment 6 differs from exemplary embodiments 1 to 5 in the following point but is configured in the same manner as exemplary embodiments 1 to 5 in other points.

Figure 11:
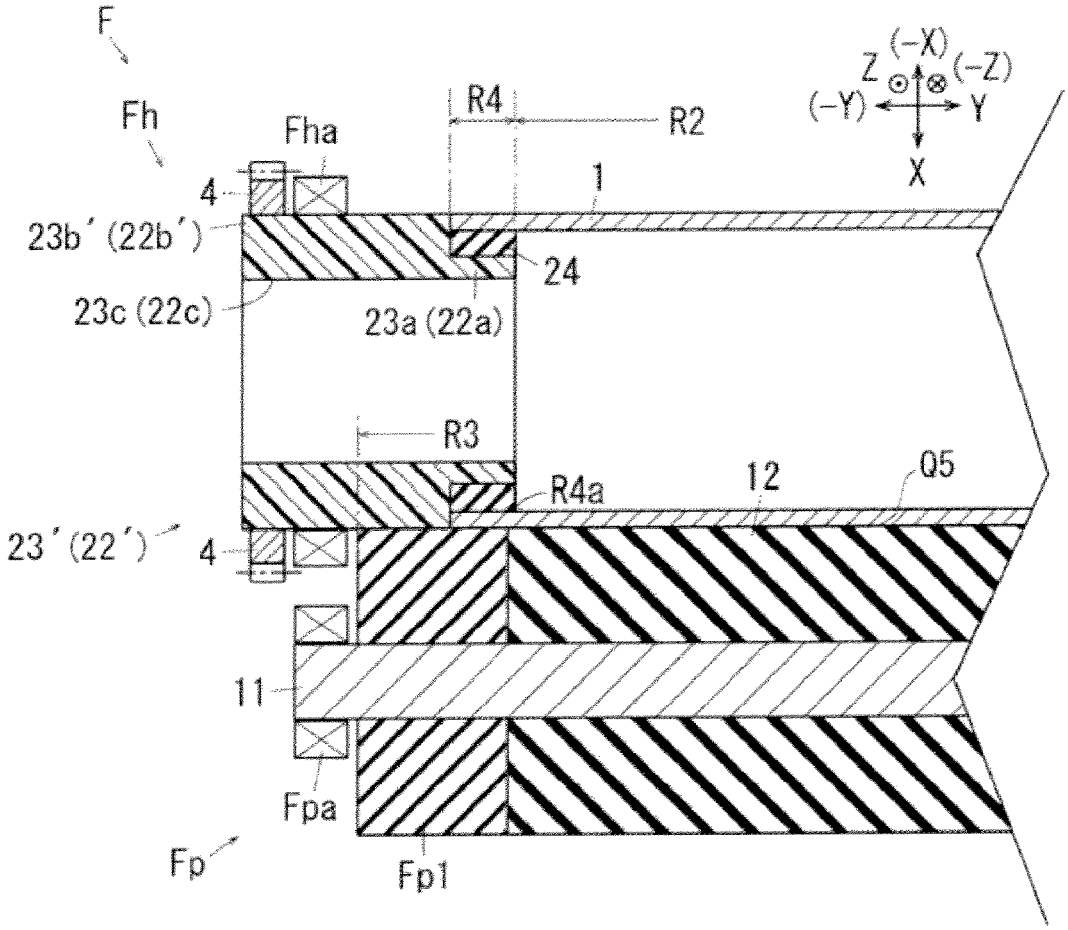
FIG. 11 is an enlarged explanatory diagram of relevant portions of an axial direction end portion of a fixing device of exemplary embodiment 6 and is a diagram that corresponds to FIG. 6 of exemplary embodiment 1.

FIG. 11 is an enlarged explanatory diagram of main portions of an axial direction end portion of a fixing device F of exemplary embodiment 6 and is a diagram that corresponds to FIG. 6 of exemplary embodiment 1.

In FIG. 11, in the fixing device F of exemplary embodiment 6, high friction portions Fp1 are, in the same manner as in exemplary embodiment 5, formed on both end portions of the pressure roll Fp, and holding members 22' and 23' of the heat roll Fh are configured in the same manner as in exemplary embodiment 4.

(Operation of Exemplary Embodiment 6)

In the fixing device F of exemplary embodiment 6 that is provided with the above-described configuration, stress concentration is alleviated by the relationship of the contact region between the pressure roll Fp and the base body 1 and the buffer rubber members 24, further, driving force from the heat roll Fh is reliably transmitted to the pressure roll Fp by high friction contact between the base body 1, the born portions 22*b*' and 23*b*' and the high friction portions Fp1.

[Exemplary Embodiment 7]

Next, description of exemplary embodiment 7 of the present invention will be performed. In the description of exemplary embodiment 7, identical reference signs will be given to configural elements that correspond to the configural elements of exemplary embodiments 1 to 6, and detailed description of those corresponding configural elements will be omitted.

Exemplary embodiment 7 differs from exemplary embodiments 1 to 6 in the following point but is configured in the same manner as exemplary embodiments 1 to 6 in other points.

Figure 12A:
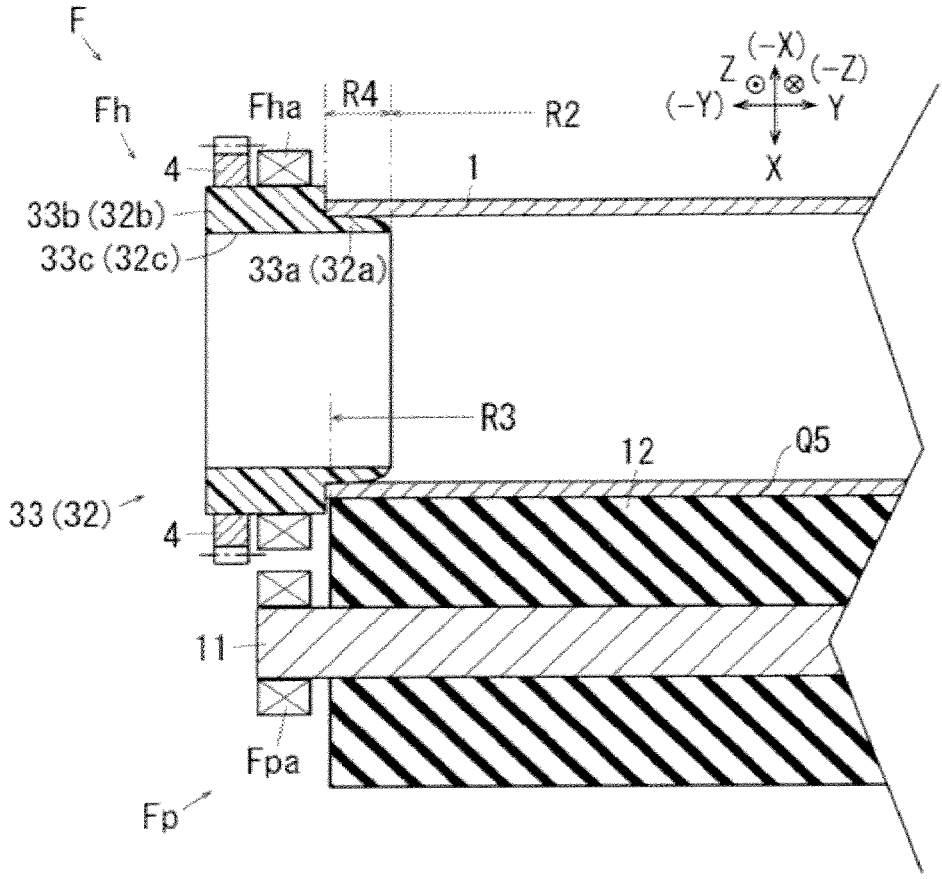
FIG. 12A and FIG. 12B are enlarged explanatory diagrams of relevant portions of an axial direction end portion of a fixing device of exemplary embodiment 7, with FIG. 12A being a diagram that corresponds to FIG. 6 of exemplary embodiment 1 and FIG. 12B being an enlarged explanatory diagram of relevant portions describing a state of deformation of a base body 1.
Figure 12B:
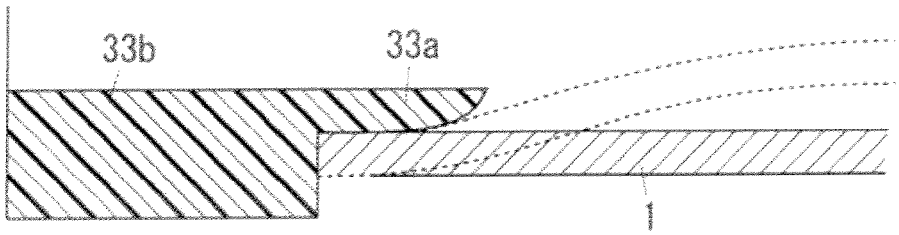

FIG. 12A and FIG. 12B are enlarged explanatory diagrams of main portions of an axial direction end portion of a fixing device F of exemplary embodiment 7, with FIG. 12A being a diagram that corresponds to FIG. 6 of exemplary embodiment 1 and FIG. 12B being an enlarged explanatory diagram of main portions describing a state of the deformation of the base body 1.

In FIG. 12A and FIG. 12B in the fixing device F of exemplary embodiment 7, holding members 32 and 33 are formed such that outer diameters of outer surfaces of base body insertion portions 32*a* and 33*a* become smaller inward in the axial direction of the base body 1. It will be noted that, in exemplary embodiment 7, the outer surfaces of the base body insertion portions 32*a* and 33*a* are formed in outer surface shapes that curve convexly outward in the radial direction in the cross sections shown in FIG. 12A and FIG. 12B.

(Operation of Exemplary Embodiment 7)

In the fixing device F of exemplary embodiment 7 that is provided with the above-described configuration, when, due to press of the roll Fp at the end portions of the base body 1, the base body 1 elastically deforms, the inner surface of the base body 1 deforms such that it is guided along the outer surfaces of the base body insertion portions 32*a* and 33*a*. That is, stress concentration is alleviated in comparison to a case where (the inner surface of) the base body 1 deforms such that it bends at the holding member inner end position of the end portion of the base body insertion portion configured such that its outer diameter is the same and stress concentration occurs.

[Exemplary Embodiment 8]

Next, description of exemplary embodiment 8 of the present invention will be performed. In the description of exemplary embodiment 8, identical reference signs will be given to configural elements that correspond to the configural elements of exemplary embodiments 1 to 7, and detailed description of those corresponding configural elements will be omitted.

Exemplary embodiment 8 differs from exemplary embodiments 1 to 7 in the following point but is configured in the same manner as exemplary embodiments 1 to 7 in other points.

Figure 13:
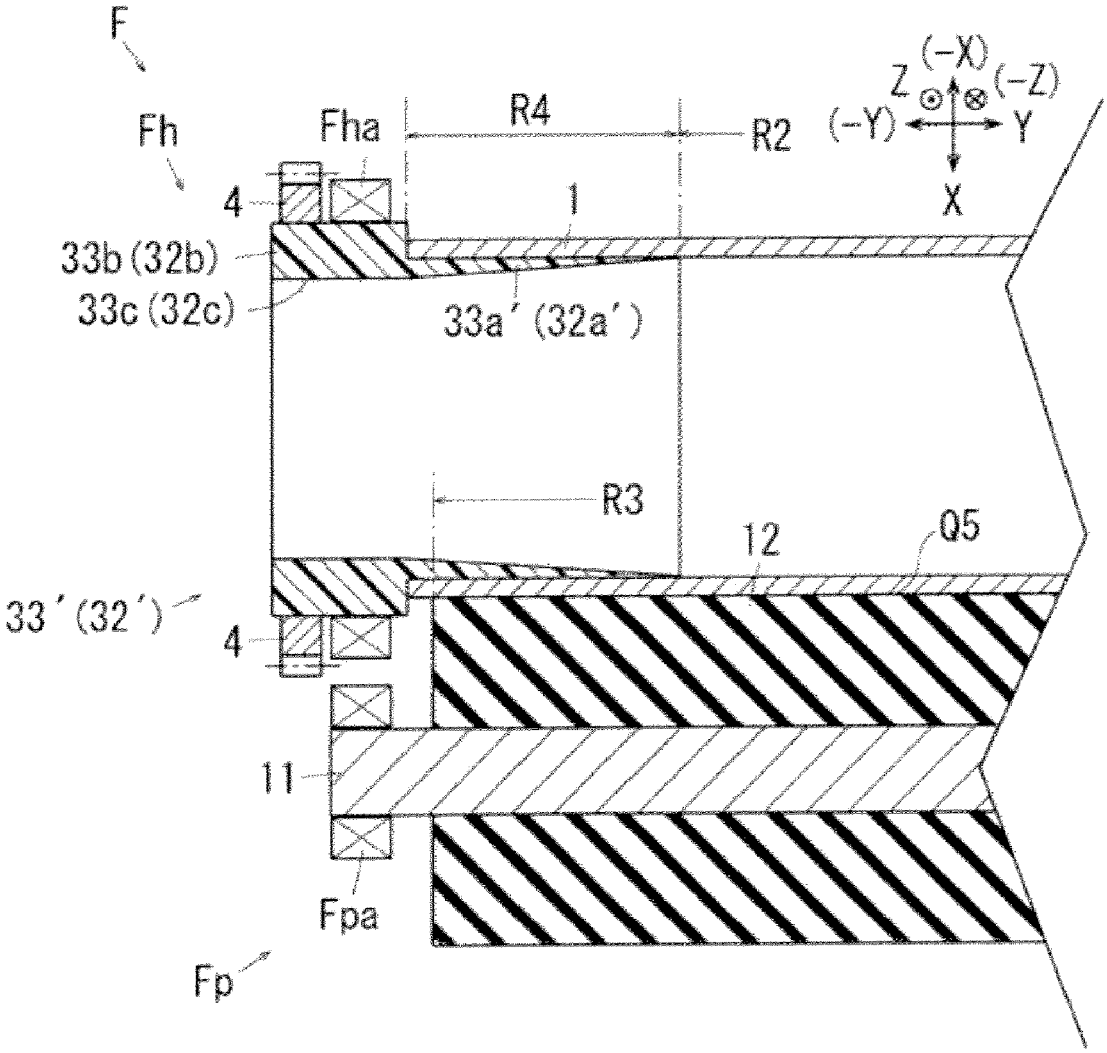
FIG. 13 is an enlarged explanatory diagram of relevant portions of an axial direction end portion of a fixing device of exemplary embodiment 8 and is a diagram that corresponds to FIG. 6 of exemplary embodiment 1.

FIG. 13 is an enlarged explanatory diagram of main portions of an axial direction end portion of a fixing device F of exemplary embodiment 8 and is a diagram that corresponds to FIG. 6 of exemplary embodiment 1.

In FIG. 13, in the fixing device F of exemplary embodiment 8, outer diameter-cylindrical shape base body insertion portions 32*a*' and 33*a*' of holding members 32' and 33' are formed such that diameters of inner surfaces of the base body insertion portions 32*a*' and 33*a*' become larger and such that the radial direction thickness, that is, the wall thickness, of the base body insertion portions 32*a*' and 33*a*' becomes thinner, inward in the axial direction of the base body 1.

(Operation of Exemplary Embodiment 8)

In the fixing device F of exemplary embodiment 8 that is provided with the above-described configuration, when the pressure roll Fp is pressed at the end portions of the base body 1 and the base body 1 elastically deforms, the base body insertion portions 32*a*' and 33*a*' that contact the inner surface of the base body 1 become thinner inward in the axial direction, and rigidity and elastic modulus in the radial direction of the combined base body insertion portions 32*a*' and 33*a*' and the base body 1 gradually become larger outward in the axial direction. Consequently, in comparison to a case where the base body insertion portions do not become thinner inward and their elastic modulus changes discontinuously at the holding member inner end positions, it is easier for the base body 1 to gradually deform outward from inside in the axial direction, and stress concentration is alleviated.

[Exemplary Embodiment 9]

Next, description of exemplary embodiment 9 of the present invention will be performed. In the description of exemplary embodiment 9, identical reference signs will be given to configural elements that correspond to the configural elements of exemplary embodiment 8, and detailed description of those corresponding configural elements will be omitted.

Exemplary embodiment 9 differs from exemplary embodiment 8 in the following point but is configured in the same manner as exemplary embodiment 8 in other points.

Figure 14A:
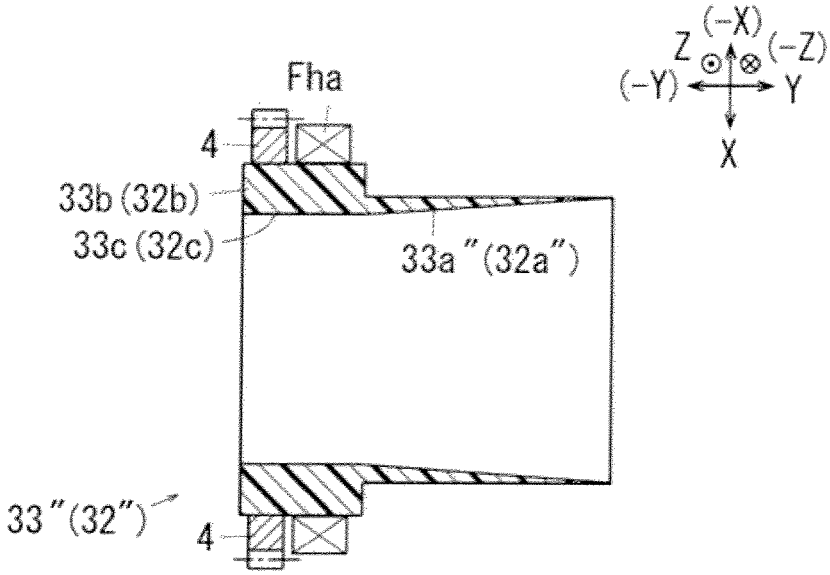
FIG. 14A and FIG. 14B are enlarged explanatory diagrams of relevant portions of an axial direction end portion of a fixing device of exemplary embodiment 9, with FIG. 14A being a cross-sectional diagram of holding members and FIG. 14B being a side diagram of the holding members.
Figure 14B:
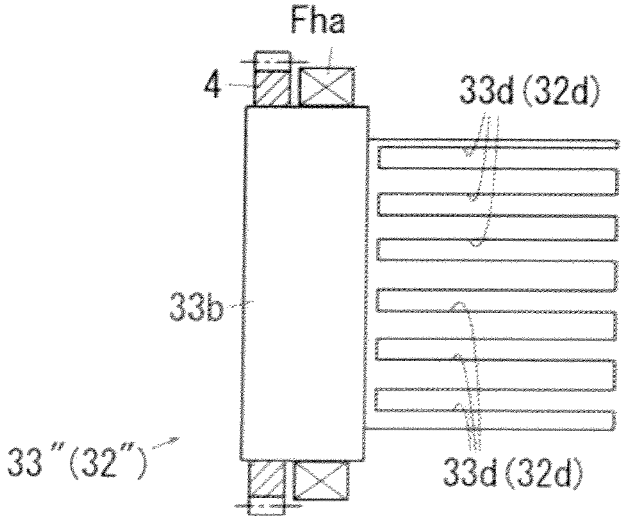

FIG. 14A and FIG. 14B are enlarged explanatory diagrams of main portions of an axial direction end portion of a fixing device F of exemplary embodiment 9, with FIG. 14A being a cross-sectional diagram of holding members and FIG. 14B being a side diagram of the holding members.

In FIG. 14A and FIG. 14B, in the fixing device F of exemplary embodiment 9, base body insertion portions 32*a*" and 33*a*" of holding members 32" and 33" are, in the same manner as in exemplary embodiment 8, formed such that the diameters of their inner surfaces become larger inward in the axial direction of the base body 1 and such that their thickness becomes thinner. Additionally, in the holding members 32" and 33" of exemplary embodiment 9, plural groove portions or so-called slits 32*d* and 33*d* that extend from the inner ends to the outer end portions along the axial direction are formed in the base body insertion portions 32*a*" and 33*a*", so the outer surfaces of the base body insertion portions 32*a*" and 33*a*" are formed in comb tooth shapes overall.

(Operation of Exemplary Embodiment 9)

In the fixing device F of exemplary embodiment 9 that is provided with the above-described configuration, the comb tooth-shaped base body insertion portions 32*a*" and 33*a*" are configured such that the teeth of the comb teeth are individually independent and are individually capable of elastic deformation. That is, when the base body insertion portions are configured in cylindrical shapes as in exemplary embodiment 8, it is relatively difficult for the base body insertion portions to deform because they try to deform such that the entire cylindrical base body insertion portions 32*a*' and 33*a*' are distorted during deformation of the base body insertion portions 32*a*' and 33*a*'. However, in exemplary embodiment 9, the base body insertion portions 32*a*" and 33*a*" are configured such that they deform relatively easily following the deformation of the base body 1, and stress concentration and damage such as folding and bending accompanying stress concentration are reduced.

[Exemplary Embodiment 10]

Next, description of exemplary embodiment 10 of the present invention will be performed. In the description of exemplary embodiment 10, identical reference signs will be given to configural elements that correspond to the configural elements of exemplary embodiments 1 to 9, and detailed description of those corresponding configural elements will be omitted.

Exemplary embodiment 10 differs from exemplary embodiments 1 to 9 in the following point but is configured in the same manner as exemplary embodiments 1 to 9 in other points.

Figure 15:
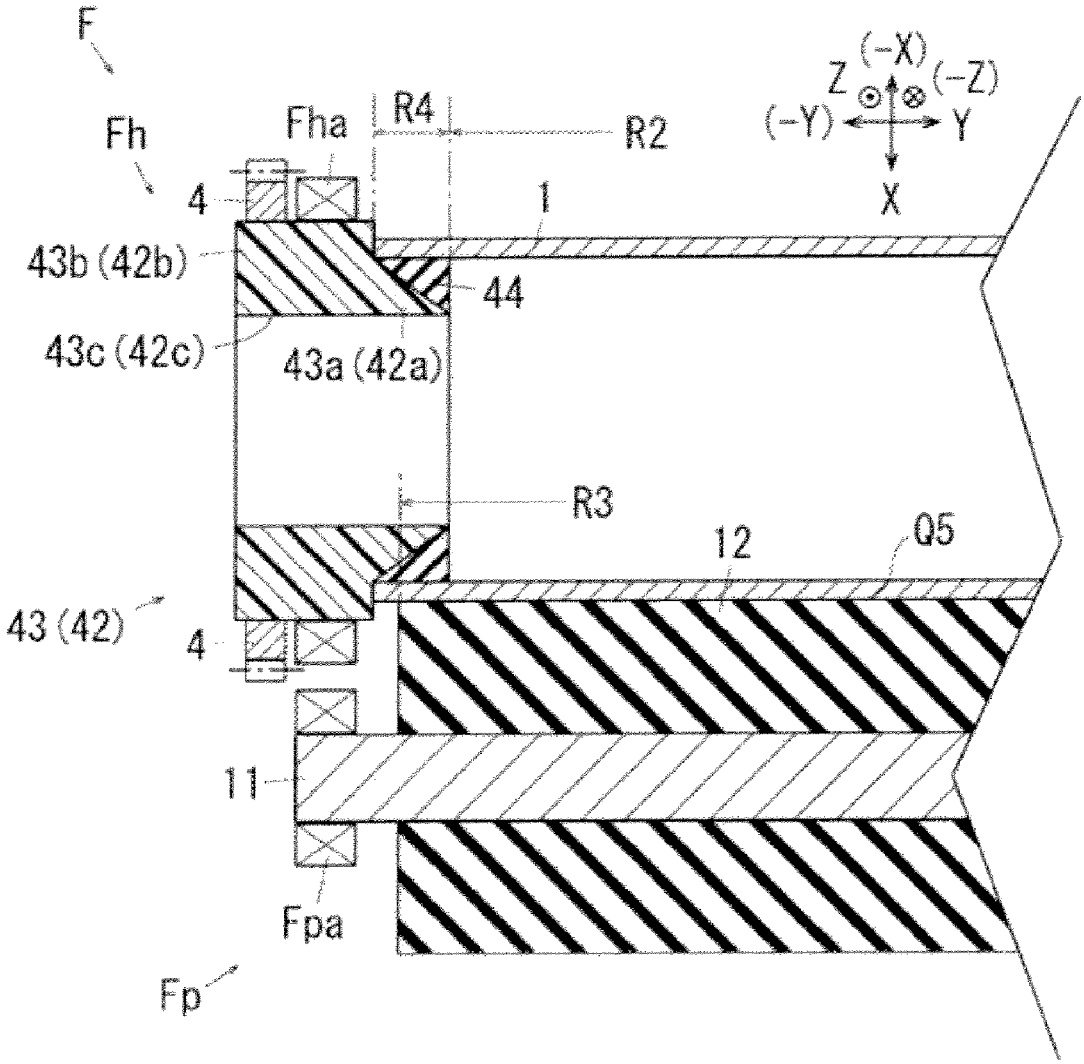
FIG. 15 is an enlarged explanatory diagram of relevant portions of an axial direction end portion of a fixing device of exemplary embodiment 10 and is a diagram that corresponds to FIG. 6 of exemplary embodiment 1.

FIG. 15 is an enlarged explanatory diagram of main portions of an axial direction end portion of a fixing device F of exemplary embodiment 10 and is a diagram that corresponds to FIG. 6 of exemplary embodiment 1.

In FIG. 15, in the fixing device F of exemplary embodiment 10, base body insertion portions 42*a* and 43*a* of holding members 42 and 43 are configured such that the outer diameters of their outer surfaces become smaller inward in the axial direction. Additionally, in accordance with the shape of the outer diameters of the base body insertion portions 42*a* and 43*a*, buffer rubber members 44 whose inner diameters are formed so as to become smaller inward in the axial direction are attached as one example of buffer members between the base body insertion portions 42*a* and 43*a* and the inner surface of the base body 1.

(Operation of Exemplary Embodiment 10)

In the fixing device F of exemplary embodiment 10 that is provided with the above-described configuration, the buffer rubber members 44 become thicker inward in the axial direction of the base body insertion portions 42*a* and 43*a* and are configured such that they easily deform inward, so in comparison to the case of exemplary embodiment 3, stress concentration and bending are more efficiently alleviated.

[Exemplary Embodiment 11]

Next, description of exemplary embodiment 11 of the present invention will be performed. In the description of exemplary embodiment 11, identical reference signs will be given to configural elements that correspond to the configural elements of exemplary embodiments 1 to 10, and detailed description of those corresponding configural elements will be omitted.

Exemplary embodiment 11 differs from exemplary embodiments 1 to 10 in the following point but is configured in the same manner as exemplary embodiments 1 to 10 in other points.

Figure 16:
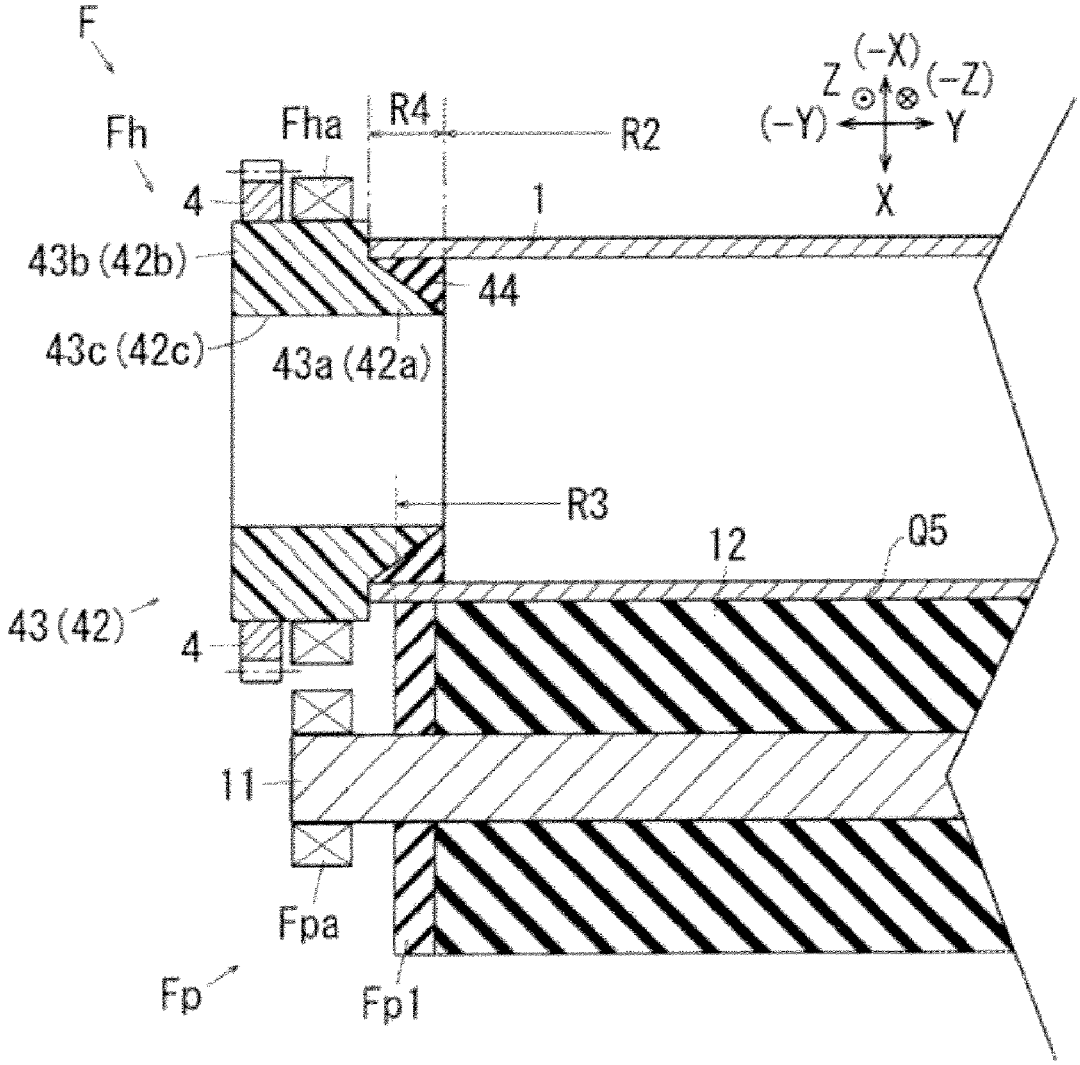
FIG. 16 is an enlarged explanatory diagram of relevant portions of an axial direction end portion of a fixing device of exemplary embodiment 11 and is a diagram that corresponds to FIG. 6 of exemplary embodiment 1.

FIG. 16 is an enlarged explanatory diagram of main portions of an axial direction end portion of a fixing device F of exemplary embodiment 11 and is a diagram that corresponds to FIG. 6 of exemplary embodiment 1.

In FIG. 16, in the fixing device F of exemplary embodiment 11, the heat roll Fh is configured in the same manner as the heat roll Fh of exemplary embodiment 10, and the pressure roll Fp is configured in the same manner as the pressure roll Fp in exemplary embodiment 5.

(Operation of Exemplary Embodiment 11)

In the fixing device F of exemplary embodiment 11 that is provided with the above-described configuration, they easily deform inward in the axial direction of the base body insertion portions 42*a* and 43*a*, stress concentration and bending are efficiently alleviated, and driving force is efficiently transmitted with the high friction portions Fp1.

[Exemplary Embodiment 12]

Next, description of exemplary embodiment 12 of the present invention will be performed. In the description of exemplary embodiment 12, identical reference signs will be given to configural elements that correspond to the configural elements of exemplary embodiments 1 to 11, and detailed description of those corresponding configural elements will be omitted.

Exemplary embodiment 12 differs from exemplary embodiments 1 to 11 in the following point but is configured in the same manner as exemplary embodiments 1 to 11 in other points.

Figure 17:
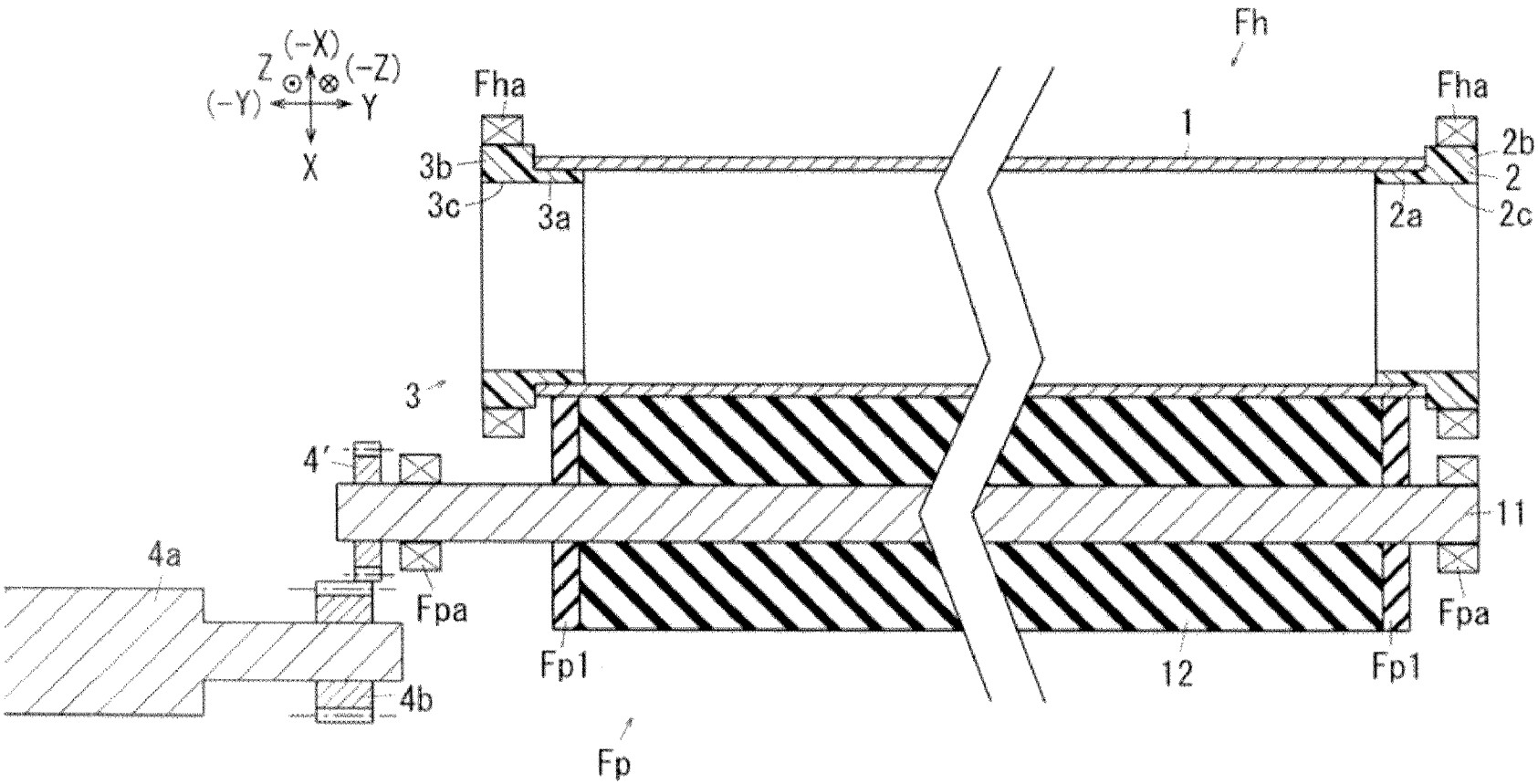
FIG. 17 is an enlarged explanatory diagram of relevant portions of an axial direction end portion of a fixing device of exemplary embodiment 12 and is a diagram that corresponds to FIG. 5 of exemplary embodiment 1.

FIG. 17 is an enlarged explanatory diagram of main portions of axial direction end portions of a fixing device F of exemplary embodiment 11 and is a diagram that corresponds to FIG. 5 of exemplary embodiment 1.

In FIG. 17, in the fixing device F of exemplary embodiment 12, the heat roll Fh and the pressure roll Fp are configured in the same manner as in exemplary embodiment 5, and a driven gear 4' is supported on the left end of the shaft 11 of the pressure roll Fp rather than on the holding member 3 of the heat roll Fh. The driven gear 4' meshes with a drive gear 4*b* that is supported on a drive shaft 4*a* to which driving force is transmitted from an unillustrated drive source, and driving force is transmitted to the driven gear 4'.

(Operation of Exemplary Embodiment 12)

In the fixing device F of exemplary embodiment 12 that is provided with the above-described configuration, stress concentration in the heat roll Fh is alleviated, the pressure roll Fp is driven to rotate, the rotation of the pressure roll Fp is reliably transmitted to the heat roll Fh by the high friction portions Fp1 and the heat roll Fh is allowed to rotate following the rotation of the pressure roll Fp.

[Exemplary Embodiment 13]

Next, description of exemplary embodiment 13 of the present invention will be performed. In the description of exemplary embodiment 13, identical reference signs will be given to configural elements that correspond to the configural elements of exemplary embodiments 1 to 11, and detailed description of those corresponding configural elements will be omitted.

Exemplary embodiment 13 differs from exemplary embodiments 1 to 11 in the following point but is configured in the same manner as exemplary embodiments 1 to 11 in other points.

Figure 18A:
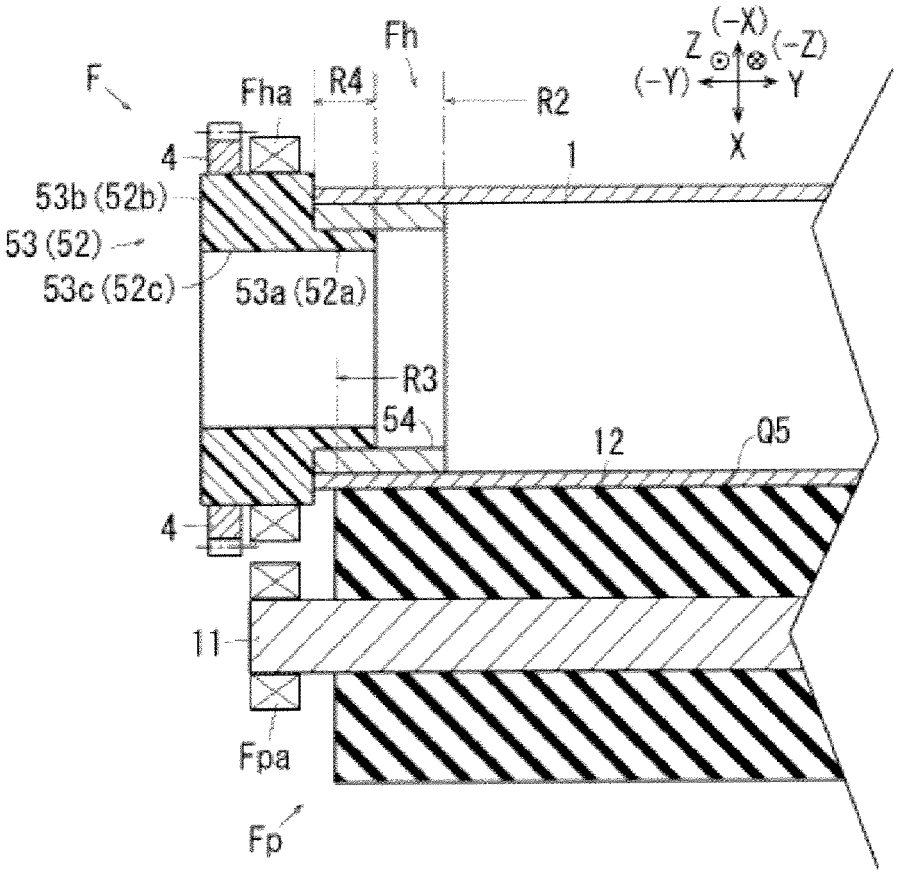
FIG. 18A and FIG. 18B are enlarged explanatory diagrams of relevant portions of an axial direction end portion of a fixing device of exemplary embodiment 13, with FIG. 18A being a diagram that corresponds to FIG. 6 of exemplary embodiment 1 and FIG. 18B being a perspective explanatory diagram of a buffer member.
Figure 18B:
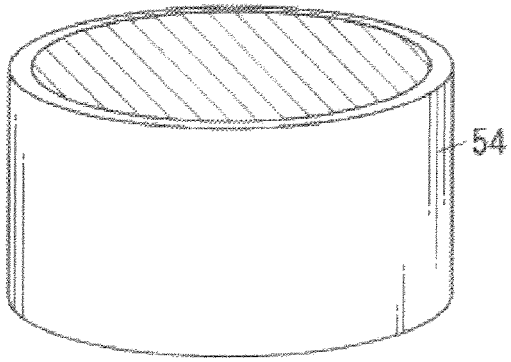

FIG. 18A and FIG. 18B are enlarged explanatory diagrams of main portions of an axial direction end portion of a fixing device F of exemplary embodiment 13, with FIG. 18A being a diagram that corresponds to FIG. 6 of exemplary embodiment 1 and FIG. 18B being a perspective explanatory diagram of a buffer member.

In FIG. 18A and FIG. 18B, the fixing device F of exemplary embodiment 13 corresponds to a configuration where holding members 52 and 53 use cylindrical metal rings 54 as one example of buffer members and as one example of annular members, instead of the buffer rubber members 24 in exemplary embodiment 3. The metal rings 54 of exemplary embodiment 13 are configured by elastically deformable ring-shaped so-called metal springs. Further, the metal rings 54 are formed such that their axial direction length is longer than the axial direction length of base body insertion portions 52*a* and 53*a*, and the medium passage region R2 is set inside the axial direction inner ends of the metal rings 54.

(Operation of Exemplary Embodiment 13)

In the fixing device F of exemplary embodiment 13 that is provided with the above-described configuration, the metal rings 54 that serve as one example of buffer members also elastically deform when the base body 1 elastically deforms, and stress concentration in the base body 1 of the heat roll Fh is alleviated. Further, the metal rings 54 of exemplary embodiment 13 are made of metal and have superior heat resistance in comparison to a case where there are used buffer members that are made of a rubber material whose properties change and whose characteristics as an elastic member are lost when its temperature rises.

[Exemplary Embodiment 14]

Next, description of exemplary embodiment 14 of the present invention will be performed. In the description of exemplary embodiment 14, identical reference signs will be given to configural elements that correspond to the configural elements of exemplary embodiments 1 to 13, and detailed description of those corresponding configural elements will be omitted.

Exemplary embodiment 14 differs from exemplary embodiments 1 to 13 in the following point but is configured in the same manner as exemplary embodiments 1 to 13 in other points.

Figure 19A:
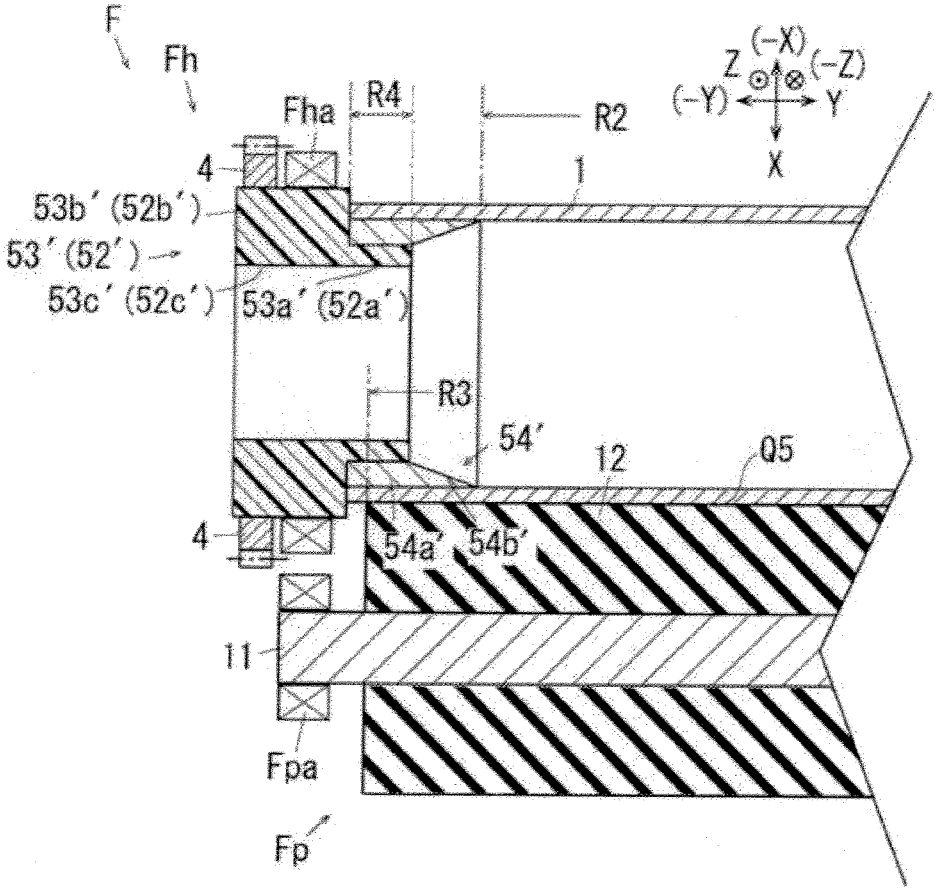
FIG. 19A and FIG. 19B are enlarged explanatory diagrams of relevant portions of an axial direction end portion of a fixing device of exemplary embodiment 14, with FIG. 19A being a diagram that corresponds to FIG. 6 of exemplary embodiment 1 and FIG. 19B being a perspective explanatory diagram of a buffer member.
Figure 19B:
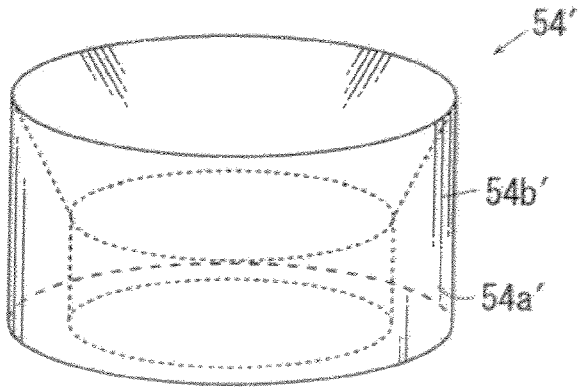

FIG. 19A and FIG. 19B are enlarged explanatory diagrams of main portions of an axial direction end portion of a fixing device F of exemplary embodiment 14, with FIG. 19A being a diagram that corresponds to FIG. 6 of exemplary embodiment 1 and FIG. 19B being a perspective explanatory diagram of a buffer member.

In FIG. 19A and FIG. 19B, in the fixing device F of exemplary embodiment 14, metal rings 54' whose shape is different from that of the metal rings 54 of exemplary embodiment 13 are used as one example of buffer members in holding members 52' and 53', instead of the metal rings 54 in exemplary embodiment 13. The metal rings 54' of exemplary embodiment 14 are, in the same manner as the metal rings 54 of exemplary embodiment 13, configured by elastically deformable ring-shaped so-called metal springs and are formed such that their axial direction length is longer than the axial direction length of base body insertion portions 52*a*' and 53*a*', and the medium passage region R2 is set inside the axial direction inner ends of the metal rings 54'. Further, each of the metal rings 54' of exemplary embodiment 14 includes a cylinder portion 54*a*' whose axial direction length is formed in correspondence to the base body insertion portions 52*a*' and 53*a*' and an inverted cone portion 54*b*' that is formed such that its thickness becomes thinner inward from the axial direction inner end of the cylinder portion 54*a*' and whose inner peripheral surface is formed along the outer peripheral surface of a cone.

(Operation of Exemplary Embodiment 14)

In the fixing device F of exemplary embodiment 14 that is provided with the above-described configuration, the metal rings 54' also elastically deform when the base body 1 elastically deforms. At this time, the elastic modulus of the metal rings 54' is set such that it does not change discontinuously on the inner ends of the metal rings 54' but gradually becomes larger outward in the axial direction, so folding does not occur at the axial direction inner end portions of the metal rings 54', and stress concentration in the base body 1 of the heat roll Fh is alleviated even more in comparison to the case of exemplary embodiment 13.

[Exemplary Embodiment 15]

Next, description of exemplary embodiment 15 of the present invention will be performed. In the description of exemplary embodiment 15, identical reference signs will be given to configural elements that correspond to the configural elements of exemplary embodiments 1 to 14, and detailed description of those corresponding configural elements will be omitted.

Exemplary embodiment 15 differs from exemplary embodiments 1 to 14 in the following point but is configured in the same manner as exemplary embodiments 1 to 14 in other points.

Figure 20:
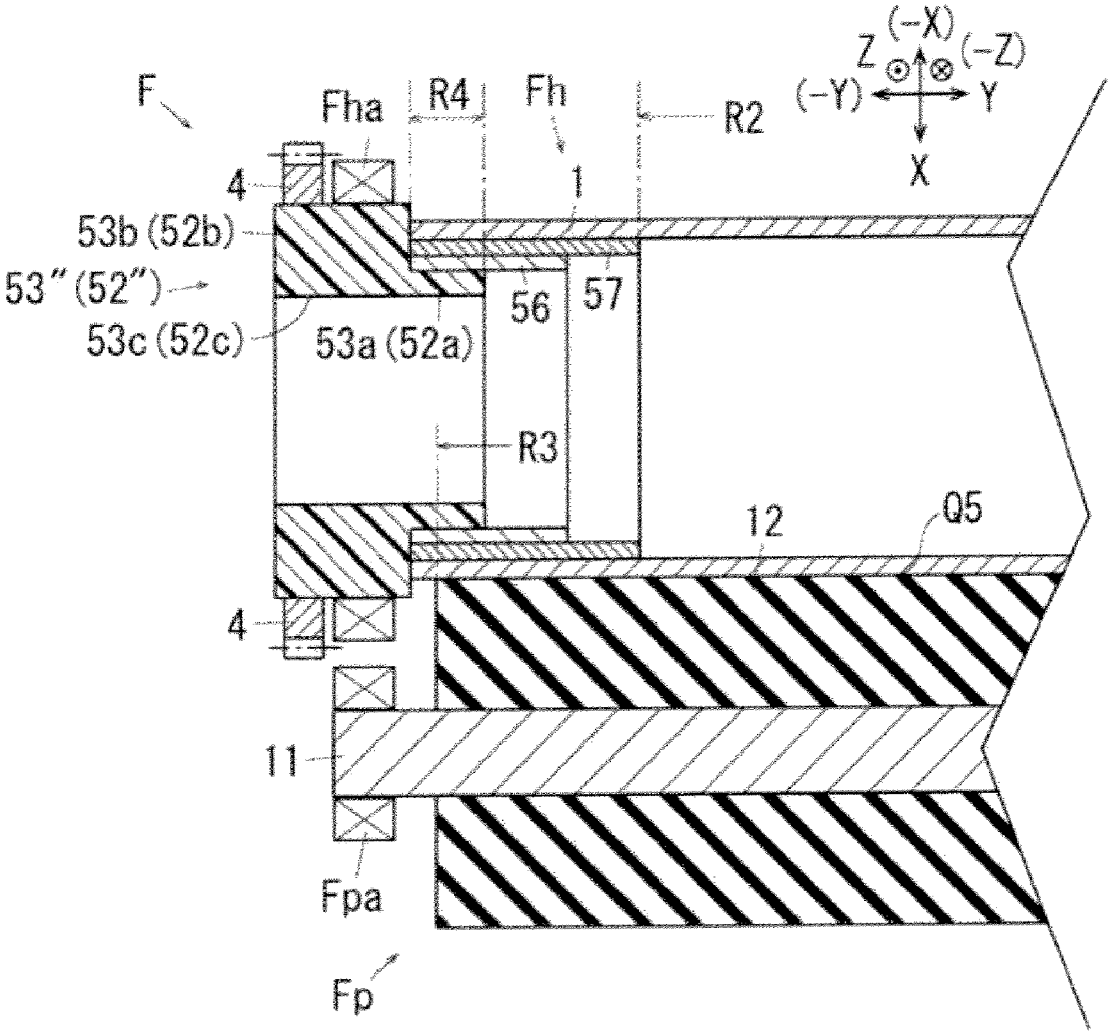
FIG. 20 is an enlarged explanatory diagram of relevant portions of an axial direction end portion of a fixing device of exemplary embodiment 15 and is a diagram that corresponds to FIG. 6 of exemplary embodiment 1.

FIG. 20 is an enlarged explanatory diagram of main portions of an axial direction end portion of a fixing device F of exemplary embodiment 11 and is a diagram that corresponds to FIG. 6 of exemplary embodiment 1.

In FIG. 20, in the fixing device F of exemplary embodiment 15, holding members 52" and 53" are formed in outer diameters that are the same as those of the base body insertion portions 52*a* and 53*a* of exemplary embodiment 13, and two concentric metal rings 56 and 57 are attached as one example of buffer members instead of the metal rings 54. It will be noted that the metal rings 56 and 57 of exemplary embodiment 15 are formed in half the thickness of the thickness of the metal rings 54 of exemplary embodiment 13. Further, the metal rings 56 and 57 are both configured by elastically deformable ring-shaped so-called metal springs, the axial direction length of the inside metal rings 56 is formed longer than the axial direction length of the base body insertion portions 52*a* and 53*a*, and the axial direction length of the outside metal rings 57 is formed longer than the axial direction length of the inside metal rings 56. It will be noted that, in exemplary embodiment 15, the medium passage region R2 is set inside the axial direction inner ends of the outside metal rings 57.

(Operation of Exemplary Embodiment 15)

In the fixing device F of exemplary embodiment 15 that is provided with the above-described configuration, the double metal rings 56 and 57 also elastically deform when the base body 1 elastically deforms, and stress concentration in the base body 1 of the heat roll Fh is alleviated. At this time, the metal springs whose thickness is thin are doubled and, in the same manner as in exemplary embodiment 14, discontinuity of the elastic modulus along the axial direction is alleviated and stress concentration is alleviated even more in comparison to the case of exemplary embodiment 13.

[Exemplary Embodiment 16]

Next, description of exemplary embodiment 16 of the present invention will be performed. In the description of exemplary embodiment 16, identical reference signs will be given to configural elements that correspond to the configural elements of exemplary embodiments 1 to 15, and detailed description of those corresponding configural elements will be omitted.

Exemplary embodiment 16 differs from exemplary embodiments 1 to 15 in the following point but is configured in the same manner as exemplary embodiments 1 to 15 in other points.

Figure 21A:
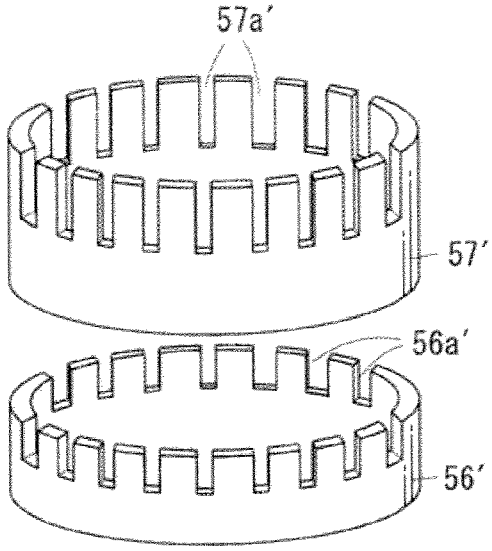
FIG. 21A, FIG. 21B and FIG. 21C are explanatory diagrams of buffer members of exemplary embodiment 16, with FIG. 21A being an explanatory diagram of a state where two metal rings are separated from each other, FIG. 21B being a cross-sectional diagram along the axial direction in FIG. 21A, and FIG. 21C being a cross-sectional diagram of a state where the two metal rings are superposed.
Figure 21B:
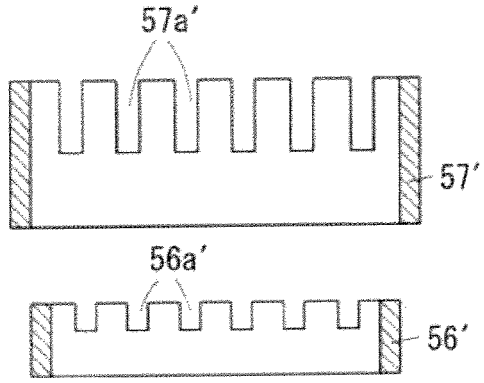
Figure 21C:
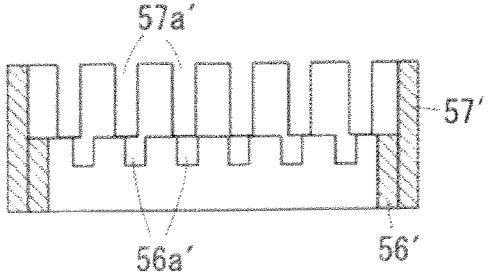

FIG. 21A, FIG. 21B and FIG. 21C are explanatory diagrams of buffer members of exemplary embodiment 16, with FIG. 21A being an explanatory diagram of a state where two metal rings are separated from each other, FIG. 21B being a cross-sectional diagram along the axial direction in FIG. 21A, and FIG. 21C being a cross-sectional diagram of a state where the two metal rings are superposed.

In FIG. 21A, FIG. 21B and FIG. 21C, metal rings 56' and 57' in which plural groove portions or so-called slits 56*a*' and 57*a*' are formed are used instead of the metal rings 56 and 57 of exemplary embodiment 15. In exemplary embodiment 16, the slits 56*a*' and 57*a*' are formed on the axial direction inner end side of the base body 1, and the slits 57*a*' of the outside metal rings 57' are configured by slits with a depth corresponding to the inner ends of the inside metal rings 56'.

(Operation of Exemplary Embodiment 16)

In the fixing device F of exemplary embodiment 16 that is provided with the above-described configuration, when the double metal rings 56' and 57' also elastically deform when the base body 1 elastically deforms, whereas, as in exemplary embodiment 15, it may be difficult for the cylindrical metal rings 56 and 57 to deform because they deform such that the cylinders becomes distortion, however, in exemplary embodiment 16, it is easy for the slits 56*a*' and 57*a*' to deform so stress concentration is efficiently alleviated. Further, the slits 56*a*' and 57*a*' are formed on the axial direction inner end side, therefore, they are configured to be able to elastically deformable more in correspondence flexibly to the elastic deformation of the base body 1 toward the inner end side.

[Exemplary Embodiment 17]

Next, description of exemplary embodiment 17 of the present invention will be performed. In the description of exemplary embodiment 17, identical reference signs will be given to configural elements that correspond to the configural elements of exemplary embodiments 1 to 16, and detailed description of those corresponding configural elements will be omitted.

Exemplary embodiment 17 differs from exemplary embodiments 1 to 16 in the following point but is configured in the same manner as exemplary embodiments 1 to 16 in other points.

Figure 22:
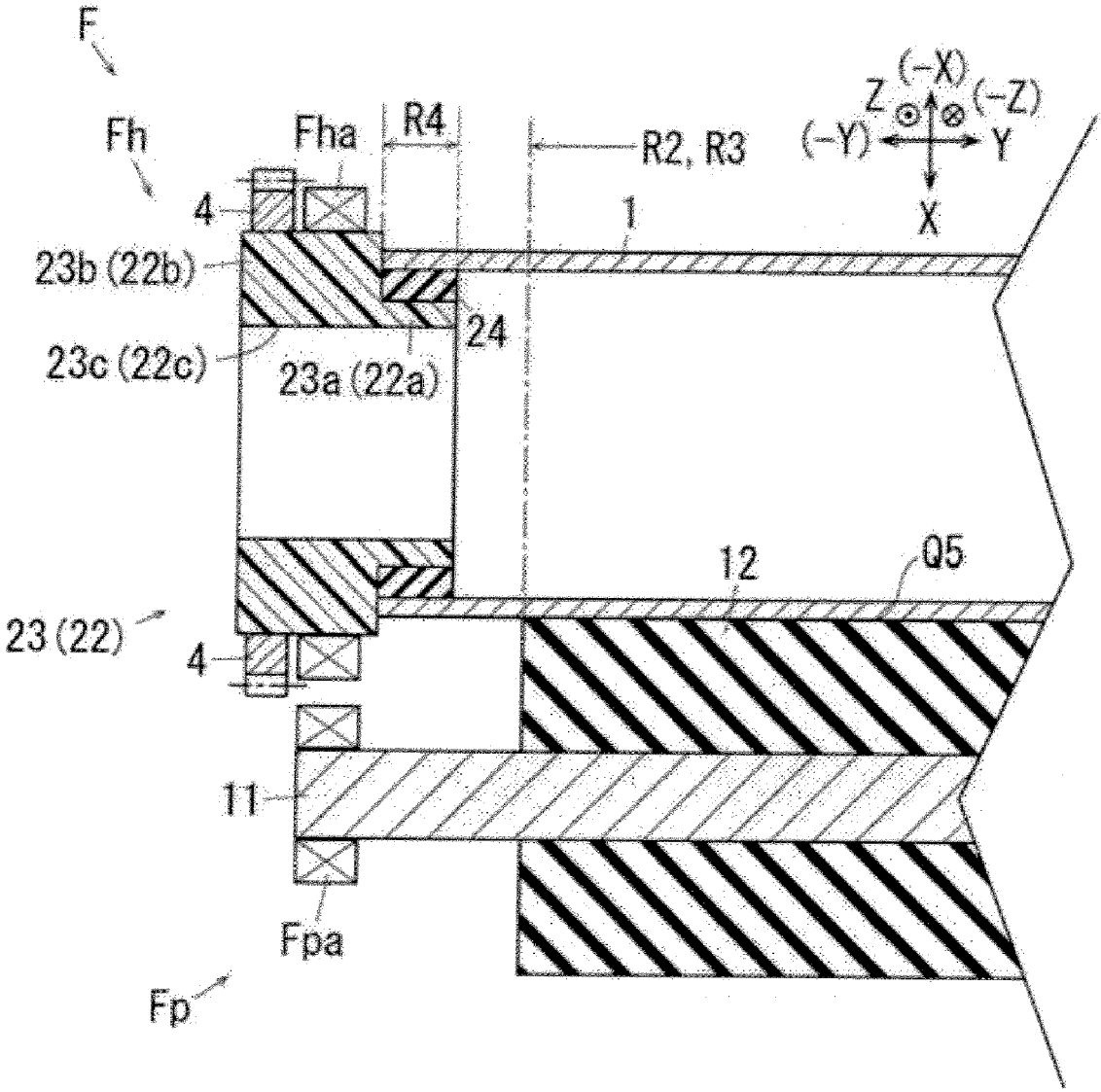
FIG. 22 is an explanatory diagram of buffer members of exemplary embodiment 17 and is a diagram that corresponds to FIG. 6 of exemplary embodiment 1.

FIG. 22 is an explanatory diagram of buffer member of exemplary embodiment 17 and is a diagram that corresponds to FIG. 6 of exemplary embodiment 1.

In FIG. 22, in the fixing device F of exemplary embodiment 17, the heat roll Fh has, in the same manner as the heat roll Fh of exemplary embodiment 3, a configuration that includes the holding members 22 and 23 that include the buffer rubber members 24. In exemplary embodiment 17, however, the outer ends of the pressure roll Fp are set further inward in the axial direction than the base body insertion portions 22*a* and 23*a* of the holding members 22 and 23, and the region R3 where the pressure roll Fp contacts the heat roll Fh is, in contrast to exemplary embodiments 1 to 16, set inward in the axial direction. It will be noted that the medium passage region R2 where fixing of an unfixed toner image is performed is set in correspondence to the contact region R3 of the pressure roll Fp.

Consequently, in exemplary embodiment 17, the region R3 where the pressure roll Fp contacts the base body 1, along the medium width direction of the fixing region Q5, is set inside, in the base body axial direction, the regions R4 where the base body insertion portions 22*a* and 23*a* are inserted, and further, the medium passage region R2 where the sheet S passes is set inside, in the base body axial direction, the regions R4 where the base body insertion portions 22*a* and 23*a* are inserted.

(Operation of Exemplary Embodiment 17)

In the fixing device F of exemplary embodiment 17 that is provided with the above-described configuration, the buffer rubber members 24 elastically deform at the both end portions of the base body 1 in response to the received force while the base body 1 elastically deforming by contact with the pressure roll Fp, and the buffer rubber members 24 absorb the force that is received and fulfill the role of so-called cushions. Thus, stress concentration in the base body 1 is alleviated. In exemplary embodiment 17, stress concentration can be alleviated in comparison to a case where the buffer rubber members 24 that are made of an elastic material are not disposed. That is, in the heat roll Fh of exemplary embodiment 17, in the holding member inner end positions R4*a*, stress concentration, fatigue resulting from repeated elastic deformation and return, and damage such as folding resulting from repeated fatigue, bending and breaking are reduced, and the life of the heat roll Fh is lengthened.

[Exemplary Embodiment 18]

Next, description of exemplary embodiment 18 of the present invention will be performed. In the description of exemplary embodiment 18, identical reference signs will be given to configural elements that correspond to the configural elements of exemplary embodiments 1 to 17, and detailed description of those corresponding configural elements will be omitted.

Exemplary embodiment 18 differs from exemplary embodiments 1 to 17 in the following point but is configured in the same manner as exemplary embodiments 1 to 17 in other points.

Figure 23:
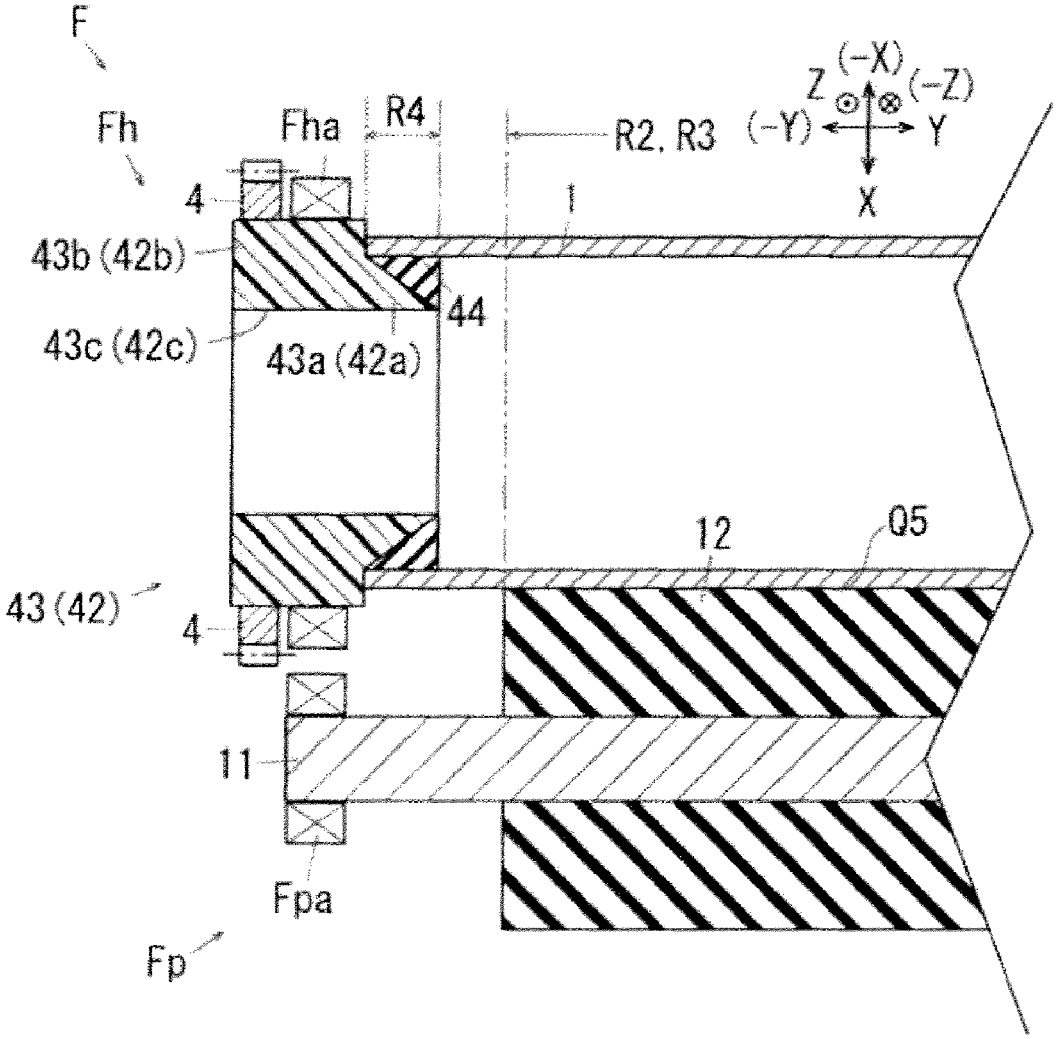
FIG. 23 is an explanatory diagram of buffer members of exemplary embodiment 18 and is a diagram that corresponds to FIG. 6 of exemplary embodiment 1.

FIG. 23 is an explanatory diagram of a buffer member of exemplary embodiment 18 and is a diagram that corresponds to FIG. 6 of exemplary embodiment 1.

In FIG. 23, in the fixing device F of exemplary embodiment 18, the heat roll Fh has, in the same manner as the heat roll Fh of exemplary embodiment 10, a configuration that includes the holding members 42 and 43 that include the buffer rubber members 44. In exemplary embodiment 18, however, the positions of the outer ends of the pressure roll Fp are, in the same manner as in exemplary embodiment 17, set further inward in the axial direction than the base body insertion portions 42*a* and 43*a*.

(Operation of Exemplary Embodiment 18)

In the fixing device F of exemplary embodiment 18 that is provided with the above-described configuration, the buffer rubber members 44 elastically deform at the both end portions of the base body 1 in response to the received force while the base body 1 elastically deforming by contact with the pressure roll Fp, the buffer rubber members 44 absorb the force that is received, stress concentration in the base body 1 is alleviated, the thickness of the buffer rubber members 44 becomes larger inward in the axial direction, and stress concentration and folding are efficiently more alleviated inside.

[Exemplary Embodiment 19]

Next, description of exemplary embodiment 19 of the present invention will be performed. In the description of exemplary embodiment 19, identical reference signs will be given to configural elements that correspond to the configural elements of exemplary embodiments 1 to 18, and detailed description of those corresponding configural elements will be omitted.

Exemplary embodiment 19 differs from exemplary embodiments 1 to 18 in the following point but is configured in the same manner as exemplary embodiments 1 to 18 in other points.

Figure 24:
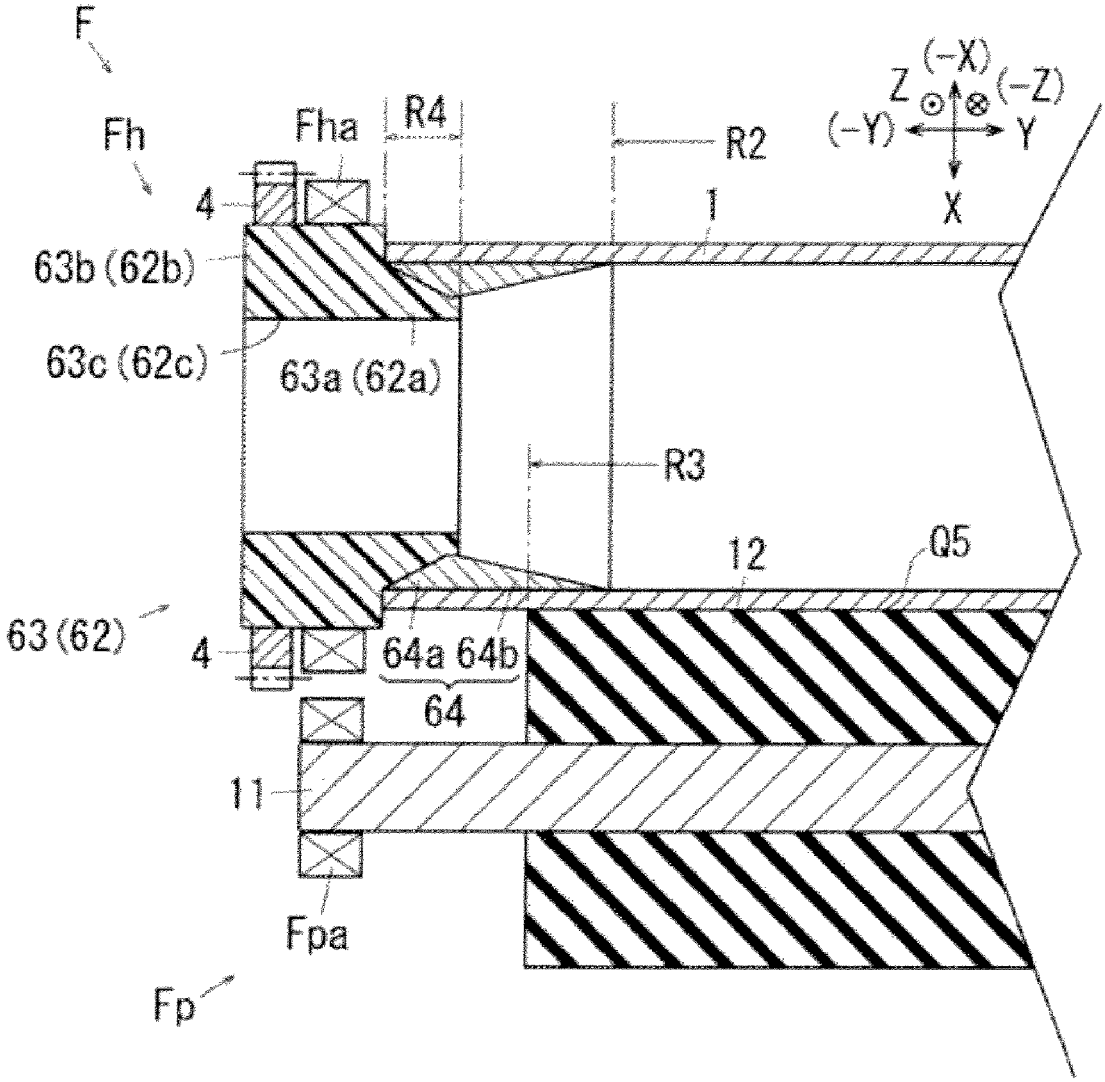
FIG. 24 is an explanatory diagram of buffer members of exemplary embodiment 19 and is a diagram that corresponds to FIG. 6 of exemplary embodiment 1.

FIG. 24 is an explanatory diagram of buffer members of exemplary embodiment 19 and is a diagram that corresponds to FIG. 6 of exemplary embodiment 1.

In FIG. 24, in the fixing device F of exemplary embodiment 19, holding members 62 and 63 are formed such that outer diameters of base body insertion portions 62*a* and 63*a* become smaller toward their inner end portions, and metal rings 64 are attached, as one example of buffer members, between the base body insertion portions 62*a* and 63*a* and the base body 1. The metal rings 64 include outside portions 64*a* that correspond to the inner ends from the outer ends of the base body insertion portions 62*a* and 63*a* and inside portions 64*b* that extend inward from the axial direction inner ends of the base body insertion portions 62*a* and 63*a*. The outside portions 64*a* are formed such that their inner diameters become smaller inward in the axial direction in correspondence to the base body insertion portions 62*a* and 63*a*. The inside portions 64*b* are formed such that their inner diameters become larger (the wall thicknesses become smaller) inward.

It will be noted that, in exemplary embodiment 19, the positions of the axial direction outer ends of the pressure roll Fp are, in the same manner as in exemplary embodiment 17, set further inward in the axial direction than the base body insertion portions 62*a* and 63*a*. Further, the axial direction inner ends of the metal rings 64 are set so as to be further inward than the axial direction outer ends of the pressure roll Fp.

(Operation of Exemplary Embodiment 19)

In the fixing device F of exemplary embodiment 19 that is provided with the above-described configuration, the metal rings 64 elastically deform at the both end portions of the base body 1 in response to the received force while the base body 1 elastically deforming by contact with the pressure roll Fp, the metal rings 64 absorb the force that is received, and stress concentration in the base body 1 is alleviated. At this time, in exemplary embodiment 19, the thickness of the inside portions 64*b* of the metal rings 64 becomes thinner inward, it is difficult to occur for the elastic modulus to change discontinuously, and alleviation of stress concentration becomes even higher. Further, the axial direction inner end portions of the inside portions 64*b* are set further inward than the axial direction outer ends of the pressure roll Fp, therefore the inside portions 64*b* are disposed so as to overlap the contact region between the base body 1 and the pressure roll Fp. Consequently, in comparison to a case where the inside portions 64*b* are not disposed, the contact pressure becomes higher in the contact region Q5 between the base body 1 and the pressure roll Fp, and the driving force of the heat roll Fh is efficiently transmitted to the pressure roll Fp. That is, in exemplary embodiment 19, driving force is efficiently transmitted while stress concentration is alleviated.

[Exemplary Embodiment 20]

Next, description of exemplary embodiment 20 of the present invention will be performed. In the description of exemplary embodiment 20, identical reference signs will be given to configural elements that correspond to the configural elements of exemplary embodiments 1 to 19, and detailed description of those corresponding configural elements will be omitted.

Exemplary embodiment 20 differs from exemplary embodiments 1 to 19 in the following point but is configured in the same manner as exemplary embodiments 1 to 19 in other points.

Figure 25:
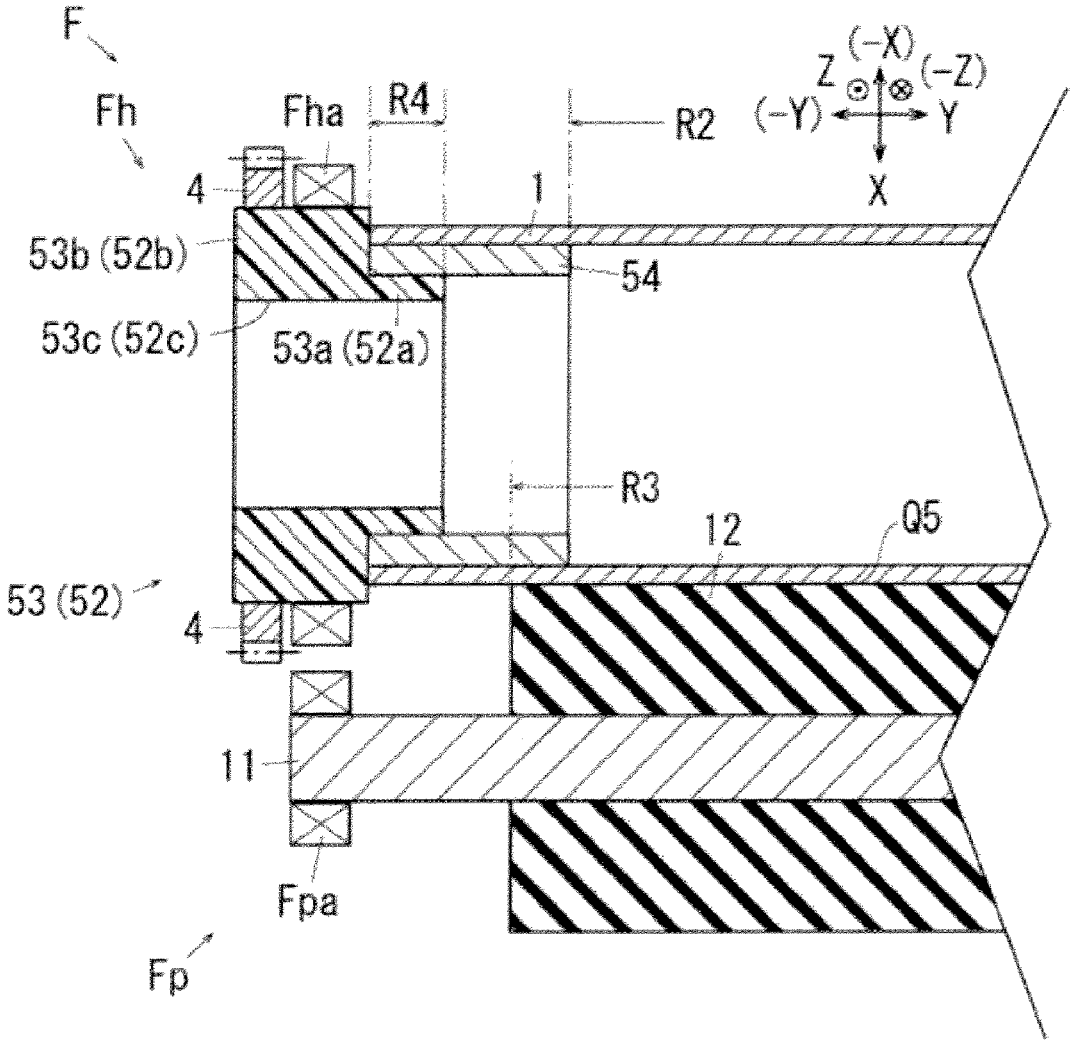
FIG. 25 is an explanatory diagram of buffer members of exemplary embodiment 20 and is a diagram that corresponds to FIG. 6 of exemplary embodiment 1.

FIG. 25 is an explanatory diagram of a buffer member of exemplary embodiment 20 and is a diagram that corresponds to FIG. 6 of exemplary embodiment 1.

In FIG. 25, the fixing device F of exemplary embodiment 20 includes, in the same manner as in exemplary embodiment 13, the heat roll Fh that includes the metal rings 54. It will be noted that, in exemplary embodiment 20, the positions of the axial direction outer ends of the pressure roll Fp are, in the same manner as in exemplary embodiment 17, set further inward in the axial direction than the base body insertion portions 52*a* and 53*a*. Further, the axial direction inner ends of the metal rings 54 are set so as to be further inward than the axial direction outer ends of the pressure roll Fp.

(Operation of Exemplary Embodiment 20)

In the fixing device F of exemplary embodiment 20 that is provided with the above-described configuration, the metal rings 54 elastically deform at the both end portions of the base body 1 while the base body 1 elastically deforming by contact with the pressure roll Fp, and stress concentration in the base body 1 is alleviated. At this time, in exemplary embodiment 20, the axial direction inner end portions of the metal rings 54 are set further inward than the axial direction outer ends of the pressure roll Fp, therefore, and the metal rings 54 are disposed so as to partially overlap the contact region between the base body 1 and the pressure roll Fp. Consequently, in comparison to a case where the metal rings 54 are not disposed, the contact pressure becomes higher in the contact region Q5 between the base body 1 and the pressure roll Fp, and the driving force of the heat roll Fh is efficiently transmitted to the pressure roll Fp.

[Exemplary Embodiment 21]

Next, description of exemplary embodiment 21 of the present invention will be performed. In the description of exemplary embodiment 21, identical reference signs will be given to configural elements that correspond to the configural elements of exemplary embodiments 1 to 20, and detailed description of those corresponding configural elements will be omitted.

Exemplary embodiment 21 differs from exemplary embodiments 1 to 20 in the following point but is configured in the same manner as exemplary embodiments 1 to 20 in other points.

Figure 26:
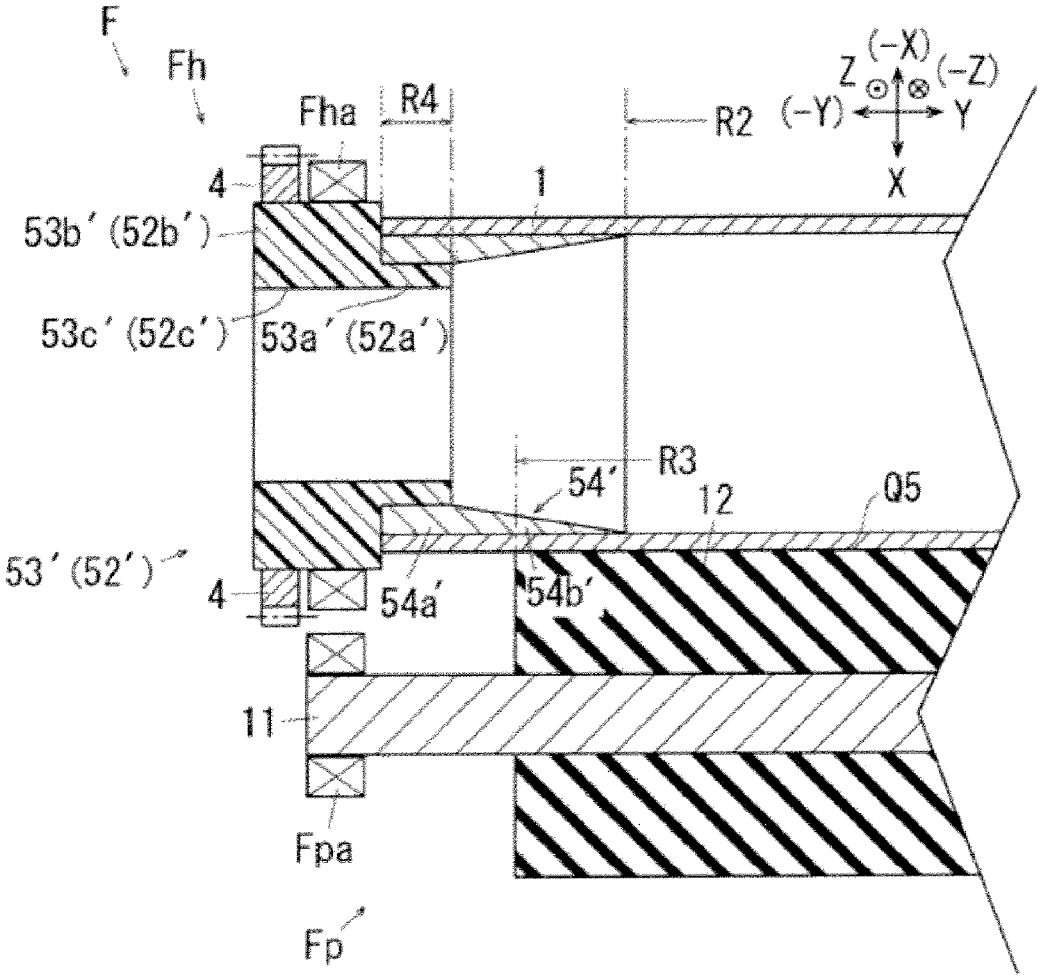
FIG. 26 is an explanatory diagram of buffer members of exemplary embodiment 21 and is a diagram that corresponds to FIG. 6 of exemplary embodiment 1.

FIG. 26 is an explanatory diagram of a buffer member of exemplary embodiment 21 and is a diagram that corresponds to FIG. 6 of exemplary embodiment 1.

In FIG. 26, the fixing device F of exemplary embodiment 21 includes, in the same manner as in exemplary embodiment 14, the heat roll Fh that includes the metal rings 54'. It will be noted that, in exemplary embodiment 21, the positions of the axial direction outer ends of the pressure roll Fp are, in the same manner as in exemplary embodiment 17, set further inward in the axial direction than the base body insertion portions 52*a*' and 53*a*'. Further, the axial direction inner ends of the metal rings 54' are set so as to be further inward than the axial direction outer ends of the pressure roll Fp.

(Operation of Exemplary Embodiment 21)

In the fixing device F of exemplary embodiment 21 that is provided with the above-described configuration, the metal rings 54' elastically deform at the both end portions of the base body 1 while the base body 1 elastically deforming by contact with the pressure roll Fp, and stress concentration in the base body 1 is alleviated. At this time, in exemplary embodiment 21, the axial direction inner end portions of the metal rings 54' are set further inward than the axial direction outer ends of the pressure roll Fp, and the metal rings 54' are disposed so as to partially overlap the contact region between the base body 1 and the pressure roll Fp. Consequently, in comparison to a case where the metal rings 54' are not disposed, the contact pressure becomes higher in the contact region Q5 between the base body 1 and the pressure roll Fp, and the driving force of the heat roll Fh is efficiently transmitted to the pressure roll Fp.

[Exemplary Embodiment 22]

Next, description of exemplary embodiment 22 of the present invention will be performed. In the description of exemplary embodiment 22, identical reference signs will be given to configural elements that correspond to the configural elements of exemplary embodiments 1 to 21, and detailed description of those corresponding configural elements will be omitted.

Exemplary embodiment 22 differs from exemplary embodiments 1 to 21 in the following point but is configured in the same manner as exemplary embodiments 1 to 21 in other points.

Figure 27:
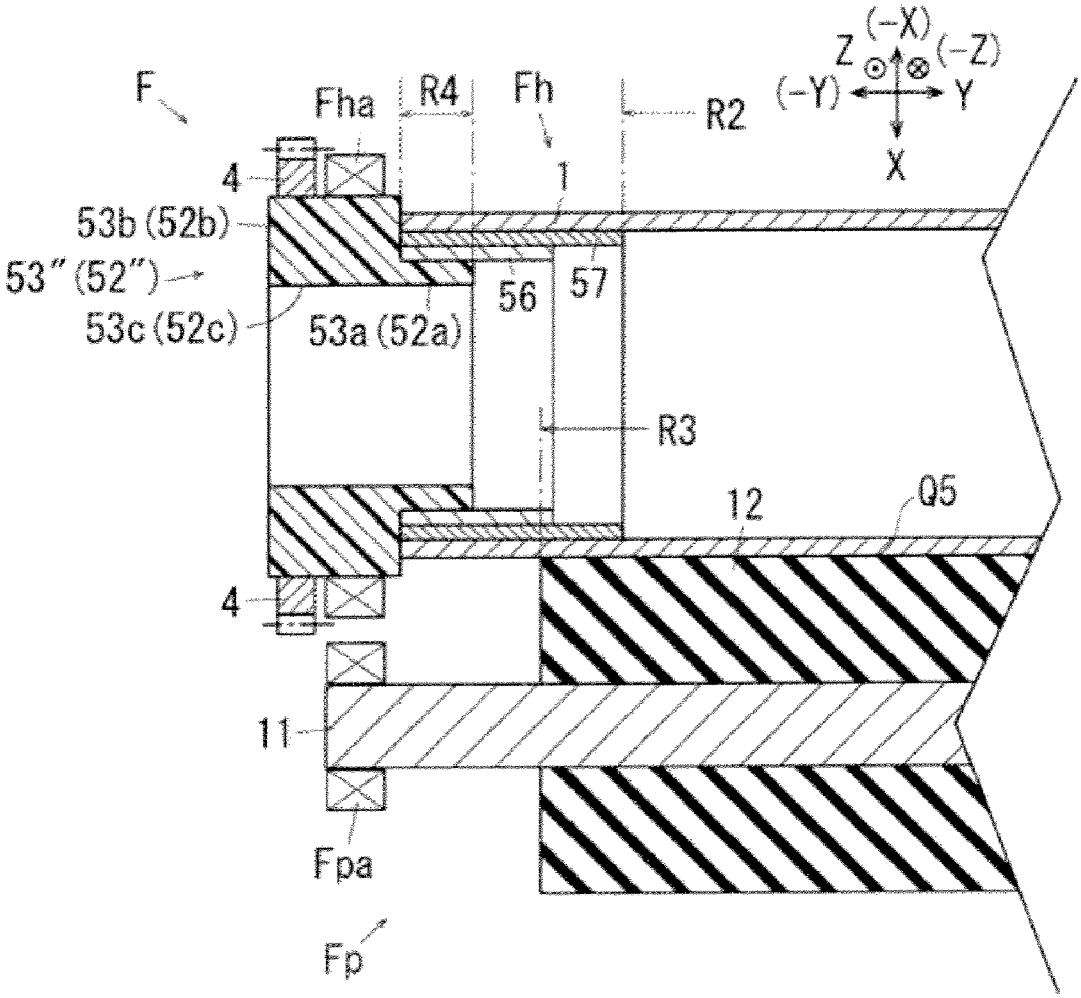
FIG. 27 is an explanatory diagram of buffer members of exemplary embodiment 22 and is a diagram that corresponds to FIG. 6 of exemplary embodiment 1.

FIG. 27 is an explanatory diagram of a buffer member of exemplary embodiment 22 and is a diagram that corresponds to FIG. 6 of exemplary embodiment 1.

In FIG. 27, the fixing device F of exemplary embodiment 21 includes, in the same manner as in exemplary embodiment 15, the heat roll Fh that includes the double metal rings 56 and 57. It will be noted that, in exemplary embodiment 22, the positions of the axial direction outer ends of the pressure roll Fp are, in the same manner as in exemplary embodiment 17, set further inward in the axial direction than the base body insertion portions 52*a* and 53*a*. Further, the axial direction inner ends of the metal rings 56 and 57 are both set so as to be further inward than the axial direction outer ends of the pressure roll Fp.

(Operation of Exemplary Embodiment 22)

In the fixing device F of exemplary embodiment 22 that is provided with the above-described configuration, the metal rings 56 and 57 elastically deform at the both end portions of the base body 1 while the base body 1 elastically deforming by contact with the pressure roll Fp, and stress concentration in the base body 1 is alleviated. At this time, the metal rings (springs) whose thickness is thin are doubled, discontinuity of the elastic modulus along the axial direction is alleviated in the same manner as in exemplary embodiment 15, and stress concentration is alleviated even more in comparison to the case of exemplary embodiment 21.

Further, in exemplary embodiment 22, the axial direction inner end portions of the metal rings 56 and 57 are set further inward than the axial direction outer ends of the pressure roll Fp, and the metal rings 56 and 57 are disposed so as to partially overlap the contact region between the base body 1 and the pressure roll Fp. Consequently, in comparison to a case where the metal rings 56 and 57 are not disposed, the contact pressure becomes higher in the contact region Q5 between the base body 1 and the pressure roll Fp, and the driving force of the heat roll Fh is efficiently transmitted to the pressure roll Fp.

[Exemplary Embodiment 23]

Next, a fixing device 100 (a fixing device F) pertaining to exemplary embodiment 23 will be described.

Figure 38A:
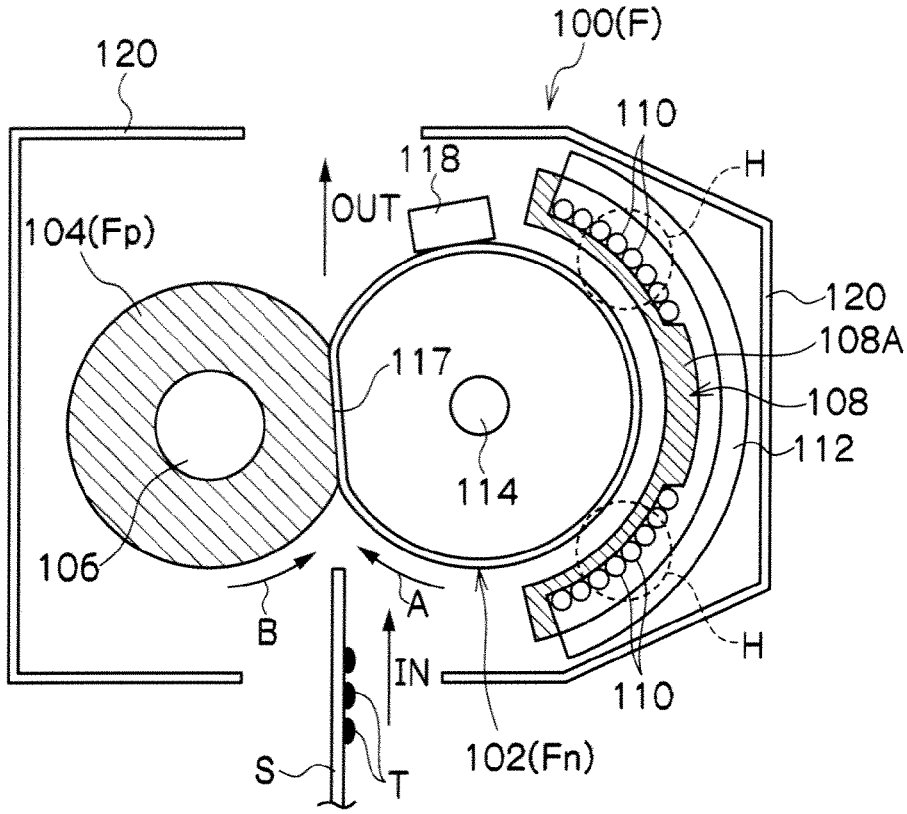
FIG. 38A is a cross-sectional diagram of a fixing device of exemplary embodiment 23.

As shown in FIG. 38A, the fixing device 100 is provided with a casing 120 in which is formed an opening for allowing a recording paper (sheet) S to enter or be discharged. Inside the casing 120, there is disposed an endless fixing roll 102 (a heat roll Fh) that rotates in the direction of arrow A. Unillustrated gears are adhered to both end portions of the fixing roll 102.

A bobbin 108 that is configured by an insulating material is disposed in a position facing the outer peripheral surface of the fixing roll 102. The bobbin 108 is formed in a substantially circular arc shape following the outer peripheral surface of the fixing roll 102, and a convex portion 108A is disposed so as to project from the substantial center portion of the surface of the bobbin 108 on the opposite side of the fixing roll 102. The distance between the bobbin 108 and the fixing roll 102 is about 1 to 3 mm.

An excitation coil 110 that generates a magnetic field H by energization is wound plural times around the bobbin 108 as a center in the axial direction (depth direction of the page of FIG. 38A) about the convex portion 108A. A magnetic core 112 that is formed in a substantially circular arc shape following the circular arc shape of the bobbin 108 is disposed in a position facing the excitation coil 110 and is supported on the bobbin 108.

A pressure roll 104 (Fp) that drivenly-rotates in the direction of arrow B with respect to the rotation of the fixing roll 102 pressure-contacts the outer peripheral surface of the fixing roll 102.

The pressure roll 104 has a configuration where a foam silicon rubber sponge elastic layer with a thickness of 5 mm is disposed around a core metal (a shaft) 106 that is a metal such as aluminium and where a release layer that is carbon-added PFA with a thickness of 50 μm covers the outside of the foam silicon rubber sponge elastic layer. As the sponge elastic layer that is disposed around the core metal 106, a layer that includes plural through holes that penetrate the layer in the longitudinal direction of the core metal 106, for example, may also be used.

A thermistor 118 that measures the temperature of the surface of the fixing roll 102 is disposed in, so as to contact, a region of the surface of the fixing roll 102 that does not face the excitation coil 110 and which is on the discharge side of the recording paper S. The thermistor 118 measures the temperature of the surface of the fixing roll 102 as a result of its resistance value changing in accordance with the amount of heat that is imparted from the surface of the fixing roll 102. The contact position of the thermistor 118 is in the substantial center portion in the axial direction (depth direction of the page of FIG. 38A) of the fixing roll 102 such that the measured value does not change depending on the size of the recording paper S.

Figure 39:
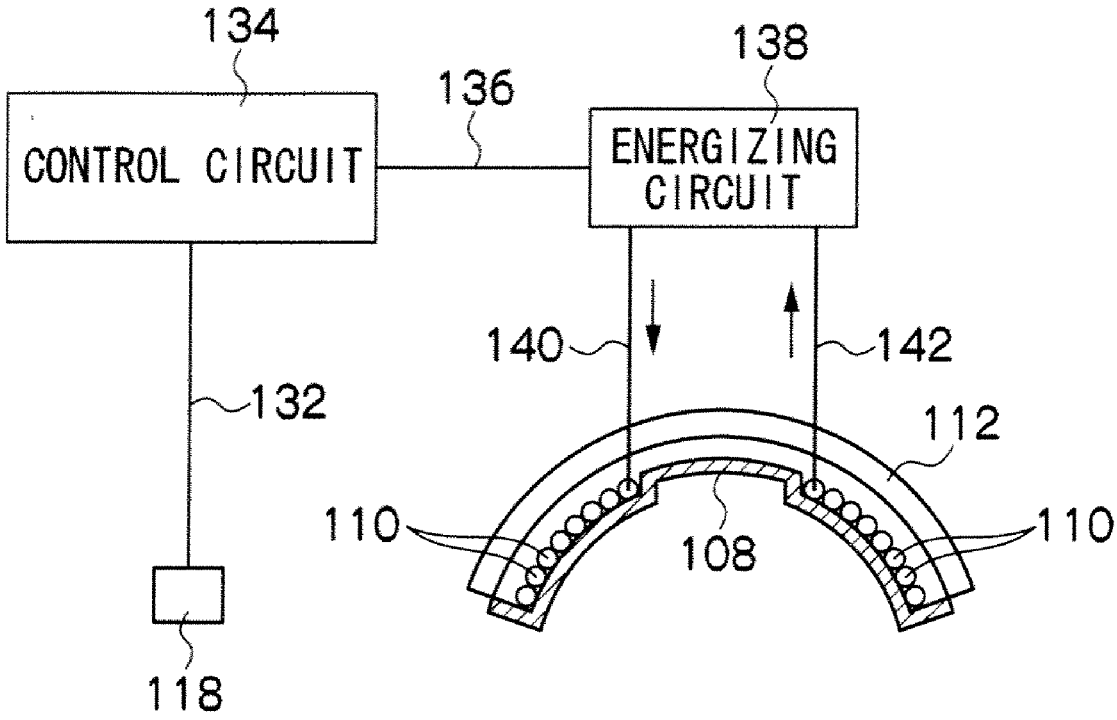
FIG. 39 is a diagram showing connection of a control circuit and an energizing circuit of exemplary embodiment 23.

As shown in FIG. 39, the thermistor 118 is connected via a wire 132 to a control circuit 134 that is disposed inside a control unit. Further, the control circuit 134 is connected via a wire 136 to an energizing circuit 138, and the energizing circuit 138 is connected via wires 140 and 142 to the excitation coil 110. The energizing circuit 138 is configured to be driven or stopped on the basis of an electrical signal sent from the control circuit 134 and to supply (direction of the arrows) or stop supplying an alternating current of a predetermined frequency to the excitation coil 110 via the wires 140 and 142.

Here, the control circuit 134 measures the temperature of the surface of the fixing roll 102 on the basis of the amount of electricity that has been sent from the thermistor 118 and compares this measured temperature with a fixing setting temperature (in the present exemplary embodiment, 170° C.) that is stored beforehand. When the measured temperature is lower than the fixing setting temperature, the control circuit 134 drives the energizing circuit 138 to energize the excitation coil 110 and cause the excitation coil 110 to generate the magnetic field H (see FIG. 38A) that serves as a magnetic circuit. Further, when the measured temperature is higher than the fixing setting temperature, the control circuit 134 stops the energizing circuit 138.

Next, the configuration of the fixing roll 102 will be described.

Figure 38B:
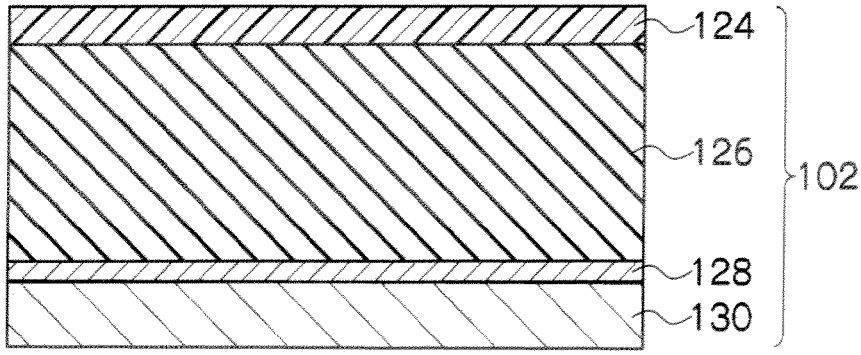
FIG. 38B is a cross-sectional diagram of a fixing roll 102 of the fixing device of exemplary embodiment 23.

As shown in FIG. 38B, the fixing roll 102 is, from inside to outside, configured by a base layer 130, a heat generating layer 128, an elastic layer 126 and a release layer 124, and these are laminated and integrated. Further, the fixing roll 102 has a diameter of 30 mm and a width direction length of 300 mm.

The base layer 130 is configured by a so-called temperature sensitive magnetic metal that has a magnetic permeability start-of-change temperature where its magnetic permeability begins to drop continuously in a temperature range that is equal to or lower than a heat resisting temperature (an allowable temperature limit: temperature at which deformation resulting from heat begins) of the heat generating layer 128 (or the fixing roll 102) and equal to or higher than the fixing setting temperature (fixing temperature that is required by the fixing roll 102) of the fixing device 100.

In the present exemplary embodiment, the allowable temperature limit of the fixing device 100 is 240° C., the fixing setting temperature is 170° C., and steel whose magnetic permeability start-of-change temperature is about 200° C. is used for the base layer 130. Thus, the base layer 130 becomes a ferromagnetic body at temperatures lower than the magnetic permeability start-of-change temperature and allows the magnetic field H (see FIG. 38A) to enter. At temperatures higher than the magnetic permeability start-of-change temperature, the base layer 130 becomes nonmagnetic (paramagnetic) and the amount of magnetic flux of the magnetic field H that penetrates the base layer 130 becomes larger.

Further, because the base layer 130 is a base for holding the strength of the fixing roll 102, it is preferable for the thickness of the base layer 130 to be set to 50 to 200 μm. For this reason, in the present exemplary embodiment, the thickness of the base layer 130 is set to 90 μm. It will be noted that a metal material configured by a metal such as steel, stainless steel, iron, nickel, chromium, silicon, boron, niobium, copper, zirconium or cobalt, or an alloy of these, or a multilayer clad metal that includes these, is used for the base layer 130. In the case of a multilayer clad metal, a multilayer clad metal that includes at least two layers or more of different types of metals including a heat generating layer may also be selected.

Here, when the temperature of the base layer 130 is equal to or lower than the magnetic permeability start-of-change temperature, the magnetic field H that penetrates the heat generating layer 128 enters the base layer 130, forms a closed magnetic circuit and strengthens thereof, because the base layer 130 is a ferromagnetic body. Thus, a heat generating amount of the heat generating layer 128 is sufficiently obtained. Further, when the temperature of the base layer 130 is equal to or higher than the magnetic permeability start-of-change temperature, the magnetic field H penetrates the base layer 130 and weakens thereof.

The heat generating layer 128 is configured by a metal material that generates heat by electromagnetic induction action where an overcurrent flows so as to generate a magnetic field that cancels out the mentioned magnetic field H. Further, it is necessary for the heat generating layer 128 to be configured thinner than the surface depth in order to allow the magnetic flux of the magnetic field H to penetrate. As the metal material that is used, there can, for example, be used a metal material of gold, silver, copper, aluminium, zinc, tin, lead, bismuth, beryllium, antimony, or an alloy of these.

In the present exemplary embodiment, in order to also shorten the warm-up time of the fixing device 100, it is good for the thickness of the heat generating layer 128 to be as thin as possible. From the standpoint of low costs and the standpoint of being able to efficiently obtain the necessary heat generating amount by using a nonmagnetic metal material whose thickness is 2 to 20 μm and whose specific resistance is equal to or less than $2.7\times10^{-8}$ cm in a range of an alternating current frequency of 20 kHz to 100 kHz where a universal power source can be utilized, copper is used as the heat generating layer 128, and the thickness of the heat generating layer 128 is 10 μm.

For the elastic layer 126, a silicon rubber or a fluorine rubber is used from the standpoint that excellent elasticity and heat resistance are obtained, and in the present exemplary embodiment, silicon rubber is used. In the present exemplary embodiment, the thickness of the elastic layer 126 is 200 μm. It will be noted that it is preferable for the thickness of the elastic layer 126 to be determined among 200 μm to 600 μm.

The release layer 124 is disposed in order to weaken the adhesive force between the fixing roll 102 and toner T (see FIG. 38A) that has been melted on the recording paper S and to make it easier for the recording paper S to be released from the fixing roll 102. In order to obtain excellent surface releasability, a fluorine resin, a silicon resin or a polyimide resin is used as the release layer 124, and in the present exemplary embodiment, PFA (tetrafluoroethylene/perfluoroalkoxyethylene copolymer resin) is used. The thickness of the release layer 124 is 30 μm.

It will be noted that, a member that has a thickness where the thickness of the base layer 130 or the thickness of the rigid layer (metal layer) excluding the elastic layer 126 and the release layer 124 from the fixing roll 102 is equal to or greater than 50 μm and where the surface pressure of the nip portion becomes equal to or greater than 0.5 kgf/cm$^2$ when 15 kgf to 20 kgf is applied thereto is defined as a fixing roll, and a member whose values are smaller than the above mentioned these values is defined as a fixing belt.

Next, the cross-sectional shapes of the fixing roll 102 and the pressure roll 104 will be described.

Figure 40A:
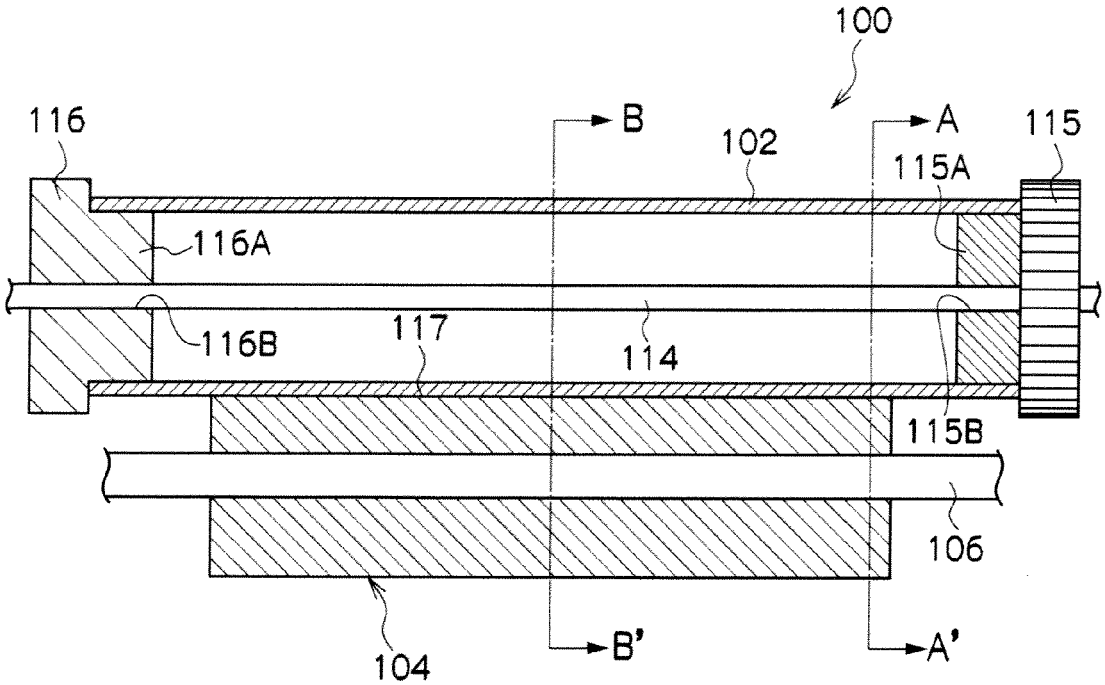
FIG. 40A is a cross-sectional diagram of the fixing roll and a pressure roll of exemplary embodiment 23.
Figure 40B:
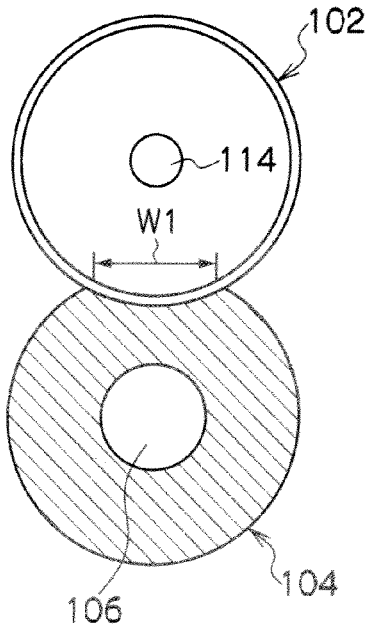
FIG. 40B is a cross-sectional diagram of the fixing roll and the pressure roll at an end portion in an axial direction of exemplary embodiment 23.
Figure 40C:
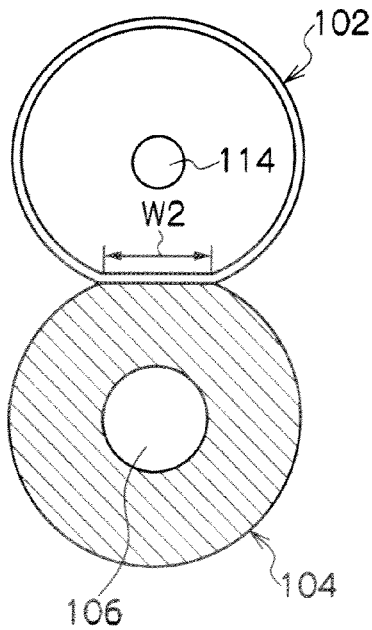
FIG. 40C is a cross-sectional diagram of the fixing roll and the pressure roll at a center portion in the axial direction of exemplary embodiment 23.

As shown in FIG. 40A, FIG. 40B and FIG. 40C, a drive gear 115 that is driven by an unillustrated drive motor is attached to one end portion of the fixing roll 102. In the drive gear 115, a cylindrical attachment portion 115A that has an outer diameter that is substantially equal to the inner diameter of the fixing roll 102 is disposed so as to project from the drive gear 115, and in the cross-sectional center of the attachment portion 115A (115), there is formed a through hole 115B into which a shaft 114 that extends in the longitudinal direction of the fixing roll 102 is press-inserted. Here, the drive gear 115 is attached as a result of the shaft 114 being press-inserted into the through hole 115B and the outer peripheral surface of the attachment portion 115A being adhered to the inner surface of the fixing roll 102.

A cap member 160 is attached to the other end portion of the fixing roll 102. In the cap member, a cylindrical attachment portion 116A that has an outer diameter that is substantially equal to the inner diameter of the fixing roll 102 is disposed so as to project from the cap member 116, and in the cross-sectional center of the attachment portion 116A, there is formed a through hole 116B into which the shaft 114 is press-inserted. Here, the cap member 116 is attached as a result of the through hole 116B being outer-press-inserted to the shaft 114 and the outer peripheral surface of the attachment portion 116A being adhered to the inner surface of the fixing roll 102 after the drive gear 115 has been attached to the fixing roll 102.

It will be noted that the drive gear 115 (the attachment portion 115A) and the cap member 116 (the attachment portion 116A) corresponds to the holding portions in the preceding exemplary embodiments.

Both ends of the shaft 114 are respectively inserted through unillustrated bearings (receiving portions) disposed inside the casing 120 of the fixing device 100 and are rotatably supported.

At both end portions of a nip portion (a nip region) 117 where the pressure roll 104 contacts the fixing roll 102, the fixing roll 102 becomes a shape that follows the outer shapes of the attachment portion 115A and the attachment portion 116A because the fixing roll 102 is supported from inside by the attachment portion 115A and the attachment portion 116A. Thus, as shown in cross section A-A', the cross-sectional shape of the fixing roll 102 at both end portions of the nip portion 117 is held in a circular shape. Further, the pressure roll 104 that includes a foam sponge deforms following the outer peripheral surface of the fixing roll 102 and becomes a shape that is recessed in the radial direction.

In the center portion of the nip portion 117, the cross-sectional shape of the fixing roll 102 becomes substantially flat, as shown in cross section B-B', because there is no member by which the fixing roll 102 is supported from inside.

It will be noted that the flatness of the center portion of the nip portion 117 is adjusted by the rigidity of the fixing roll 102, the rigidity of the pressure roll 104 and the attachment places of the attachment portions 115A and 116A, and the flatness of the nip portion 117 is realized mainly by adjusting the rigidity of the fixing roll 102. It will be noted that, the attachment portion 116A is supported from the inside of the fixing roll 102, but the attachment portion 116A can also be supported from the outside of the fixing roll 102 such that the cross-sectional shape of both end portions of the fixing roll 102 is regulated from the outer peripheral surface side and is held in a circular shape.

(Operation of Exemplary Embodiment 23)

Next, the operation of Exemplary Embodiment 23 of the present invention will be described.

As shown in FIG. 38A, FIG. 38B and FIG. 39, the recording paper S (or an envelope) to which the toner T has been transferred through the image forming process of the aforementioned printer U is sent to the fixing device 100. In the fixing device 100, the unillustrated drive motor is driven by the control unit, the drive gear 115 rotates, and the fixing roll 102 rotates in the direction of arrow A. The pressure roll 104 passively follows this and rotates in the direction of arrow B. At this time, the energizing circuit 138 is driven on the basis of the electrical signal from the control circuit 134, and the alternating current is supplied to the excitation coil 110.

When the alternating current is supplied to the excitation coil 110, the magnetic field H that serves as a magnetic circuit repeatedly generates and disappears around the excitation coil 110. When the magnetic field H goes across the heat generating layer 128 of the fixing roll 102, an overcurrent generates in the heat generating layer 128 such that a magnetic field that hinders changing of the magnetic field H arises.

The heat generating layer 128 generates heat in proportion to the surface resistance of the heat generating layer 128 and the size of the overcurrent that flows through the heat generating layer 128, whereby the fixing roll 102 is heated. The temperature of the surface of the fixing roll 102 is detected by the thermistor 118, and when the temperature has not reached the fixing setting temperature of 170° C., the control circuit 134 controls the driving of the energizing circuit 138 to energize the excitation coil 110 with the alternating current of the predetermined frequency. Further, when the temperature has reached the fixing setting temperature, the control circuit 134 stops controlling the energizing circuit 138.

Next, the recording paper S that has been sent into the fixing device 100 is heated and pressed by the fixing roll 102 that has reached the predetermined fixing setting temperature (170° C.) and the pressure roll 104, and the toner image is fixed to the surface of the recording paper S. The recording paper S that has been discharged from the fixing device 100 is discharged into a tray 38 by paper transporting rolls 36.

Here, a case will be described where, in the fixing device 100, fixing is performed on an envelope that is one example of a sack-like object.

Figure 41A:
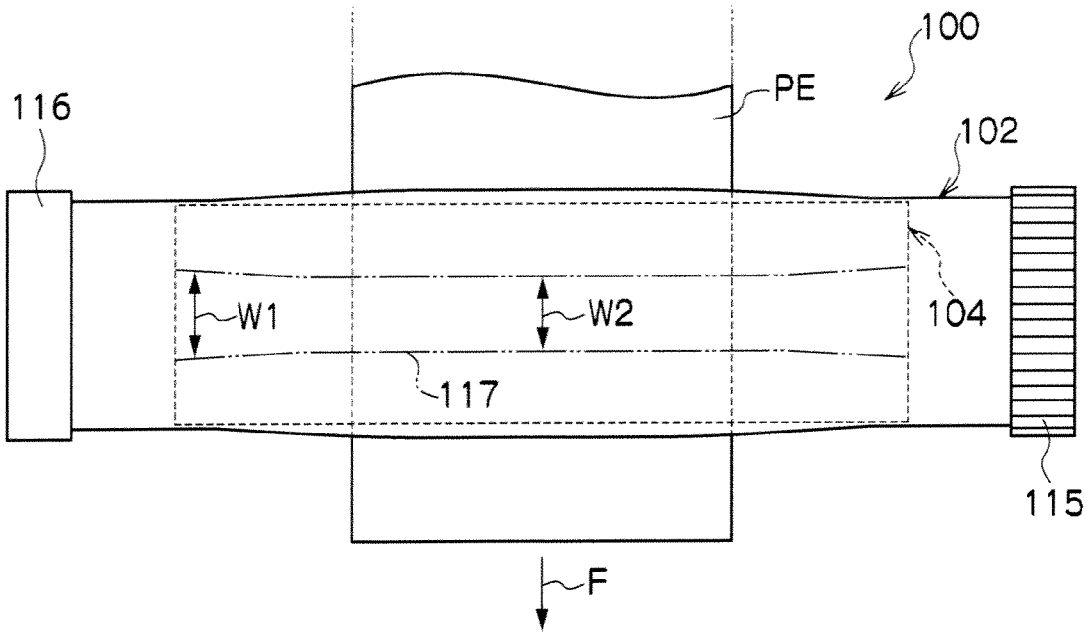
FIG. 41A is a diagram showing shape of a nip portion formed by the fixing roll and the pressure roll of exemplary embodiment 23.
Figure 41B:
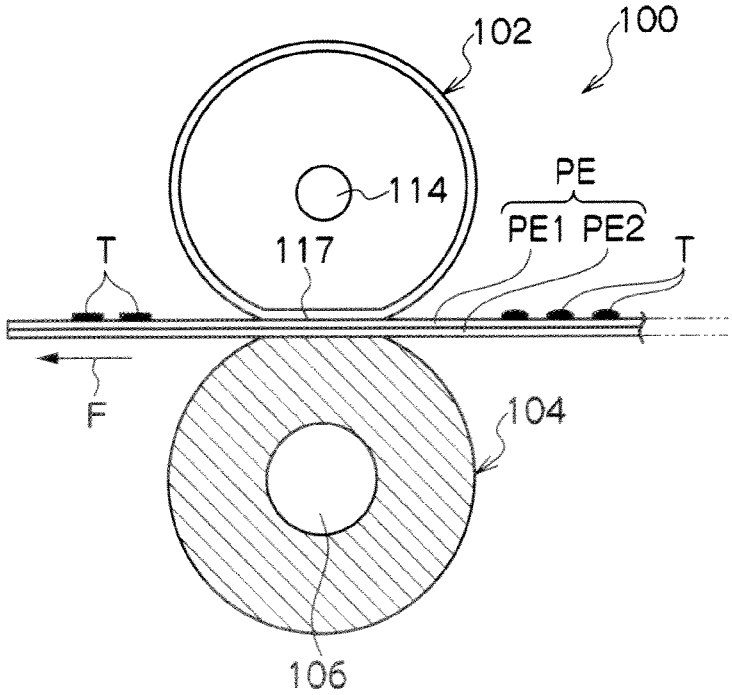
FIG. 41B is a cross-sectional diagram showing fixing state of a toner image in the fixing device of exemplary embodiment 23.

As shown in FIG. 41B, an envelope PE is configured by two layers, where the outer edge portion of an upper layer PE1 that faces the fixing roll 102 and to which the toner (image) T is to be fixed and the outer edge portion of a lower layer PE2 that faces the pressure roll 104 are adhered together by an adhesive. It will be noted that the envelope PE is shown as having a horizontal width of about 100 mm to about 120 mm, but the envelope PE may also have a horizontal width that is greater than this. Further, the envelope PE may also be configured by a number of plural layers that is equal to or greater than two layers.

As shown in FIG. 41A and FIG. 41B, in the fixing device 100, the fixing roll 102 is driven to rotate and the pressure roll 104 is passively rotated. Next, the envelope PE to which the toner T has been transferred enters the nip portion 117.

As a comparative example to the present exemplary embodiment, when the nip portion 117 has a convex nip shape toward the pressure roll 104 side, the upper layer PE1, by the fixing roll 102, warps into a circular arc shape, compressive stress acts thereon and the upper layer PE1 becomes contracted. On the other hand, the lower layer PE2 similarly warps into a circular arc shape, but tensile stress acts thereon because the lower layer PE2 is positioned more on the outer peripheral side than the upper layer PE1. Here, the outer edge portions of the envelope PE are adhered together, so the lower layer PE2 does not elongate further even when the upper layer PE 1 contracts, a relative displacement occurs between the upper layer PE1 and the lower layer PE2, and creases arise.

On the other hand, in the fixing device 100 of the exemplary embodiment 23 of the present invention, the shape of the nip portion 117 is substantially flat. For this reason, compressive stress and tensile stress that respectively cause the upper layer PE1 and the lower layer PE2 to warp in circular arc shapes virtually do not act on the envelope PE, and the toner T is fixed to the envelope PE by the action of heat and pressure while the envelope PE travels straightly in the direction of arrow F, so it becomes difficult for creases to arise.

It will be noted that, because both end portions of the fixing roll 102 are supported from inside by the attachment portions 115A and 116A, a situation where the cross-sectional shape of the fixing roll 102 deforms into an elliptical shape during rotation is suppressed. Thus, the fixing roll 102 is driven to rotate while maintaining a predetermined linear velocity.

Figure 42:
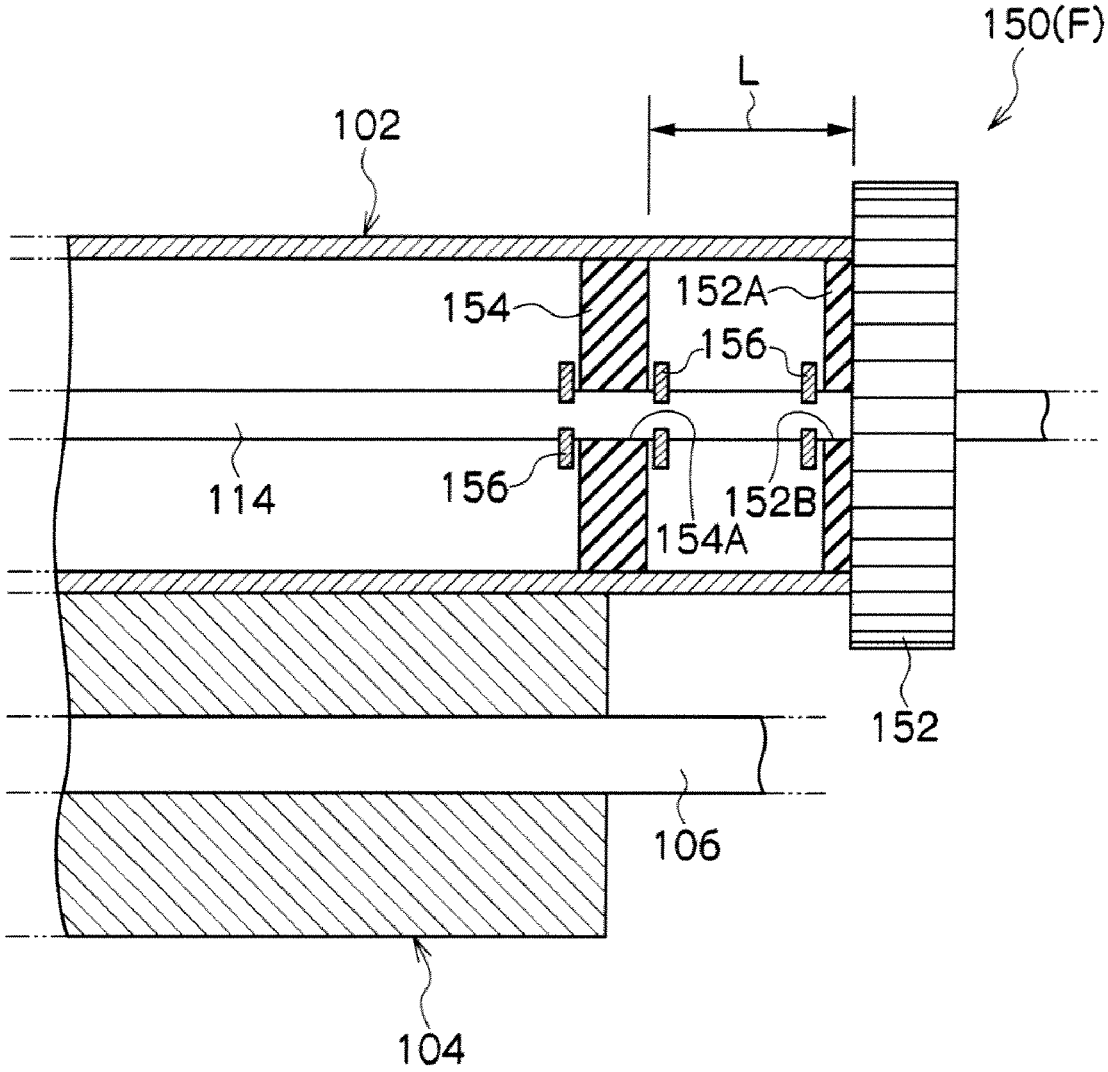
FIG. 42 is a cross-sectional diagram of a fixing device of modified example of exemplary embodiment 23.

As modified example of the fixing device 100 of the exemplary embodiment 23 of the present invention, for example, a fixing device 150 (F) such as shown in FIG. 42 may also be used.

In the fixing device 150, a drive gear 152 is disposed on an end portion of the fixing roll 102. In the drive gear 152, a cylindrical attachment portion 152A that has an outer diameter that is substantially equal to the inner diameter of the fixing roll 102 is disposed so as to project from the drive gear 152, and in the cross-sectional center, there is formed a through hole 152B that has a slightly smaller diameter than the outer diameter of the shaft 114. Here, the drive gear 152 is fixed as a result of the shaft 114 being press-inserted into the through hole 152B.

A holding plate 154 that holds the fixing roll 102 from inside in a circular shape is disposed in a position that corresponds to the position of the end portion of the pressure roll 104 on the center portion side in the axial direction of the shaft 114 (that is, in the vicinity of the end portion of the pressure roll 104). A through hole 154A is formed in the cross-sectional center of the holding plate 154, and the shaft 114 is inserted through the through hole 154A. Further, groove portions are formed in the shaft 114 along its circumferential direction, and E rings 156 are engaged in the groove portions, whereby the holding plate 154 is positioned in a position a distance L away from the drive gear 152. Another holding plate 154 is also disposed at the other end side in the similar way, preferably.

The fixing roll 102 in the fixing device 150 is assembled by inserting the shaft 114 through the inside of the fixing roll 102 and adhering the drive gear 152 after the holding plate 154 and the drive gear 152 have been attached to the shaft 114.

Here, the position of the holding plate 154 in the axial direction of the shaft 114 changes by the formation positions of the groove portions being changed. In this manner, the holding plate 154 is made independent of the drive gear 152, and the position of the holding plate 154 is appropriately determined between the end portion of the pressure roll 104 and the end portion of the fixing roll 102, whereby the circular state of the end portion of the fixing roll 102 is held, and the shape of the center portion of the nip portion 117 is adjusted to be substantially flat.

[Exemplary Embodiment 24]

Next, exemplary embodiment 24 of the fixing device and the image forming apparatus of the present invention will be described on the basis of the drawings. It will be noted that reference numerals that are the same as those in the preceding the exemplary embodiment 23 will be given to parts that are basically the same as those of the exemplary embodiment 23 and that description of those parts will be omitted.

Figure 43:
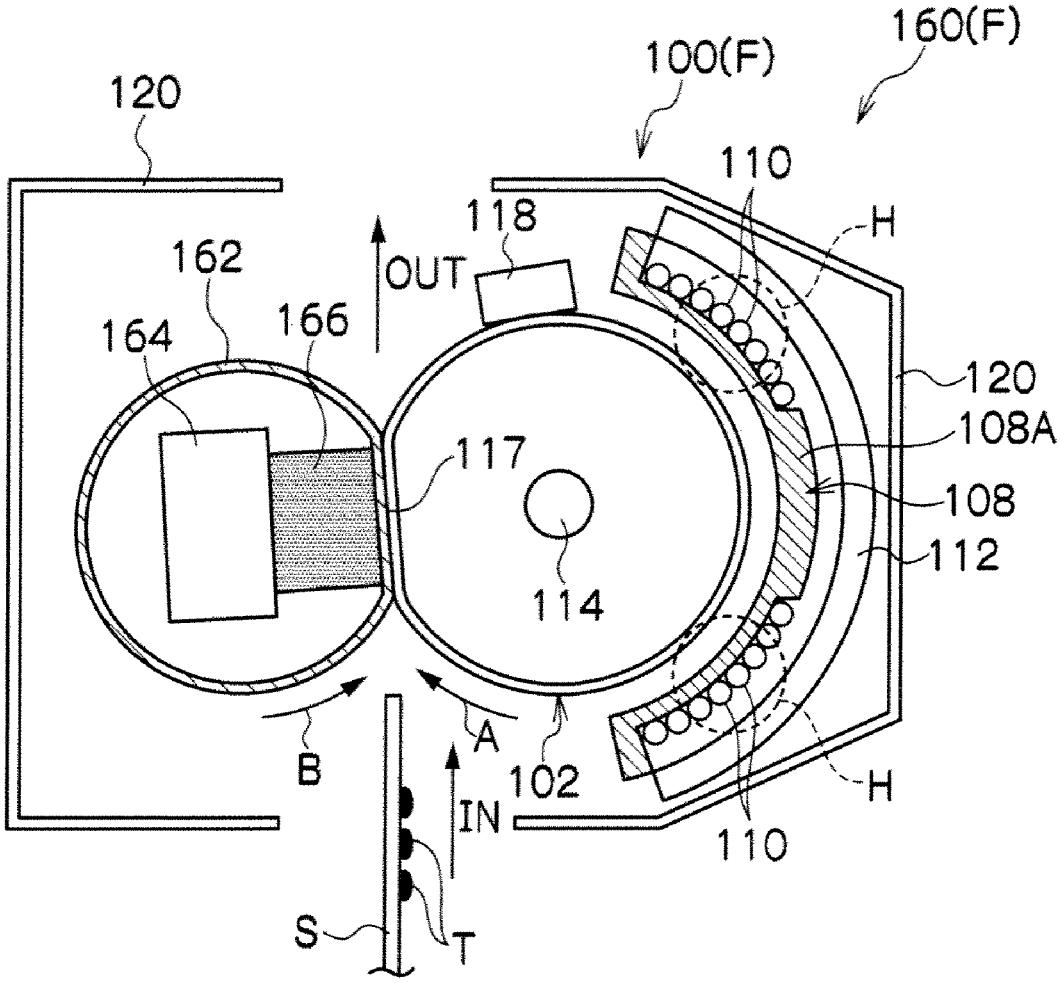
FIG. 43 is a cross-sectional diagram of a fixing device of exemplary embodiment 24.

In FIG. 43, there is shown a fixing device 160 (F). The fixing device 160 uses an endless pressure belt 162 instead of the pressure roll 104 of the fixing device 100 of the exemplary embodiment 23. Further, the fixing roll 102 has a diameter of 26 mm and a length of 300 mm, the material of the base layer 130 is stainless steel, and the thickness of the base layer 130 is about 110 μm.

The pressure belt 162 has a configuration where a release layer that is made from PFA and has a thickness of 30 μm covers the top of an endless belt-like base layer that is made from polyimide and has a thickness of 60 μm. Further, the width direction length of the pressure belt 162 is 240 mm. It will be noted that, because a member that has flexibility is good for the pressure belt 162, the base layer of the pressure belt 162 may also be a metal that is thinner and whose rigidity is weaker than those of the fixing roll base layer; for example, it may be steel, stainless steel or electroformed nickel with a thickness of 20 to 40 μm. When the material is metal, electric potential can be imparted to the base layer and the charge-amount of the pressure belt 162 can be made smaller than that of a resin such as polyimide, so electrostatic toner offsetting and the like can be suppressed.

Figure 44A:
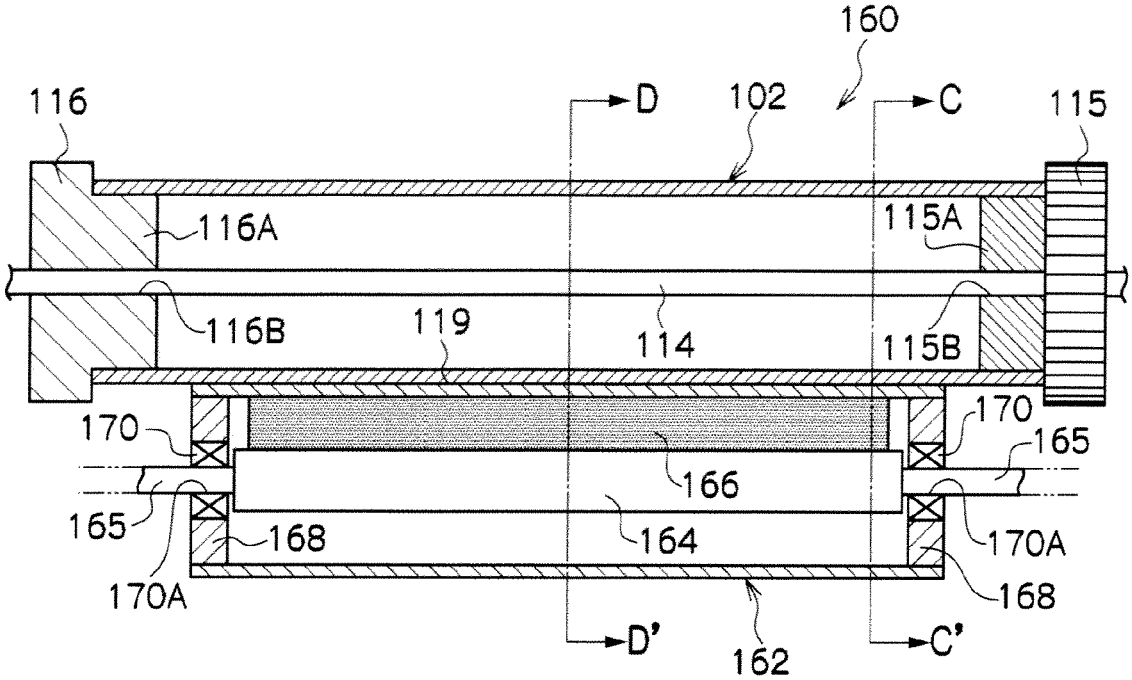
FIG. 44A is a cross-sectional diagram of a fixing belt and a pressure roll of exemplary embodiment 24.

As shown in FIG. 43 and FIG. 44A, a prismatic support member 164 is disposed in the substantial center inside the pressure belt 162. Cylindrical spindles 165 are disposed in the support member 164 so as to project outward from both axial direction end surfaces of the support member 164, and the end portions of the spindles 165 are fixed to side surface portions of the casing 120 of the fixing device 160.

One side surface of a substantially rectangular parallelopiped shaped pressure pad 166 that is made from a heat-resistant resin such as PPS (polyphenylene sulfide) is adhered to one side surface of the support member 164. Further, the other side surface of the pressure pad 166 contacts the inner peripheral surface of the pressure belt 162 and pressures a nip portion (a nip region) 119 where the pressure belt 162 contacts the fixing roll 102. The load that acts on the nip portion 119 is 20 kgf, and the nip width is 6 mm. Cylindrical cap members 168 that have outer diameters that are substantial equal to the inner diameter of the pressure belt 162 are respectively attached to the insides of both end portions of the pressure belt 162. Bearings 170 are fitted together with and fixed to the centers of the cap members 168. Here, after the support member 164 and the pressure pad 166 have been disposed inside the pressure belt 162, hole portions 170A in the bearings 170 are outer-inserted to the spindles 165, and the outer peripheral surfaces are adhered to the inside of the pressure belt 162, whereby the cap members 168 are attached to both end portions of the pressure belt 162. Thus, the pressure belt 162 is rotatably supported about the spindle 165 and passively rotates by the rotation of the fixing roll 102.

Next, the cross-sectional shapes of the fixing roll 102 and the pressure belt 162 will be described.

Figure 44B:
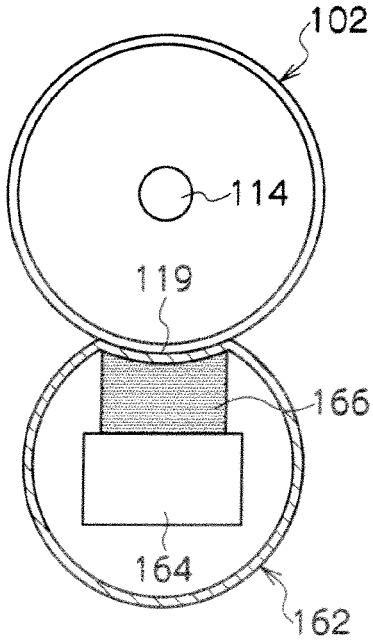
FIG. 44B is a cross-sectional diagram of the fixing belt and the pressure roll at an end portion in an axial direction of exemplary embodiment 24.
Figure 44C:
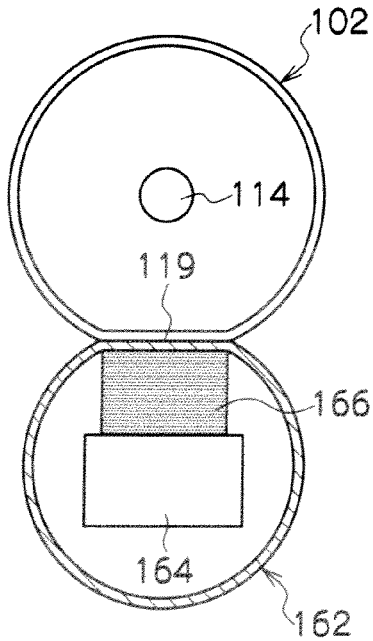
FIG. 44C is a cross-sectional diagram of the fixing belt and the pressure roll at a center portion in the axial direction of exemplary embodiment 24.

As shown in FIG. 44A, FIG. 44B and FIG. 44C, the drive gear 115 is attached to one end portion of the fixing roll 102, and the cap member 116 is attached to the other end portion of the fixing roll 102. At both end portions of the nip portion 119, the cross-sectional shape of the fixing roll 102 is held in a circular shape as shown in cross section C-C' because the fixing roll 102 is supported from inside by the attachment portion 115A and the attachment portion 116A. Further, the pressure belt 162 deforms following the outer peripheral surface of the fixing roll 102 and becomes a shape that is recessed in the radial direction.

In the center portion of the nip portion 119, the fixing roll 102 follows the rigidity of the pressure pad 166 via the pressure belt 162 because there is no member by which the fixing roll 102 is supported from inside. Thus, as shown in cross section D-D', the cross-sectional shape of the fixing roll 102 in the center portion of the nip portion 119 becomes substantially flat.

The width of the center portion of the nip portion 119 becomes narrower than the width at both end portions of the nip portion 119 because the fixing roll 102 and the support member 164 respectively receive a load and flex. In the present exemplary embodiment, in order to obtain a uniform nip width in the axial direction, correction of flexure in the axial direction of the fixing roll 102 and the support member 164 can be performed by the pressure pad 166. In order to correct flexure, the height of the pressure pad 166 is adjusted so as to make the center portion larger than the end portions in the axial direction thus, the correction can be easily performed. Further, the thickness of the support member 164 on the pressure pad 166 side may also be made thicker in accordance with the flexure amount such that the center portion becomes convex.

It will be noted that the flatness of the center portion of the nip portion 119 is adjusted by the rigidity of the fixing roll 102, the rigidities of the pressure belt 162, the pressure pad 166 and the support member 164, the shapes of the pressure pad 166 and the support member 164, and the attachment places of the attachment portions 115A and 116A, here, the flatness of the nip portion 119 is realized mainly by adjusting in a balance between the rigidity on the fixing roll 102 side and the rigidity on the pressure belt 162 side including the pressure pad 166 and the support member 164.

(Operation of Exemplary Embodiment 24)

Next, the operation of the exemplary embodiment 24 of the present invention will be described.

Figure 45:
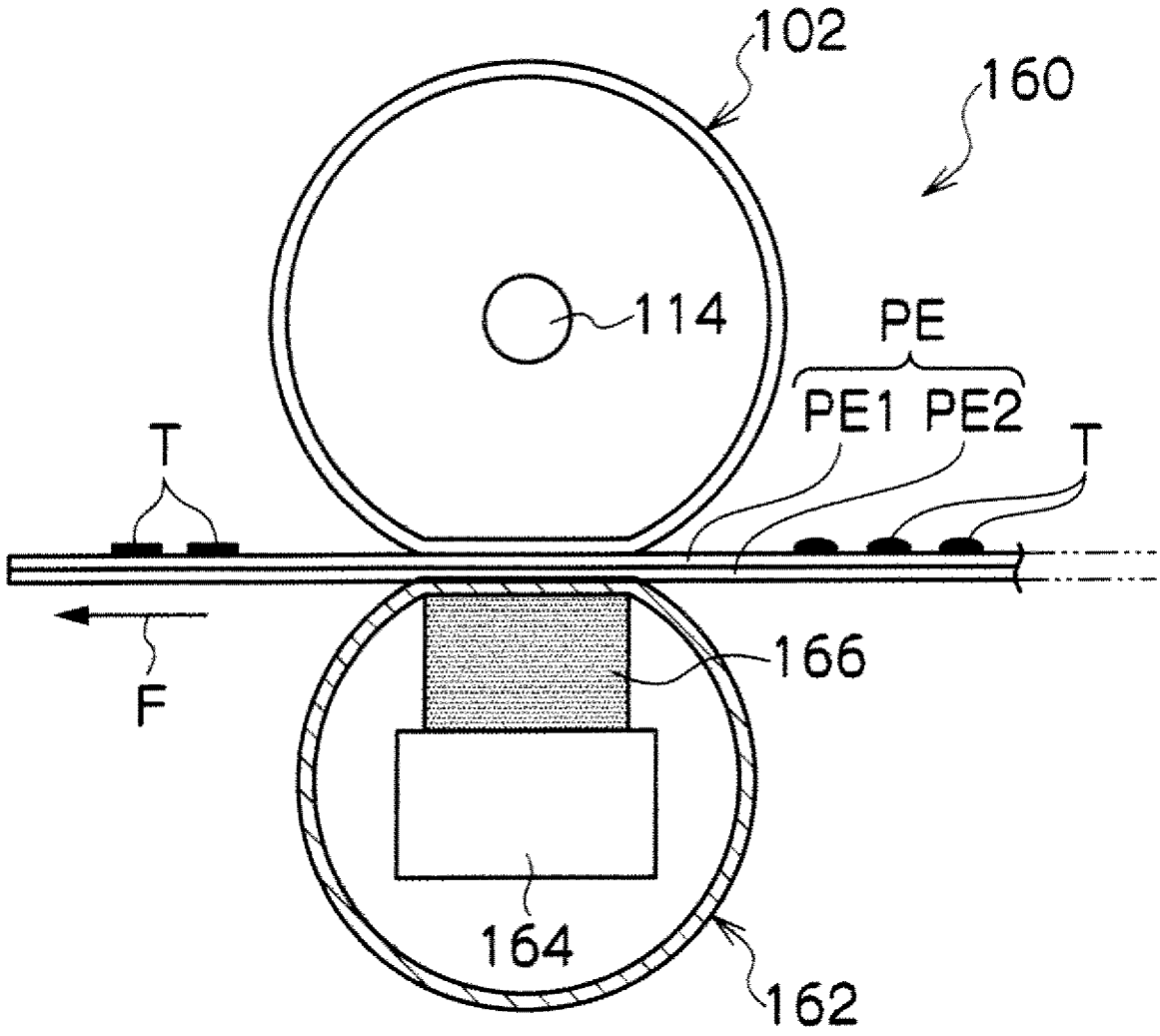
FIG. 45 is a cross-sectional diagram showing fixing state of a toner image in the fixing device of exemplary embodiment 24.

As shown in FIG. 45, the envelope PE to which the toner T has been transferred through the image forming process is sent to the nip portion 119 of the fixing device 160. The envelope PE that has been sent into the nip portion 119 is heated and pressed by the fixing roll 102 that has reached the predetermined fixing setting temperature (170° C.) and is rotating and the pressure belt 162 that passively rotates following the fixing roll 102, and the toner image is fixed to the surface of the envelope PE. In envelopes, a place may exist where papers are superposed up to a maximum of four to five layers, so portions may exist where the thickness of the envelope is different even in the same plane, and thus creases are easily formed.

Here, the shape of the nip portion 119 is substantially flat at least in a region equal to or greater than the transporting width of the envelope PE, so compressive stress and tensile stress that respectively cause the upper layer PE1 and the lower layer PE2 to warp in circular arc shapes virtually do not act on the envelope PE, and the toner T is fixed to the envelope PE by the action of heat and pressure while the envelope PE travels straightly in the direction of arrow F. Thus, it becomes difficult for creases to arise.

It will be noted that the present invention is not limited to the preceding exemplary embodiments.

The printer U may be not only a dry electrophotographic system that uses a solid developer but also a system that uses a liquid developer. Further, the unit for heating the fixing roll 102 may also be a heater that is disposed inside or outside the fixing roll.

Moreover, as the unit for detecting the temperature of the fixing roll 102, a thermocouple may also be used instead of the thermistor 118. The position where the thermistor 118 is attached is not limited to the surface of the fixing roll 102, the thermistor 118 may also be attached to the inner peripheral surface of the fixing roll 102. In this case, it becomes difficult for the surface of the fixing roll 102 to wear. Further, the thermistor 118 may also be attached to the surface of the pressure roll 104.

Further, in FIG. 44B and FIG. 44C of the present exemplary embodiment, the shape of the pressure pad 166 is imparted such that the nip portion shape became substantially flat in cross section D-D' (the fixing roll side becomes convex in cross section C-C'), but the invention is not limited to this; the nip portion shape may also be changed as needed such that, for example, the pressure belt side becomes convex in cross section D-D' (the fixing roll side becomes convex in cross section C-C'), or the nip portion shape may gently change from concave to convex from the nip portion entrance side to the exit side. It suffices to appropriately select and adjust the shape and rigidity of the pressure pad 166, and the nip portion shape can be appropriately changed in accordance with the purpose and object of the fixing device.

EXPERIMENTAL EXAMPLE

Next, an experiment to verify the effects of the present invention is performed. The experiment is performed by a computer simulation. It will be noted that, in the experiment, in contrast to the exemplary embodiments, the axial direction of the heat roll Fh and the pressure roll Fp is represented by the Z axis direction, the direction from the central axis of the pressure roll Fp toward the central axis of the heat roll Fh is represented by the +Y axis direction, the direction that is orthogonal to the Z axis direction and the Y axis direction is the X axis direction, and there is assumed XYZ axes of a left-handed system.

In the experiment, as the configuration of the heat roll Fh, there is employed the configuration of exemplary embodiment 10 shown in FIG. 15, with the axial direction length of the base body 1 being 250 mm, the outer diameter being 25 mm, and iron being used as the material.

Further, in the experiment, as the pressure roll Fp, there is employed a pressure roll where a rubber layer is formed around an iron shaft with an axial direction length of 250 mm and a diameter of 12 mm. The axial direction length of the rubber layer is 200 mm, the outer diameter of the rubber layer is 25 mm, and the rubber layer is modeled as a rubber layer of 1.6 MPa which corresponds to Young's modulus of a member of a fixing region portion of a belt-type pressure member that is presently commercially available. The belt-type fixing device is conventionally publicly known, so detailed description thereof will be omitted.

Additionally, stress acting on the heat roll Fh and displacement are measured in a case where a force of 100 N is added in the +Y direction, that is, toward the central axis of the heat roll Fh as contact pressure or so-called nip pressure on both end portions of the shaft of the pressure roll Fp. It will be noted that, as the stress, there is employed Mises stress (or von Mises stress), which is used in the judgment of the yield of a member.

Experimental Example 1

In experimental example 1, an experiment is performed with the thickness of the base body 1 being 0.10 mm.

Comparative Example 1

In comparative example 1, an experiment is performed with the thickness of the base body 1 being 0.16 mm.

Below, the experimental results are shown in FIG. 28A and FIG. 28B to FIG. 35A and FIG. 35B.

Figure 28A:
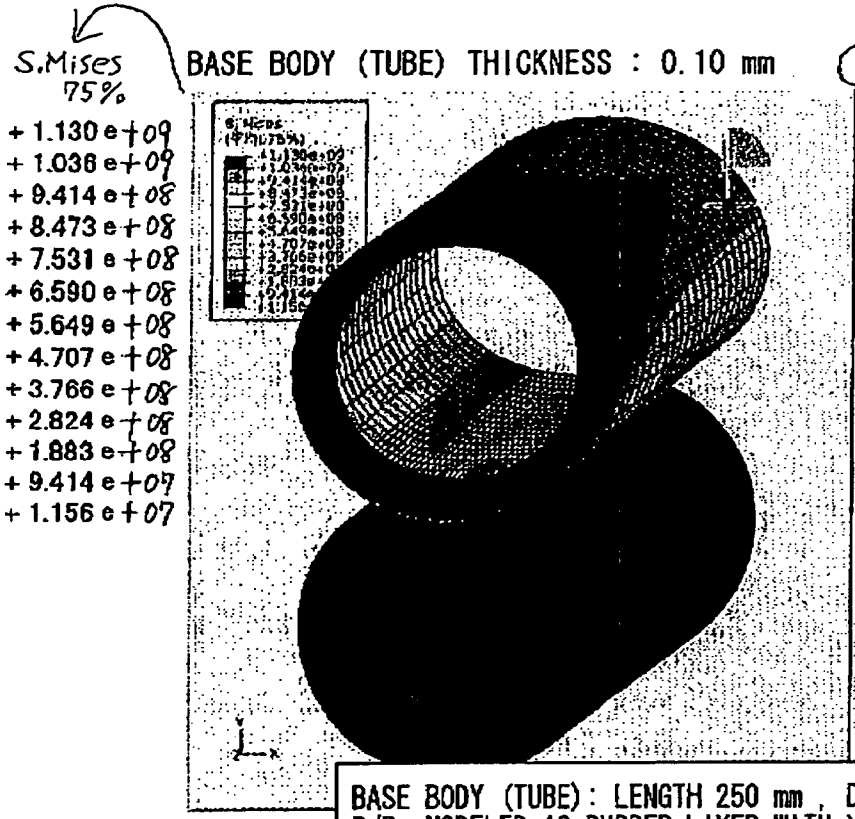
FIG. 28A and FIG. 28B are explanatory diagrams of stress distribution in experimental results, with FIG. 28A being an explanatory diagram of experimental example 1 and FIG. 28B being an explanatory diagram of comparative example 1.
Figure 28B:
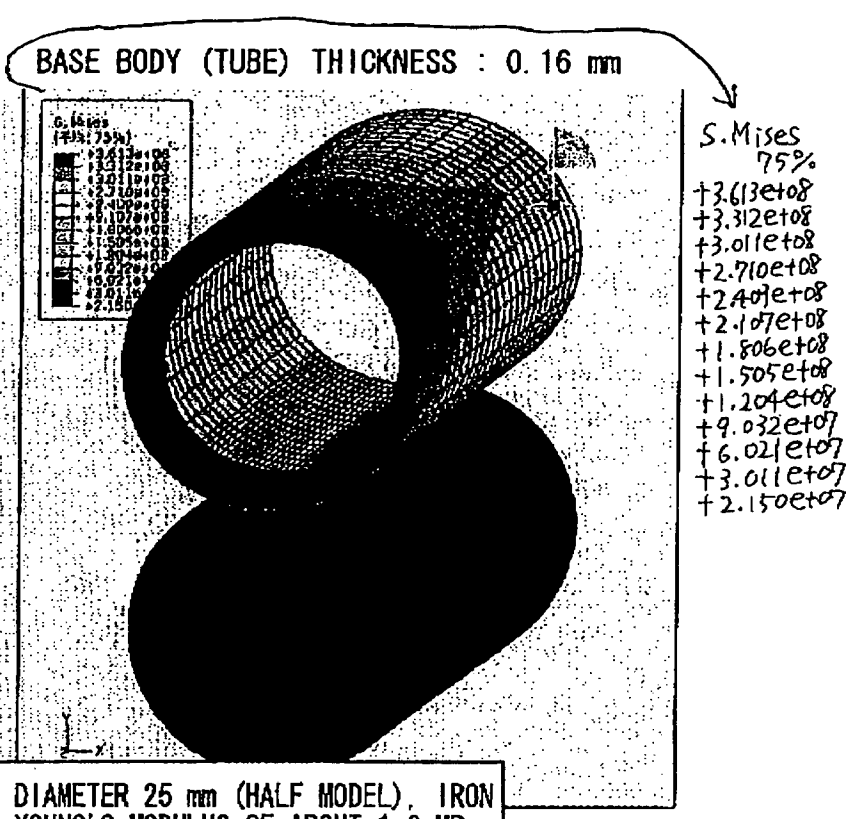

FIG. 28A and FIG. 28B are explanatory diagrams of stress distribution in the experimental results, with FIG. 28A being an explanatory diagram of experimental example 1 and FIG. 28B being an explanatory diagram of comparative example 1.

Figure 29A:
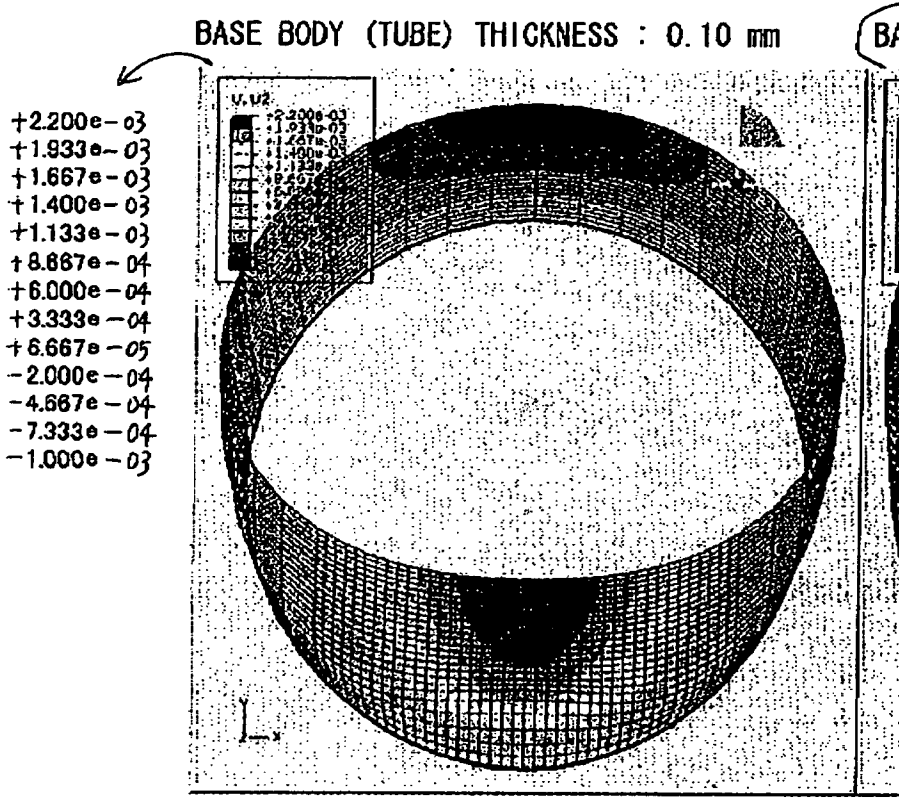
FIG. 29A and FIG. 29B are explanatory diagrams in a case where the distribution of displacement of basal bodies in the experimental results is seen from +Z and +Y sides, with FIG. 29A being an explanatory diagram of experimental example 1 and FIG. 29B being an explanatory diagram of comparative example 1.
Figure 29B:
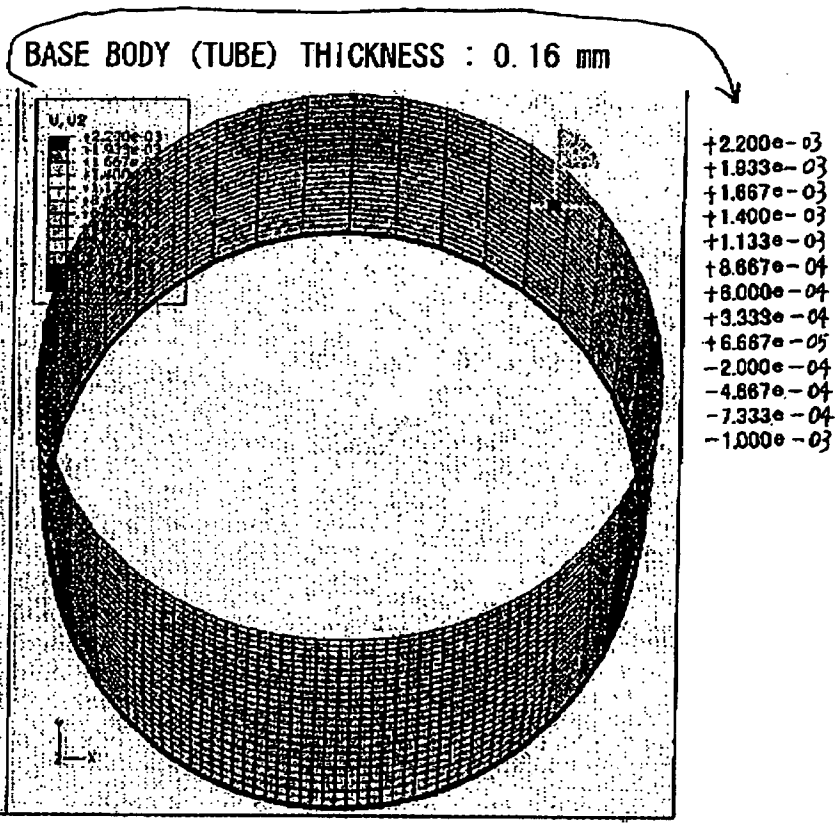

FIG. 29A and FIG. 29B are explanatory diagrams in a case where the distribution of displacement of the basal bodies in the experimental results is seen from +Z and +Y sides, with FIG. 29A being an explanatory diagram of experimental example 1 and FIG. 29B being an explanatory diagram of comparative example 1.

Figure 30A:
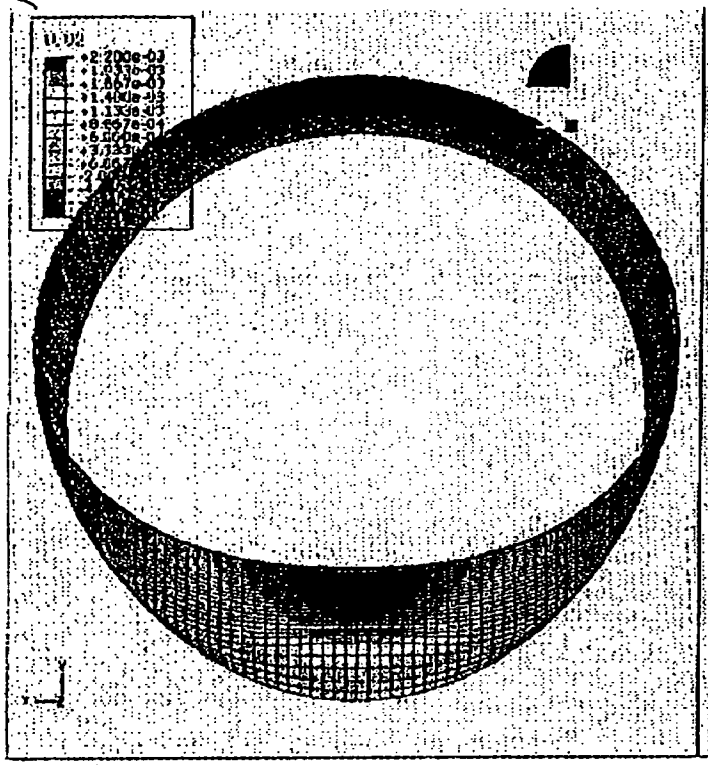
FIG. 30A and FIG. 30B are explanatory diagrams in a case where the distribution of displacement of the basal bodies in the same experimental results as FIG. 29 is seen from −Z and −Y sides, with FIG. 30A being an explanatory diagram of experimental example 1 and FIG. 30B being an explanatory diagram of comparative example 1.
Figure 30B:
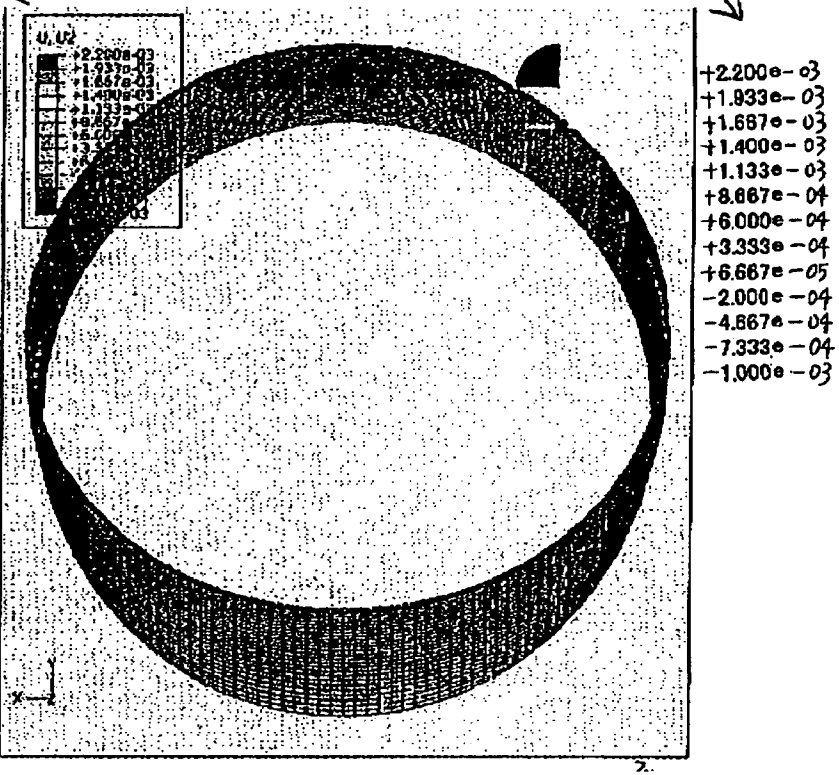

FIG. 30A and FIG. 30B are explanatory diagrams in a case where the distribution of displacement of the basal bodies in the same experimental results as FIG. 29 is seen from −Z and −Y sides, with FIG. 30A being an explanatory diagram of experimental example 1 and FIG. 30B being an explanatory diagram of comparative example 1.

Figure 31A:
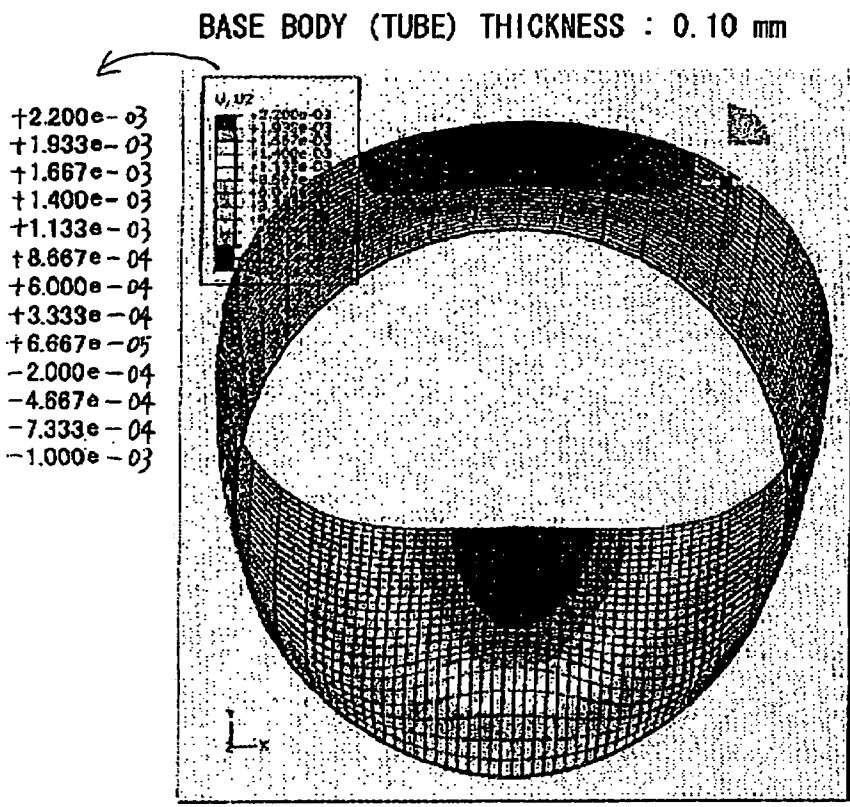
FIG. 31A and FIG. 31B are explanatory diagrams of a state where the distribution of displacement of the basal bodies in the same experimental results as FIG. 29 is doubled in a Y axis direction and emphasized, with FIG. 31A being an explanatory diagram of experimental example 1 and FIG. 31B being an explanatory diagram of comparative example 1.
Figure 31B:
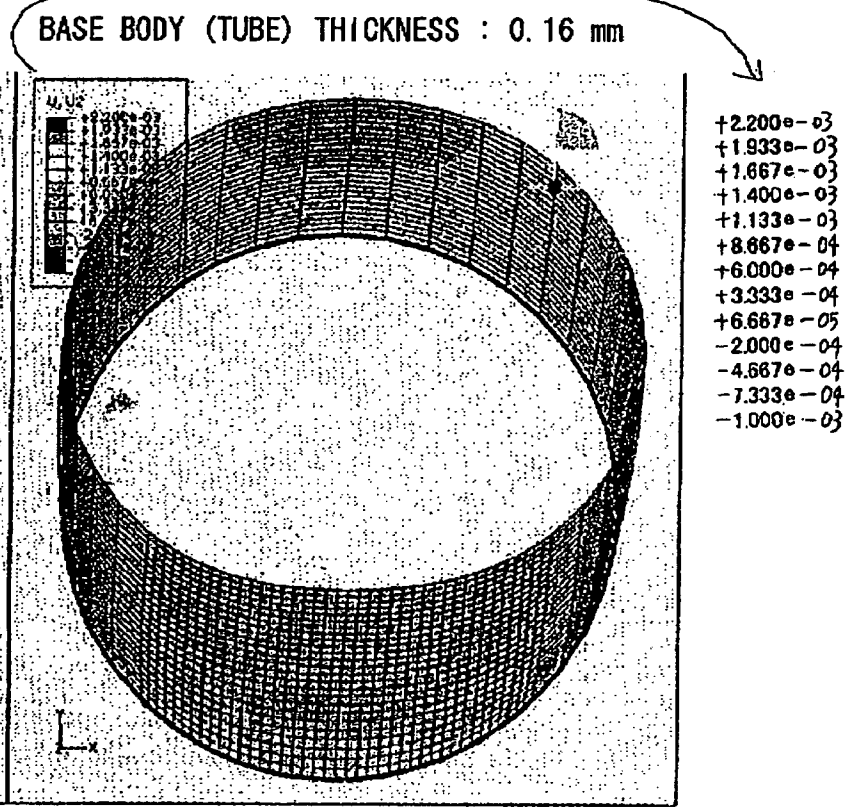

FIG. 31A and FIG. 31B are explanatory diagrams of a state where the distribution of displacement of the basal bodies in the same experimental results as FIG. 29 is doubled in the Y axis direction and emphasized, with FIG. 31A being an explanatory diagram of experimental example 1 and FIG. 31B being an explanatory diagram of comparative example 1.

Figure 32A:
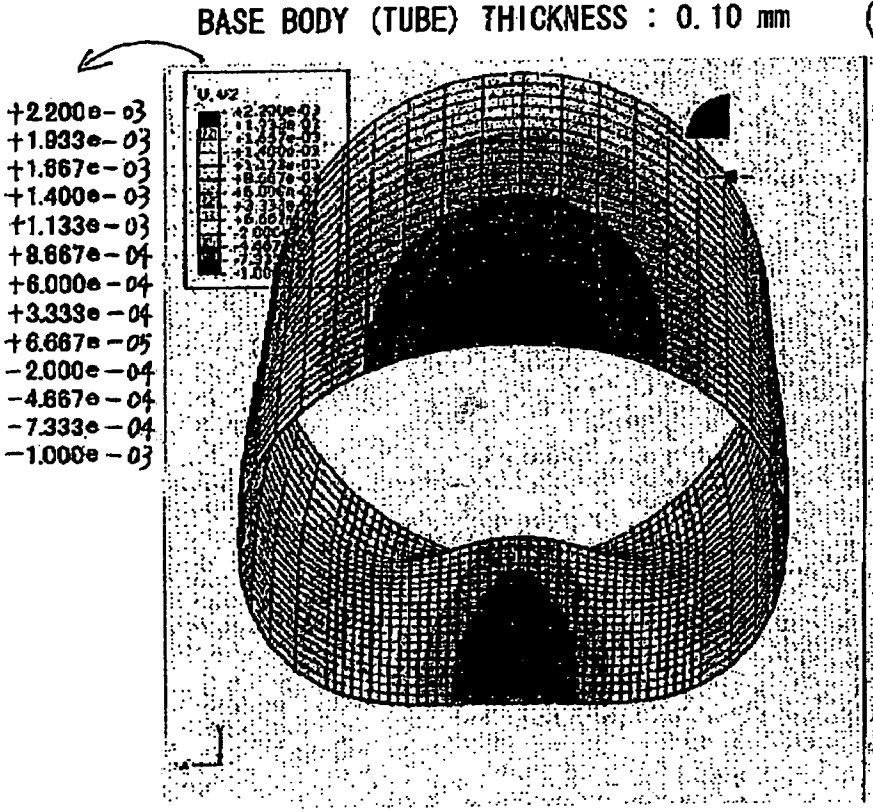
FIG. 32A and FIG. 32B are explanatory diagrams of a state where the distribution of displacement of the basal bodies in the same experimental results as FIG. 30 is doubled in the Y axis direction and emphasized, with FIG. 32A being an explanatory diagram of experimental example 1 and FIG. 32B being an explanatory diagram of comparative example 1.
Figure 32B:
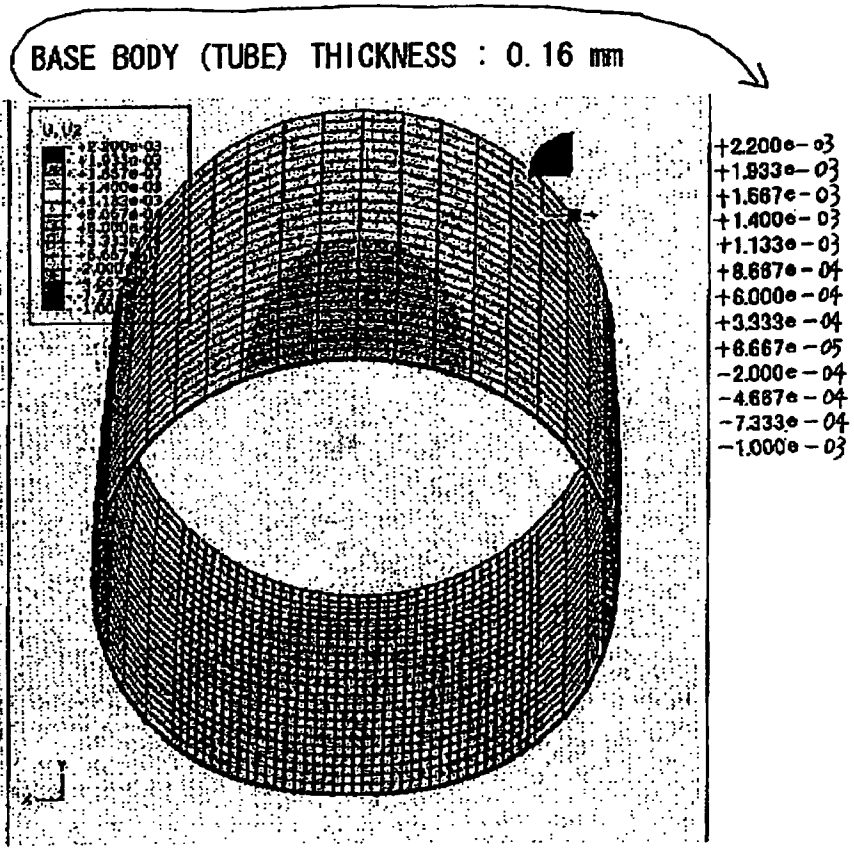

FIG. 32A and FIG. 32B are explanatory diagrams of a state where the distribution of displacement of the basal bodies in the same experimental results as FIG. 30 is doubled in the Y axis direction and emphasized, with FIG. 32A being an explanatory diagram of experimental example 1 and FIG. 32B being an explanatory diagram of comparative example 1.

Figure 33A:
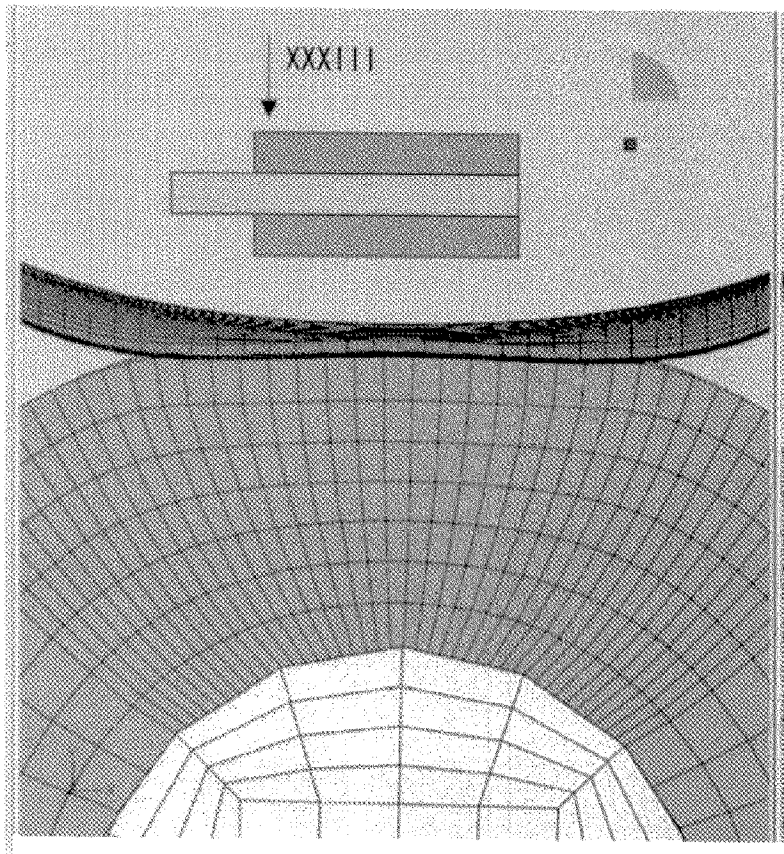
FIG. 33A and FIG. 33B are explanatory diagrams of a deformed state of a contact region between a heat roll and a pressure roll in the experimental results and a cross-sectional diagram along line XXXIII-XXXIII of FIG. 33A, with FIG. 33A being an explanatory diagram of experimental example 1 and FIG. 33B being an explanatory diagram of comparative example 1.
Figure 33B:
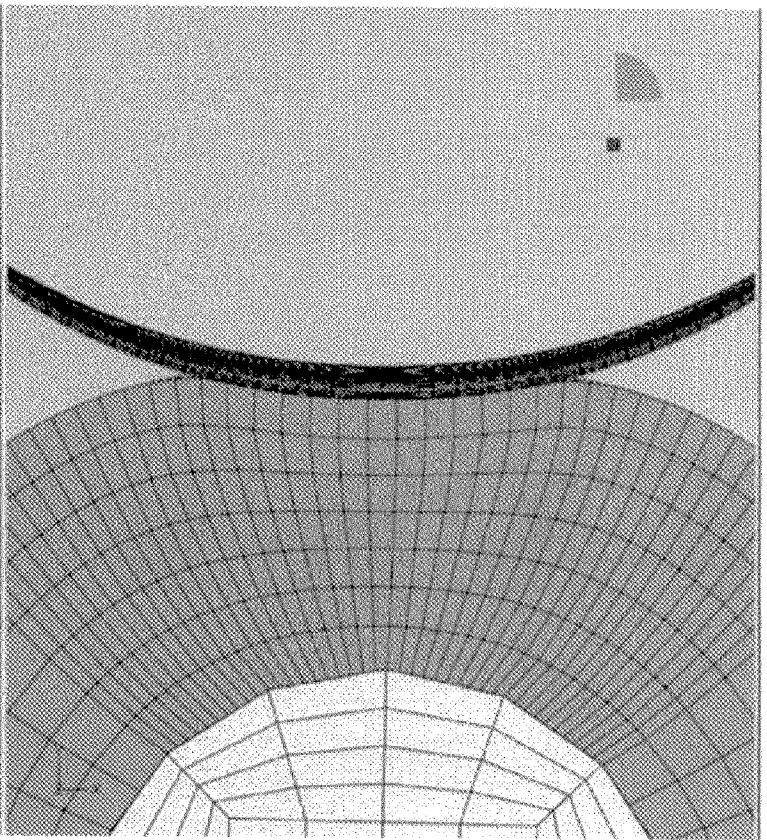

FIG. 33A and FIG. 33B are explanatory diagrams of a deformed state of the contact region between the heat roll and the pressure roll in the experimental results and a cross-sectional diagram along line XXXIII-XXXIII of FIG. 33A, with FIG. 33A being an explanatory diagram of experimental example 1 and FIG. 33B being an explanatory diagram of comparative example 1.

Figure 34A:
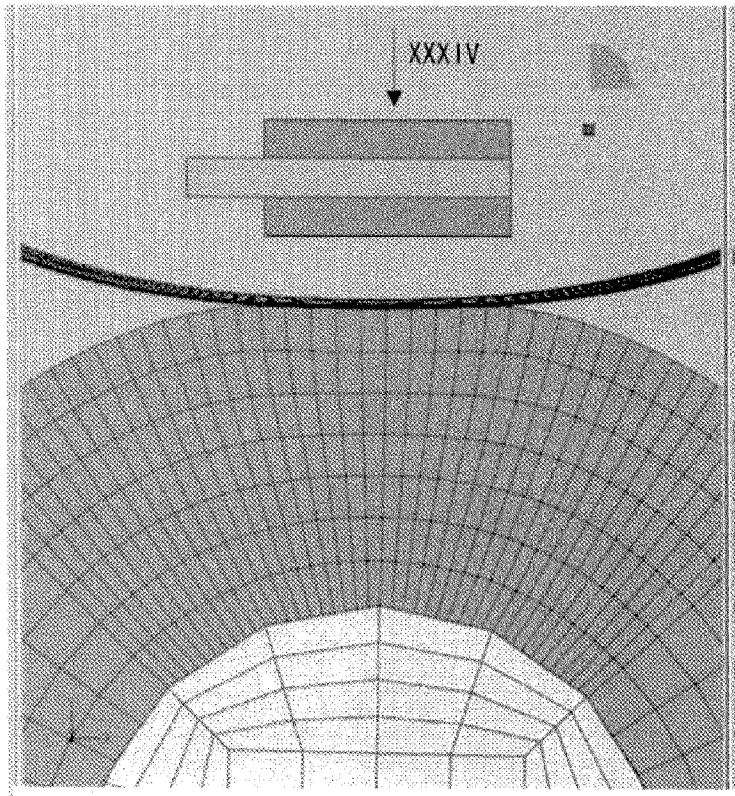
FIG. 34A and FIG. 34B are explanatory diagrams of a deformed state of the contact region between the heat roll and the pressure roll in the experimental results and a cross-sectional diagram along line XXXIV-XXXIV of FIG. 34A, with FIG. 34A being an explanatory diagram of experimental example 1 and FIG. 34B being an explanatory diagram of comparative example 1.
Figure 34B:
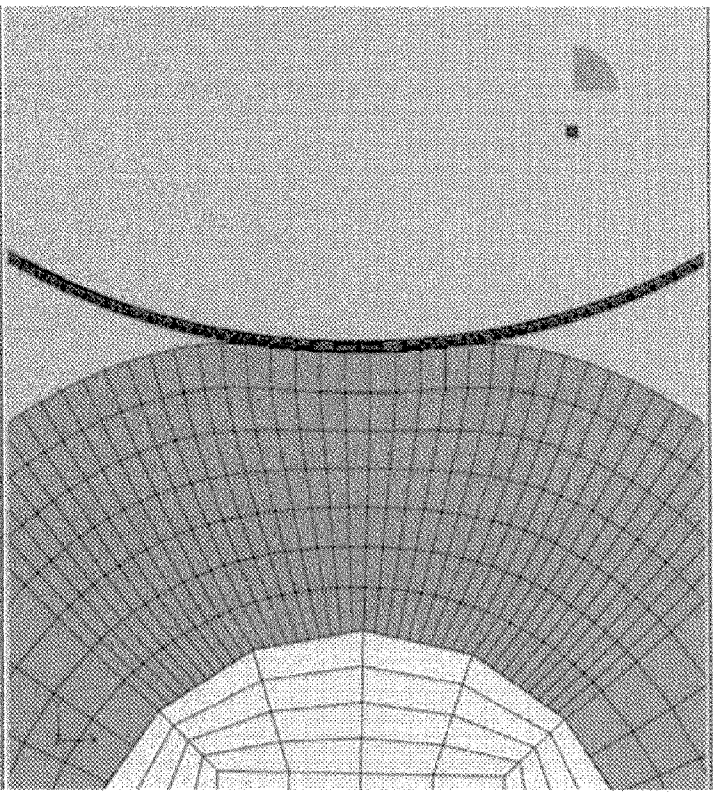

FIG. 34A and FIG. 34B are explanatory diagrams of a deformed state of the contact region between the heat roll and the pressure roll in the experimental results and a cross-sectional diagram along line XXXIV-XXXIV of FIG. 34A, with FIG. 34A being an explanatory diagram of experimental example 1 and FIG. 34B being an explanatory diagram of comparative example 1.

Figures 35A, 35B:
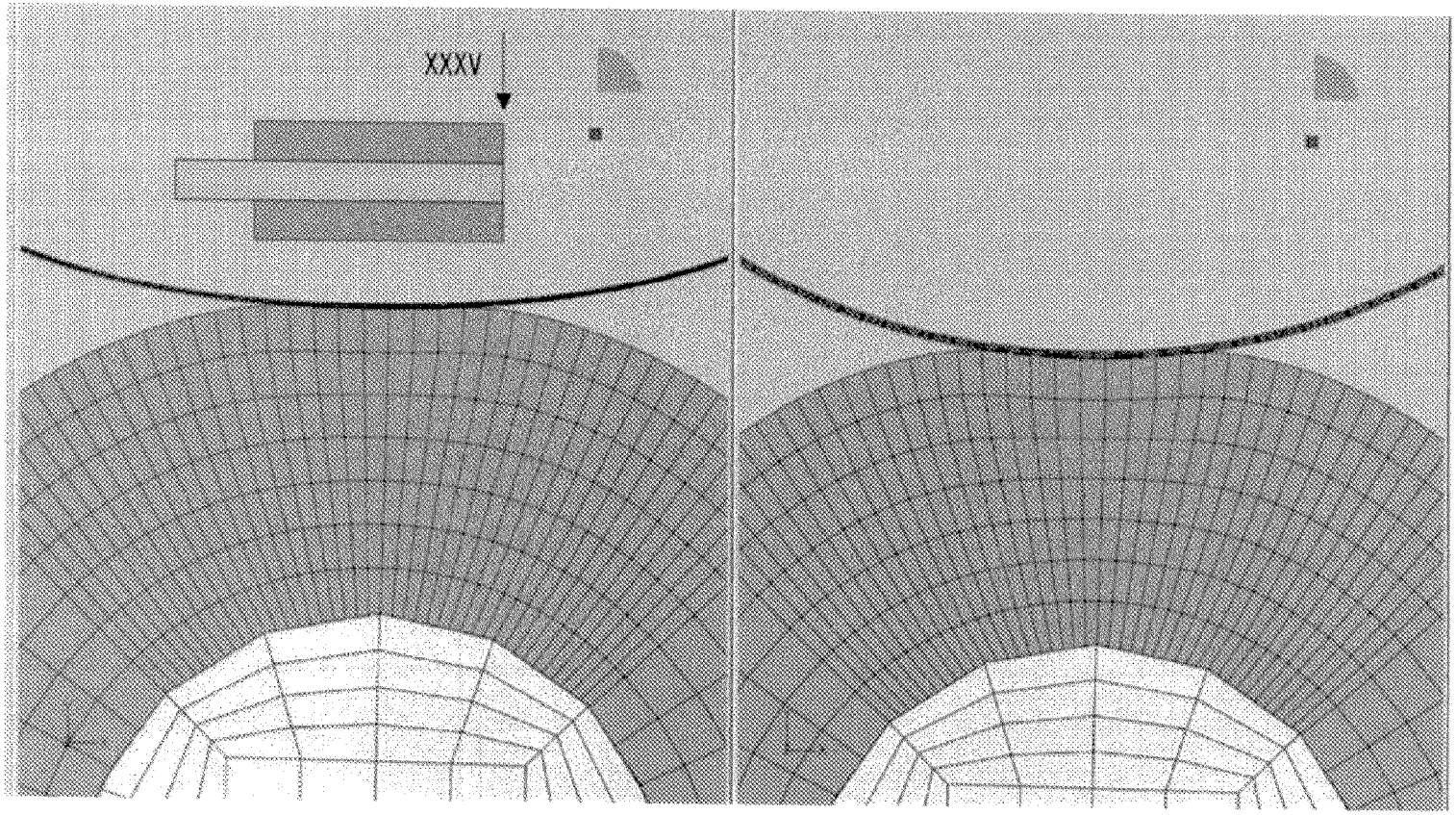
FIG. 35A and FIG. 35B are explanatory diagrams of a deformed state of the contact region between the heat roll and the pressure roll in experimental results and a cross-sectional diagram along line XXXV-XXXV of FIG. 35A, with FIG. 35A being an explanatory diagram of experimental example 1 and FIG. 35B being an explanatory diagram of comparative example 1.

FIG. 35A and FIG. 35B are explanatory diagrams of a deformed state of the contact region between the heat roll and the pressure roll in experimental results and a cross-sectional diagram along line XXXV-XXXV of FIG. 35A, with FIG. 35A being an explanatory diagram of experimental example 1 and FIG. 35B being an explanatory diagram of comparative example 1.

It will be noted that, in FIG. 28A and FIG. 28B to FIG. 35A and FIG. 35B, the experimental results are such that the heat roll Fh and the pressure roll Fp are symmetrical with respect to the axial direction using the axial direction center as a boundary, so the axial direction lengths of the rolls are halved, that is, FIG. 28A and FIG. 28B to FIG. 35A and FIG. 35B show half-size portions from the axial direction center to the axial direction end portion on the +Z side, and illustration of the range from the axial direction center to the axial direction end portion on the −Z side is omitted.

In the present experimental example, the axial direction length of the rubber layer of the pressure roll Fp is 200 mm, the axial direction length of the base body 1 of the heat roll Fh is 250 mm, and the axial direction end portions of the rubber layer contact at positions 25 mm from the ends of the base body 1. It is verified that, whereas in experimental example 1 shown in FIG. 28A, stress is concentrated in the end portions of the base body 1 at portions further inward in the axial direction than the buffer rubber members 44 of the holding members 42 and 43, in comparative example 1 shown in FIG. 28B, stress acts substantially uniformly along the region where the rubber layer of the pressure roll Fp contacts the base body 1.

Further, whereas in comparative example 1 shown in FIG. 29B to FIG. 32B, displacement in the +Y direction is small, three-dimensional strain is also small, and a cylindrical shape is pretty much held, in experimental result 1 shown in FIG. 29A to FIG. 32A, on the side where the base body 1 contacts the pressure roll Fp, toward the center side in the axial direction, the base body 1 is pressed against the pressure roll Fp so that displacement in the +Y direction becomes larger, so, in accompaniment with this deformation, its cross-sectional shape is distorted from a circular shape to an elliptical shape that is long in the X direction. At this time, as indicated by the lattice-like lines in FIG. 29 to FIG. 32, in experimental example 1, three-dimensional strain occurs in correspondence to the inner end portions of the buffer rubber members 44 of the holding members 42 and 43.

Consequently, as shown in FIG. 33B, whereas in the conventional heat roll Fh in comparative example 1, the base body 1 does not deform so much and mainly the rubber layer of the pressure roll Fp deforms, whereby the fixing region is formed, as shown in FIG. 33A, in experimental example 1, at positions that correspond to the inner end portions of the buffer rubber members 44 of the holding members 42 and 43, not only the rubber layer of the pressure roll Fp but also the base body 1 of the heat roll Fh deform, whereby the fixing region is formed. At this time, as shown in FIG. 33A and FIG. 33B, whereas in comparative example 1, the fixing region becomes a shape that curves so as to be recessed toward the pressure roll Fp, however, in experimental example 1, the fixing region becomes substantially flat along the X axis direction, that is, the medium transporting direction.

Similarly, in positions toward the ends from the center in the axial direction shown in FIG. 34A and FIG. 34B and in the center portion in the axial direction shown in FIG. 35A and FIG. 35B, whereas in comparative example 1, a fixing region with a shape where the rubber layer of the pressure roll Fp is mainly recessed is formed, however, in experimental example 1, the heat roll Fh and the pressure roll Fp both deform and a substantially flat fixing region is formed.

[Exemplary Embodiment 23]

Next, description of exemplary embodiment 23 of the present invention will be performed. In the description of exemplary embodiment 23, identical reference signs will be given to configural elements that correspond to the configural elements of exemplary embodiment 1, and detailed description of those corresponding configural elements will be omitted.

Exemplary embodiment 23 differs from exemplary embodiment 1 in the following point but is configured in the same manner as exemplary embodiment 1 in other points.

Figure 36:
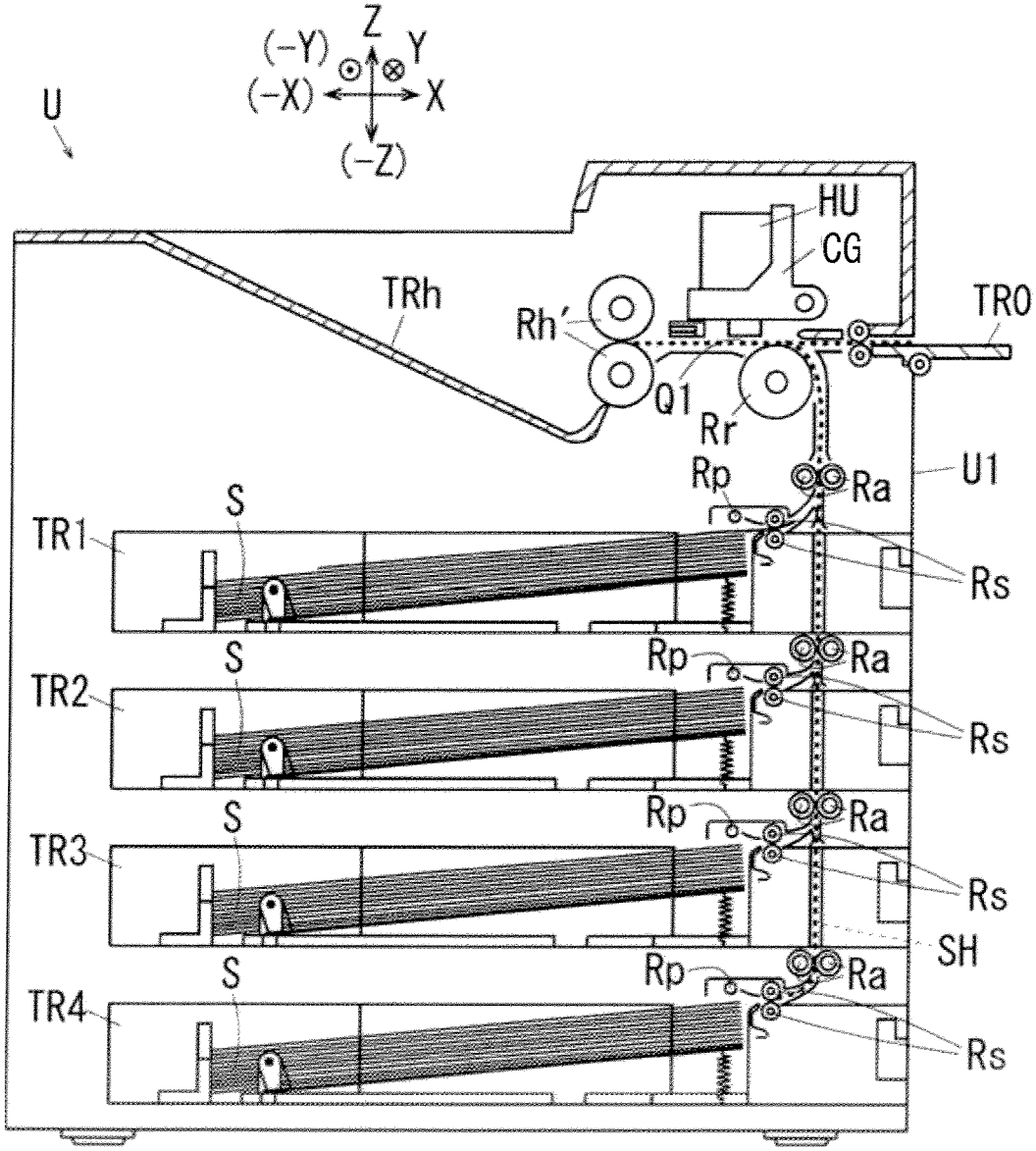
FIG. 36 is an overall explanatory diagram of an image forming apparatus of exemplary embodiment 23 of the invention.

FIG. 36 is an overall explanatory diagram of an image forming apparatus of exemplary embodiment 23 of the invention.

In FIG. 36, a printer U that serves as one example of the image forming apparatus of exemplary embodiment 23 of the invention is configured such that paper feed trays TR1 to TR4 in which are stored sheets S that serve as one example of a medium on which images are recorded are housed in the lower portion of the printer U and such that a paper discharge tray TRh is disposed in the top surface of the printer U.

The printer U of exemplary embodiment 23 is, different from to the electrophotographic printer U of exemplary embodiment 1, configured by an inkjet recording printer, and a head unit HU that serves as one example of an image recording member is disposed in the front side top portion of the printer U. The head unit HU is supported on a carriage CG that serves as one example of a scanning member, and the carriage CG is supported, so as to be movable in the right-left direction, along a shaft CG1 that extends in the medium width direction. The head unit HU records, with respect to the sheet S that is transported by a registration roll Rr and passes through Q1 that is an image recording region, an image by ejecting ink while the carriage CG moves in the shaft CG1 direction. It will be noted that the head unit HU and the carriage CG are conventionally publicly known, so detailed description thereof will be omitted.

Figure 37:
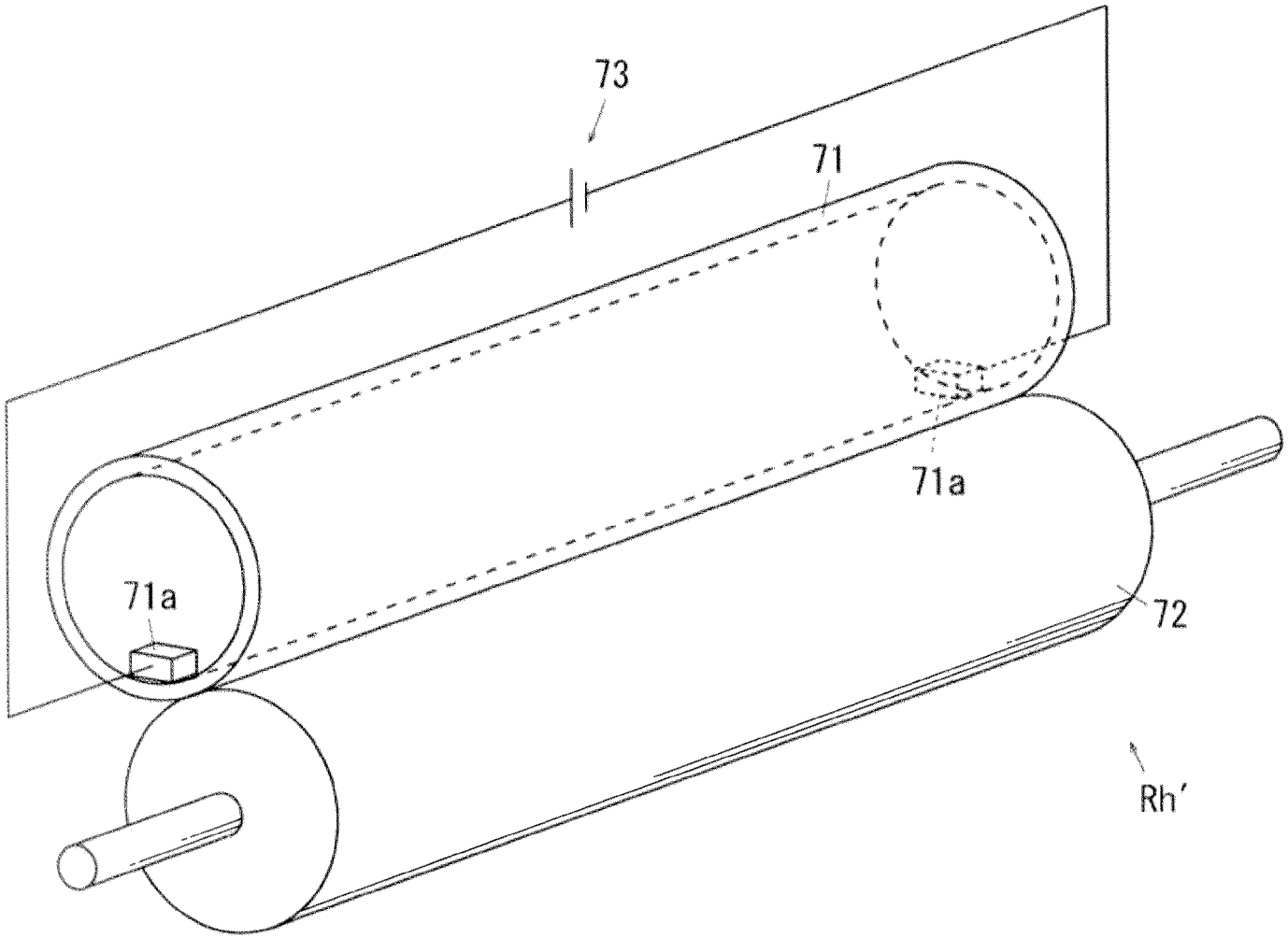
FIG. 37 is an explanatory diagram of relevant portions of discharge rollers of exemplary embodiment 23.

FIG. 37 is an explanatory diagram of main portions of discharge rollers Rh' of exemplary embodiment 23.

In FIG. 36, the discharge rollers Rh' that serve as one example of medium transporting members are disposed on the downstream side of the image recording region Q1. In FIG. 37, the discharge rollers Rh' of exemplary embodiment 23 include a heat roller 71, which is one example of a drive member and serves as one example of a cylindrical rotating member, and a driven roller 72, which serves as one example of a driven member that is disposed facing the heat roller 71. The heat roller 71 and the driven roller 72 of exemplary embodiment 23 are configured in the same manner as the heat roll Fh and the pressure roll Fp of exemplary embodiment 1.

In FIG. 37, power supply terminals 71*a* are disposed in the heat roller 71 of exemplary embodiment 23 in both end portions of the inner peripheral surface on the side where the heat roller 71 contacts the driven roller 72, and electrical power is supplied from a power supply unit 73. Consequently, the heat roller 71 of exemplary embodiment 23 is configured to generate heat by electrical power supply and electric resistance of the base body of the heat roller 71. That is, the heat roller 71 itself of exemplary embodiment 23 is configured to be a heat source member.

A medium transporting device of exemplary embodiment 23 is configured by the registration roll Rr, medium transporting rollers Ra and the discharge rollers Rh'.

(Operation of Exemplary Embodiment 23)

In the printer U of exemplary embodiment 23 that is provided with the above-described configural requirements, the sheet S on which image recording has been performed by inkjet recording by the ejection of ink from the head unit HU is transported to the discharge rollers Rh'. When the sheet S that has been transported to the discharge rollers Rh' passes through the contact region between the heat roller 71 and the driven roller 72, the sheet S is discharged into the discharge tray TRh while being heated by the heat roller 71. Consequently, drying of the sheet S that has been moistened by the ink is promoted by heating, and the sheet S is discharged in a dried state into the discharge tray TRh. At this time, in exemplary embodiment 23, the contact region becomes wider because of the elastic deformation of the heat roller 71, and heating is efficiently performed. Thus, image defects where the ink bleeds into another sheet S when the sheets S are stacked are reduced, time and effort to dry the sheets S is removed, and the sheets S that have been discharged into the discharge tray TRh may be quickly utilized.

Modified Examples

Exemplary embodiments of the present invention have been described in detail above, but the present invention is not limited to the preceding exemplary embodiments and may be variously changed within the range of the gist of the present invention defined in the claims. Modified examples (M01) to (M05) of the present invention are exemplified below.

(M01) In the preceding exemplary embodiments, a printer that serves as an image forming apparatus has been exemplified, but the invention is not limited to this and may also be configured as a fax machine, a copier, or a multifunctional machine that is provided with all of these or plural functions. Further, the invention is not limited to a multicolor developing image forming apparatus and may also be configured by a single color or so-called black-and-white image forming apparatus. Further, the invention is not limited to a configuration where an image is directly transferred to a medium from an image carrier and is also applicable to a configuration that uses an intermediate transfer body.

(M02) In the preceding exemplary embodiments, the configurations that have been exemplified in each of the exemplary embodiments may be combined with each other and made into composites. For example, the configuration of exemplary embodiment 19 may be applied to exemplary embodiments 3, 4, 6 and 11, and exemplary embodiment 12 may be applied to other exemplary embodiments.

(M03) In exemplary embodiments 15 and 22, the metal rings were doubled, but the metal rings may also be tripled or more.

(M04) In the preceding exemplary embodiments, the pressure fixing member is not limited to a roll shape, and a conventionally publicly known arbitrary shape may be used. For example, an endless belt-like pressure fixing member or a so-called pressure belt, or a non-rotating block-like pressure fixing member or a so-called pressure pad, may be used. It will be noted that the above pressure belt is conventionally publicly known.

(M05) In the preceding exemplary embodiments, a case has been exemplified where a cylindrical rotating member is used as the heat fixing member for the fixing device F, but the invention is not limited to this configuration, and a cylindrical rotating member that includes the base body 1 as a medium transporting member that transports a medium, which is not for the fixing device F, may also be used. For example, in an image forming apparatus, a cylindrical rotating member that houses a heat source member inside may be disposed on the downstream side of the fixing device F, the medium may be heated in order to correct curving and waving, or so-called curling that occurs because of variations in the evaporation of moisture in the medium when the medium passes through the fixing device F, and the cylindrical rotating member may be used in order to remove the curls.

What is claimed is:

1. A fixing device comprising:

a heat fixing member that is rotatably supported and is heated; and a pressure fixing member that is supported in a state in which the pressure fixing member is pressed against the heat fixing member, an unfixed image on a surface of a medium between the heat fixing member and the pressure fixing member being fixed thereby, the heat fixing member including:

an elastically deformable base body that is a metal cylinder extending in a width direction of the medium, the width direction intersecting a transport direction of the medium;

holding members disposed at both end portions in an axial direction of the base body, the holding member including:

an insertion portion that is inserted inside the end portion of the base body and maintains contact with the base body all along its periphery to hold a cross-sectional shape of the end portion of the base body in the axial direction in a circular shape; and a received portion that is disposed at an outer end of the insertion portion, in the width direction of the medium, and formed integrally with the insertion portion, and that is thicker than the insertion portion, and a heat source member that extends in an axial direction of the cylindrical base body and is disposed such that the heat source member does not contact the base body, and when the heat fixing member is rotated and a portion of the heat fixing member reaches a fixing portion at which the heat fixing member fixes the unfixed image on the surface of the medium, the portion of the heat fixing member elastically deforms without it being necessary to provide a member that contacts an inner surface of the base body in the fixing portion from within, applies pressure to the medium, increases the size of a contact area with the medium and applies heat to the medium, and after the heat fixing member is further rotated and the portion of the heat fixing member has passed the fixing portion, the heat fixing member elastically recovers its original shape.

2. The fixing device of claim 1, wherein the heat fixing member elastically deforms in a planar manner along the transport direction of the medium in the fixing portion.

3. The fixing device of claim 1, further comprising a gear that is attached to an end portion of the heat fixing member and through which driving force is transmitted to the heat fixing member.

4. The fixing device of claim 1, wherein the cross-sectional shape in the axial direction of the heat fixing member changes from the end portion thereof to a center portion thereof in a contact portion between the heat fixing member and the pressure fixing member.

5. The fixing device of claim 4, wherein the insertion portion has a circular outer periphery surface; and the received portion is rotatably supported by a receiving portion.

6. The fixing device of claim 1, wherein a wall thickness of the heat fixing member is equal to or greater than 50 μm, and the surface pressure at a contact portion at which the heat fixing member contacts the pressure fixing member is equal to or greater than 0.5 $kgf/cm^2$.

7. The fixing device of claim 1, wherein the pressure fixing member includes an elastic layer that is formed with a foam sponge body.

8. The fixing device of claim 1, wherein the pressure fixing member is an endless belt member, and a pressure pad that sandwiches the belt member against the heat fixing member is disposed inside the belt member.

9. The fixing device of claim 1, wherein the heat source member includes a magnetic field generation component that generates a magnetic field, and the heat fixing member includes a heat generating layer that is electromagnetically induced and heated by the magnetic field.

10. The fixing device of claim 9, wherein the heat fixing member includes a temperature-sensitive layer that contacts a surface of the heat generating layer at an opposite side thereof to the magnetic field generation component, and a magnetic permeability start-of-change temperature, at which the magnetic permeability of the temperature-sensitive layer begins to drop continuously, is in a temperature range that is equal to or higher than a fixing setting temperature for fixing of the unfixed image and equal to or lower than a heat resistant temperature of the fixing member.

11. The fixing device of claim 1, wherein a ring shaped member which is elastically deformable is provided between an outer periphery surface of the insertion portion and an inner periphery surface of the base body such that the insertion portion maintains contact with the base body all along its periphery via the ring shaped member.

12. The fixing device of claim 11, wherein the ring shaped member is a buffer member which alleviates stress concentration in the base body by elastically deforming according to the elastically deformable base body.

13. The fixing device of claim 1, wherein, in a cross section including a rotating axis of the base body, at least a portion of the insertion portion is overlapped, along the axial direction, to an end portion in the axial direction of the contact portion where the base body of the heat fixing member contacts the pressure fixing member.

14. The fixing device of claim 1, wherein a buffer member, which alleviates stress concentration in the base body by elastically deforming according to the elastically deformable base body, is provided between an outer periphery surface of the insertion portion and an inner periphery surface of the base body such that the insertion portion maintains contact with the base body all along its periphery via the buffer member.

15. An image forming apparatus comprising:

an image carrier;

a latent image forming device that forms a latent image on a surface of the image carrier;

a developing device that develops the latent image on the surface of the image carrier into a visible image;

a transfer device that transfers the visible image on the surface of the image carrier to a medium; and a fixing device that fixes the visible image to the medium surface, the fixing device including:

a heat fixing member that is rotatably supported and is heated; and a pressure fixing member that is supported in a state in which the pressure fixing member is pressed against the heat fixing member, an unfixed image on a surface of a medium between the heat fixing member and the pressure fixing member being fixed thereby, the heat fixing member including:

an elastically deformable base body that is a metal cylinder extending in a width direction of the medium, the width direction intersecting a transport direction of the medium; and holding members disposed at both end portions in an axial direction of the base body, the holding member including:

an insertion portion that is inserted inside the end portion of the base body and maintains contact with the base body all along its periphery to hold a cross-sectional shape of the end portion of the base body in the axial direction in a circular shape; and a received portion that is disposed at an outer end of the insertion portion, in the width direction of the medium, and formed integrally with the insertion portion, and that is thicker than the insertion portion, a heat source member that extends in an axial direction of the cylindrical base body and is disposed such that the heat source member does not contact the base body, and when the heat fixing member is rotated and a portion of the heat fixing member reaches a fixing portion at which the heat fixing member fixes the unfixed image on the surface of the medium, the portion of the heat fixing member elastically deforms without it being necessary to provide a member that contacts an inner surface of the base body in the fixing portion from within, applies pressure to the medium, increases the size of a contact area with the medium and applies heat to the medium, and after the heat fixing member is further rotated and the portion of the heat fixing member has passed the fixing portion, the heat fixing member elastically recovers its original shape.

16. A heat fixing member for a fixing device that includes a heat fixing member that is rotatably supported and is heated and a pressure fixing member that is supported in a state in which the pressure fixing member is pressed against the heat fixing member, the fixing device fixing an unfixed image on a surface of a medium between the heat fixing member and the pressure fixing member, the heat fixing member for a fixing device comprising:

an elastically deformable base body that is a metal cylinder that extends in a width direction of the medium, the width direction intersecting a transport direction of the medium;

a holding portion that includes a base body insertion portion that is inserted inside an end portion of the base body and having a circular outer periphery that maintains contact with the base body all along its periphery to hold a cross-sectional shape of the end portion of the base body in the axial direction in a circular shape, and a received portion that is disposed at an outer end of the base body insertion portion, in the width direction of the medium, and is rotatably supported by a receiving member, and formed integrally with the insertion portion, and that is thicker than the insertion portion, and a heat source member that extends in an axial direction of the cylindrical base body and is disposed at a distance from an inner surface of the base body, and when the heat fixing member is rotated and a portion of the heat fixing member reaches a fixing portion at which the heat fixing member fixes the unfixed image on the surface of the medium, the portion of the heat fixing member elastically deforms without it being necessary to provide a member that contacts an inner surface of the base body in the fixing portion from within, applies pressure to the medium, increases the size of a contact area with the medium and applies heat to the medium, and after the heat fixing member is further rotated and the portion of the heat fixing member has passed the fixing portion, the heat fixing member elastically recovers its original shape.

* * * * *